United States Patent [19]

Uram

[11] 4,220,869

[45] Sep. 2, 1980

[54] DIGITAL COMPUTER SYSTEM AND METHOD FOR OPERATING A STEAM TURBINE WITH EFFICIENT CONTROL MODE SELECTION

[75] Inventor: Robert Uram, East Pittsburgh, Pa.

[73] Assignee: Westinghouse Electric Corp., Pittsburgh, Pa.

[21] Appl. No.: 449,562

[22] Filed: Mar. 8, 1974

Related U.S. Application Data

[63] Continuation of Ser. No. 247,849, Apr. 26, 1972, abandoned.

[51] Int. Cl.[2] ..... H02P 9/04

[52] U.S. Cl. ..... 290/40 R; 364/494

[58] Field of Search ..... 415/1, 17; 235/121.21; 290/40

[56] References Cited

U.S. PATENT DOCUMENTS

| | | | |
|---|---|---|---|
| 3,552,872 | 1/1971 | Giras et al. | 290/40 |
| 3,588,265 | 6/1971 | Berry | 415/1 |
| 3,741,246 | 6/1973 | Braytenbah | 290/40 |

*Primary Examiner*—J. V. Truhe
*Assistant Examiner*—John W. Redman
*Attorney, Agent, or Firm*—E. F. Possessky

[57] ABSTRACT

A control system for a steam turbine includes an operator's panel and a programmed digital computer which generates valve position signals for the turbine throttle and governor valves. Mode select signals are generated at the panel and the computer includes a mode selector which provides for structuring the control system to implement external synchronizer, load runback, automatic turbine startup, operator automatic, manual and other mode selections.

12 Claims, 37 Drawing Figures

REFDMD
SPEED FEEDBACK LOOP
REF1
X
Y
REF2
GR3
PISP
N
IPI
Y
RESPI
% + S
VSP
PI
1876

REFDMD
SPEED FEEDBACK LOOP
REF1
X
N
MWI
Y
1087
1086
REF2
1089
A
RESMW
% + S
1084
1082
MW
1091

DIGITAL COMPUTER SYSTEM AND METHOD FOR OPERATING A STEAM TURBINE WITH EFFICIENT CONTROL MODE SELECTION

This is a continuation of application Ser. No. 247,849 filed Apr. 26, 1972, now abandoned.

BACKGROUND OF THE INVENTION

The present invention relates to the elastic fluid turbines and more particularly to systems and methods for operating steam turbines and electric power plants in which generators are operated by steam turbines.

In the operation of steam turbines, electric analog controls have been provided as set forth for example in U.S. Pat. No. 3,097,488. Once the various control configurations are defined for a turbine, it is necessary or desirable to arrange the control system so as to provide for transfer from one control configuration to another or from one mode of turbine operation to another, such as from speed mode to load mode, single valve to sequential valve, remote dispatch to local automatic, etc.

Generally, various kinds of operating modes for steam turbines have been used in the prior art. An operator interface between a control panel and the prior art analog control circuitry has provided for mode transfers by operator selection. Further, certain automatic transfers have been made by prior art control systems between some control modes on the occurrence of contingencies or other transfer trigger events.

In Ser. No. 408,962 there is disclosed a steam turbine system operated by a digital computer control. The present application is directed to those aspects of a steam turbine system and a turbine controller related to the manner in which the turbine operating mode is controlled and implemented. Thus, in the application of a digital computer to control the operation of a steam turbine which drives an electric generator to produce electric power, it is desirable to employ the computer in the control system so as to provide for smooth turbine operation in various operating modes and during transfer between such modes while simultaneously providing user convenience and enabling the turbine and power plant to meet performance demand reliably and efficiently.

SUMMARY OF THE INVENTION

An automatic steam turbine digital control system includes an operator panel for generating mode select signal and means for digitally generating valve position signals in response to panel speed/load signals and mode select signals. Provision is made for any or all of a plurality of mode changes or selections including speed/load bumpless transfer, manual/automatic transfer if tracking is valid, external synchronizer, and automatic startup.

CROSS-REFERENCE TO RELATED APPLICATIONS

1. Ser. No. 408,962, entitled "System and Method for Starting, Synchronizing and Operating a Steam Turbine with Digital Computer Control" filed as a continuation of Ser. No. 247,877 which had been filed by Theodore C. Giras and Robert Uram on Apr. 26, 1972 and assigned to the present assignee.

DESCRIPTION OF THE PREFERRED EMBODIMENT

A. POWER PLANT

Figure 1:
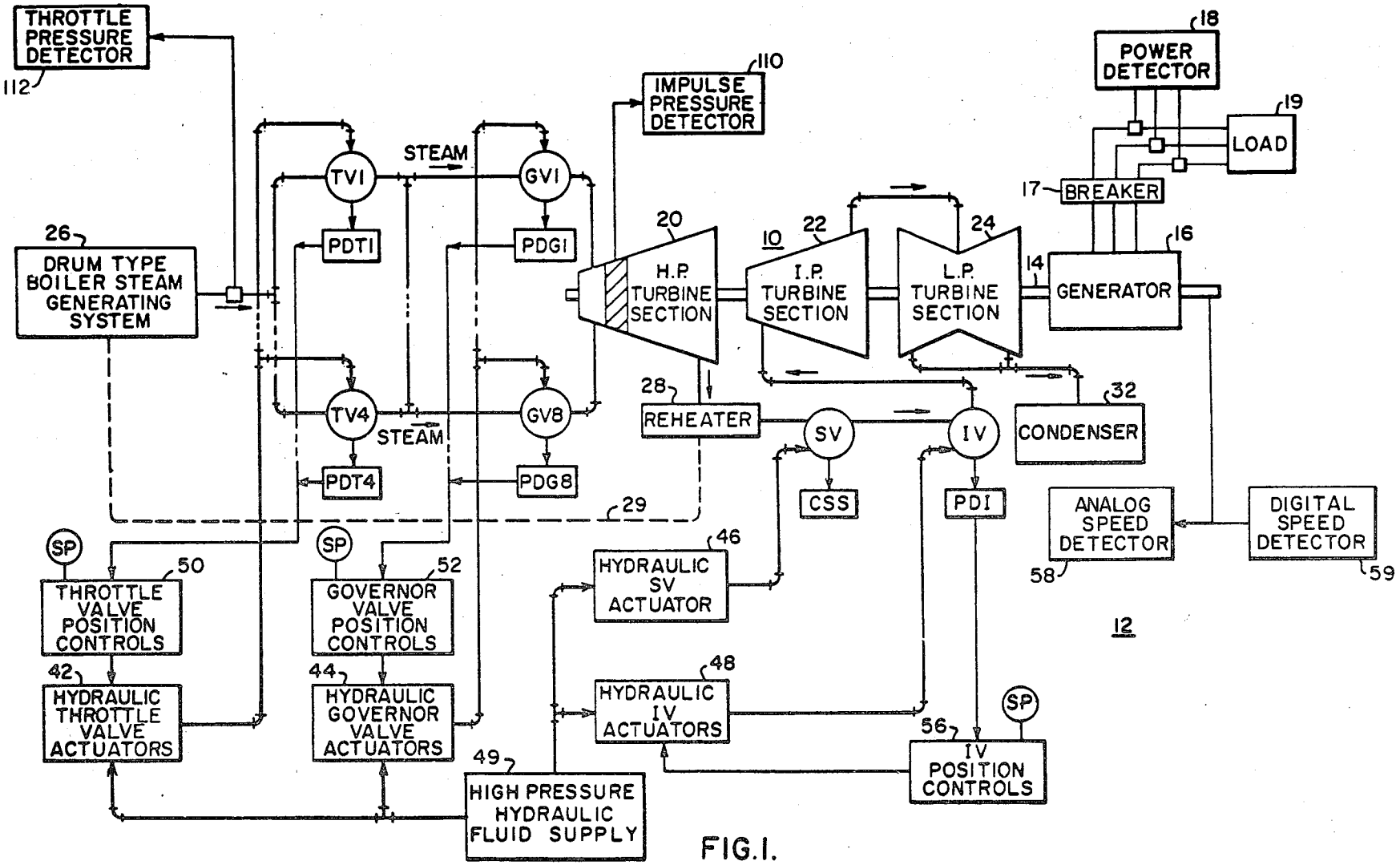
FIG. 1 shows a schematic diagram on an electric power plant including a large steam turbine and a fossile fuel fired drum type boiler and control devices which are all operable in accordance with the principles of the invention.
Figure 2:
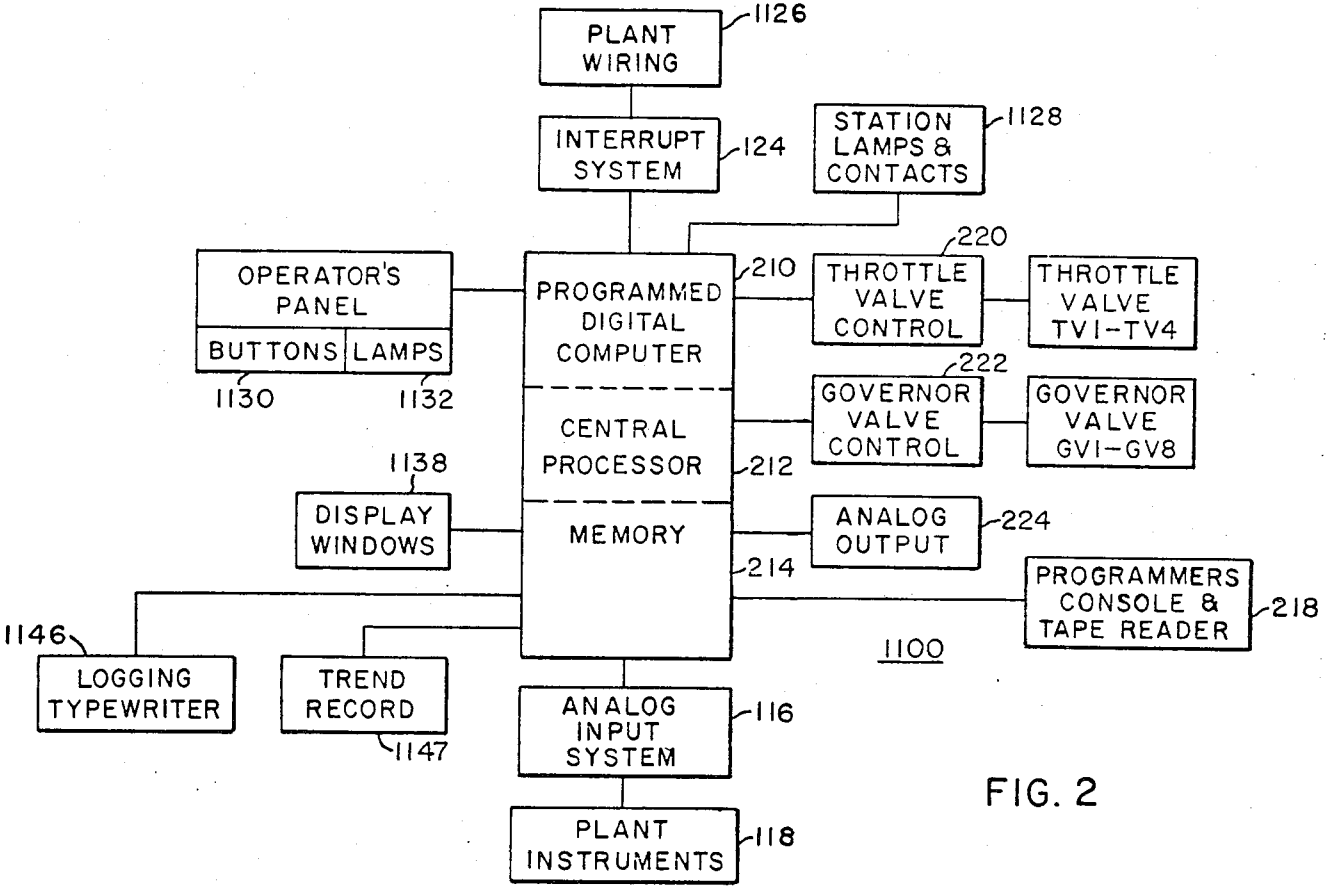
FIG. 2 shows a schematic diagram of a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be affected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valves.

Steam is directed from the admission steam chest to the first high pressure section expansion stage through sight governor inlet valves GV1–GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are throttle all fully opened and steam flow control is provided by a full arc throttling valve operation. At some point in the start-up process, transfer is made from full arc throttle valve control to full arc governor valve control because of throttling energy losses and/or throttling control capability. Upon transfer the throttle valves TV1–TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turbine speed and/or load operation level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1–PDT4, PDG1–PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1-PDT4, PDG1-PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH—COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. A detailed list of all parameters is provided in Appendix 1. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters as well as alarms generated, by an automatic turbine startup system (ATS) which includes program system blocks 1140, 1142, 1144 (FIG. 4) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system, is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3A:
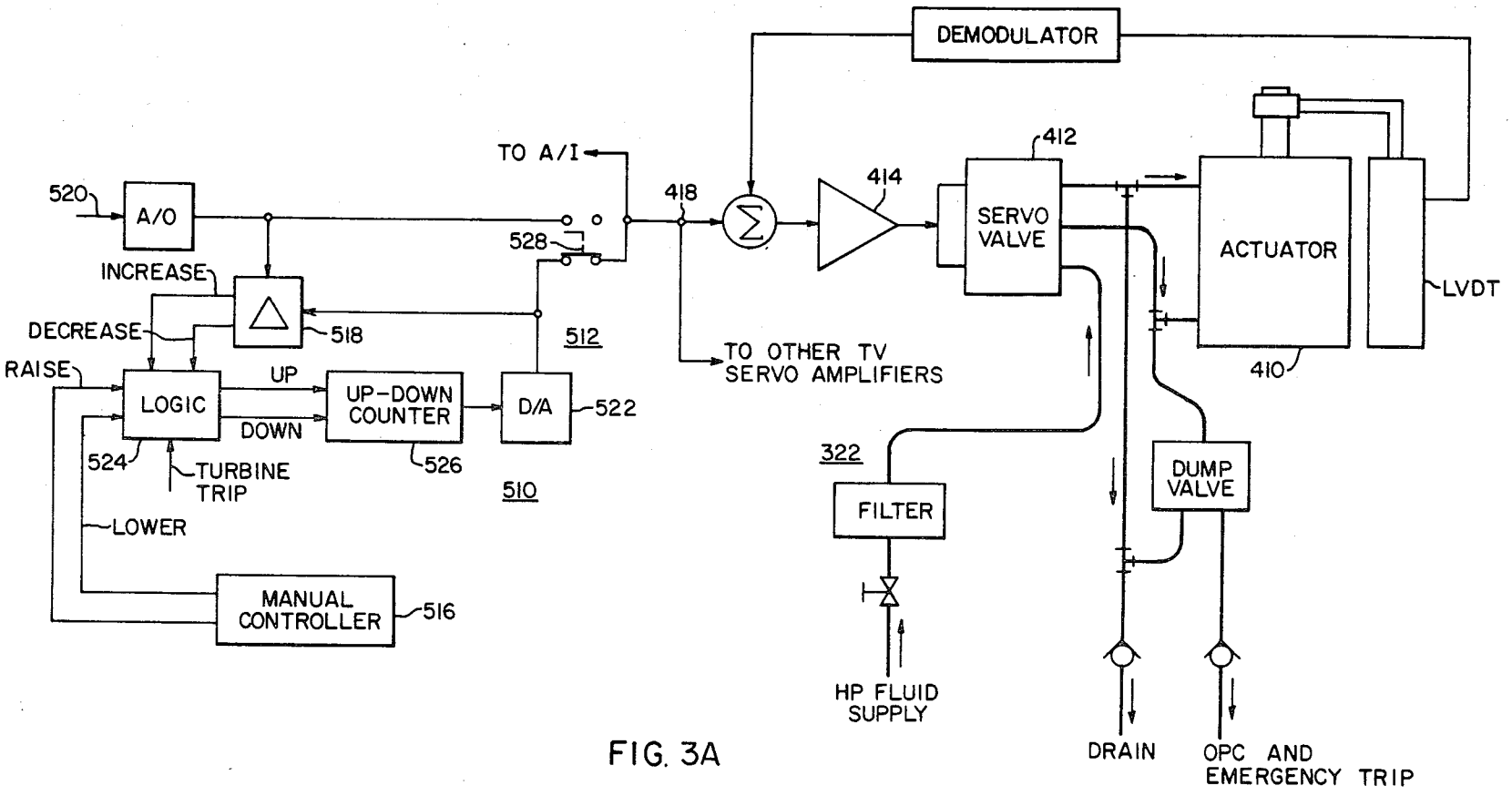
FIGS. 3A, 3B and 3C show a schematic diagram of a hybrid interface between a manual backup system and the digital computer connected with the servo system controlling the valve actuators.
Figure 3B:
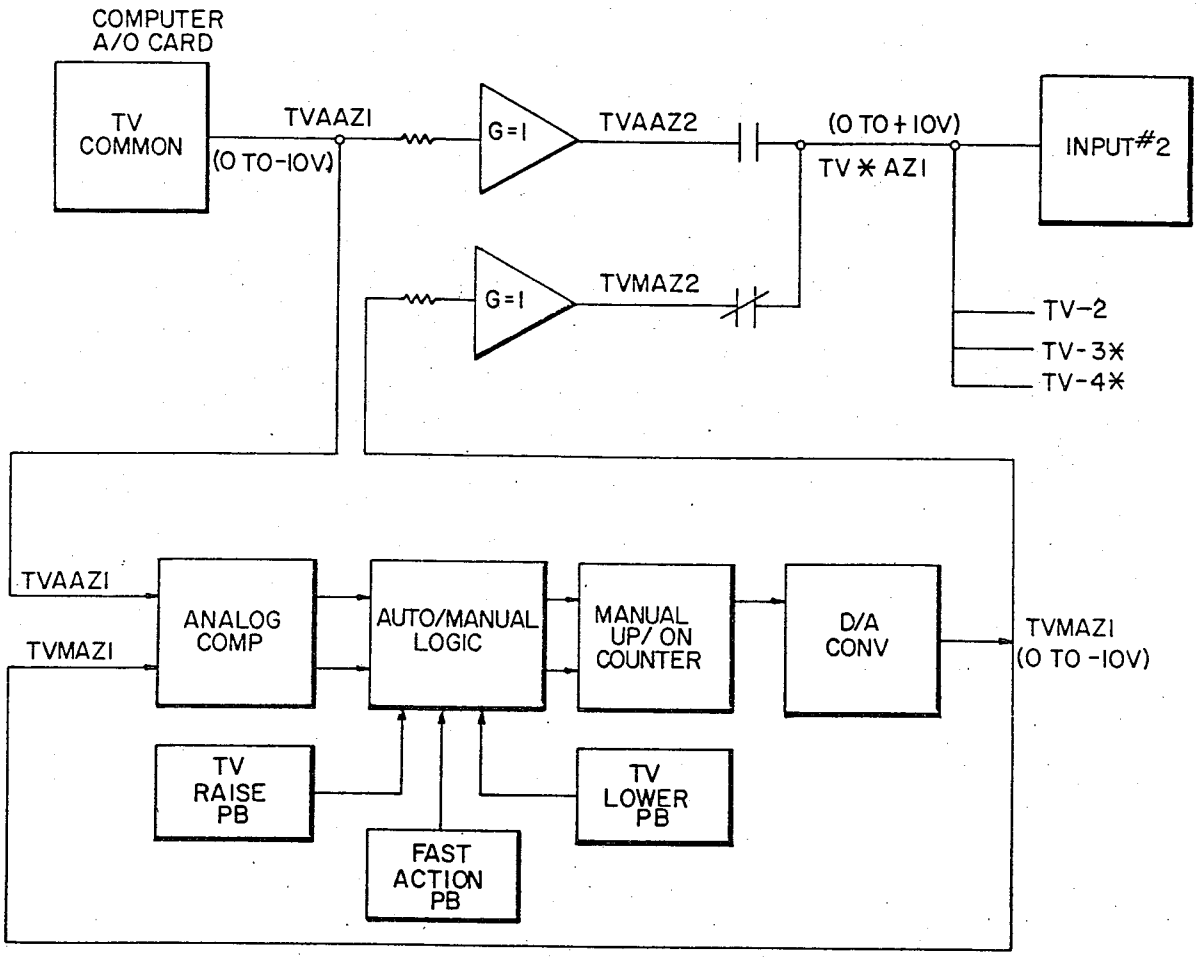
Figure 3C:
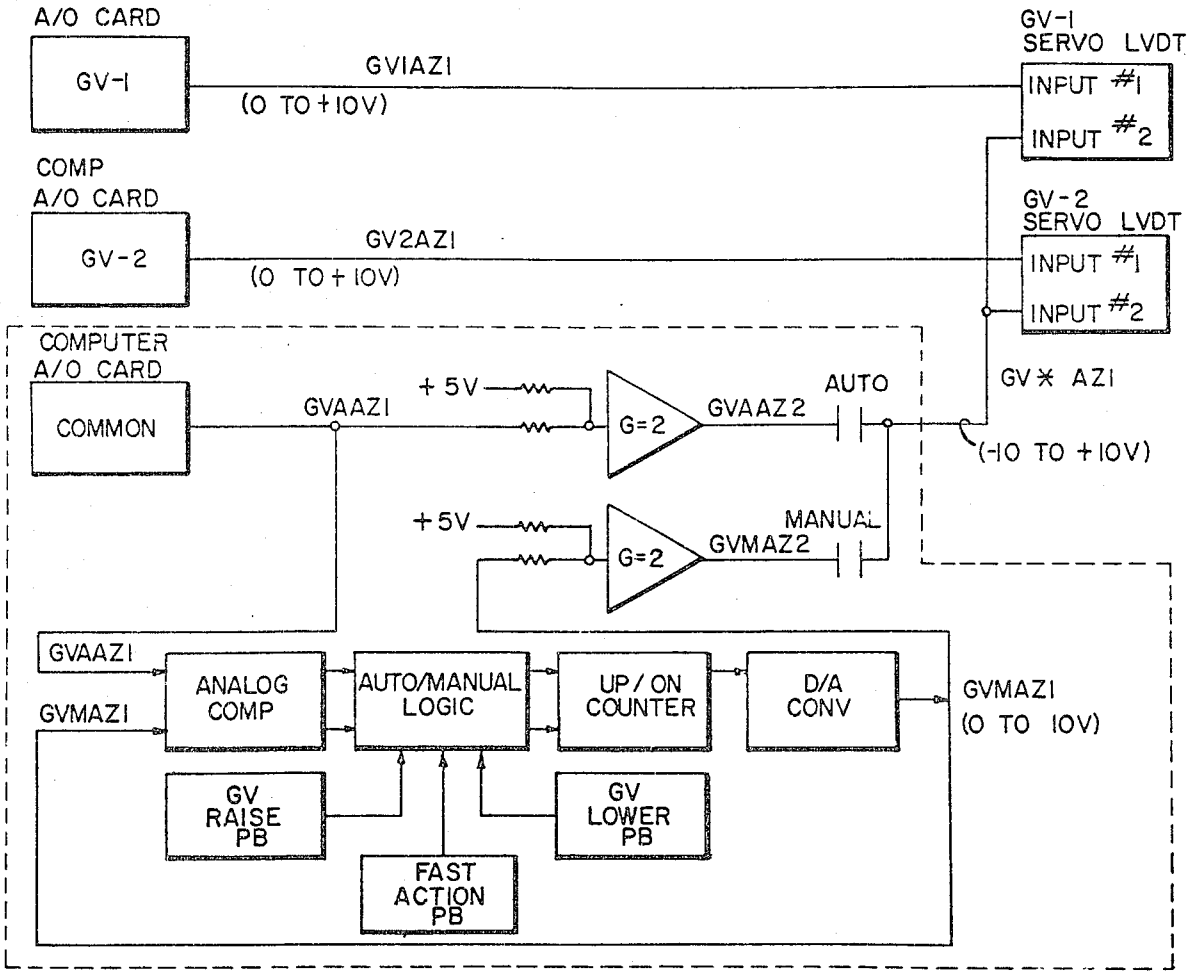

Making reference now to FIGS. 3A–3C, a hardwired digital/analog system forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system. The hybrid interface 510 is connected to actuator system servo-amplifiers 414 for the various steam valves which in turn are connected to a manual controller 516, an overspeed protection controller, not shown, and redundant DC power supplies, not shown.

A controller shown in FIG. 3A is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks signal valve analog outputs 520 from the digital computer 210. A comparator 518 compares a signal from a digital-to-analog converter 522 of the manual system with the signal 520 from the digital computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structure arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

Figure 4:
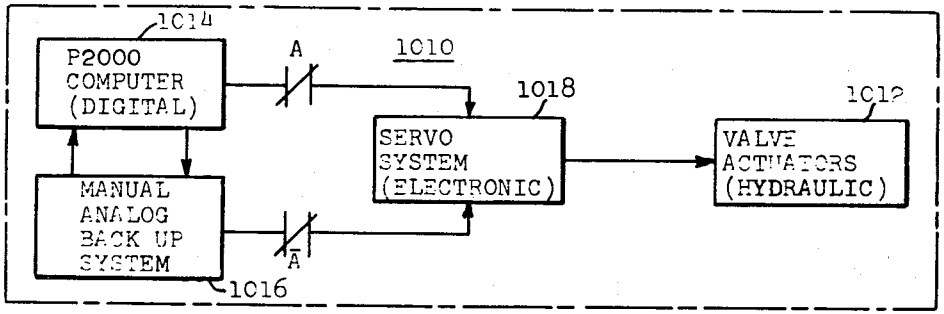
FIG. 4 shows a simplified block diagram of the digital Electro Hydraulic Control System in accordance with the principles of the invention.

With reference now to FIG. 4, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention. More functional detail on various program is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

Figure 5:
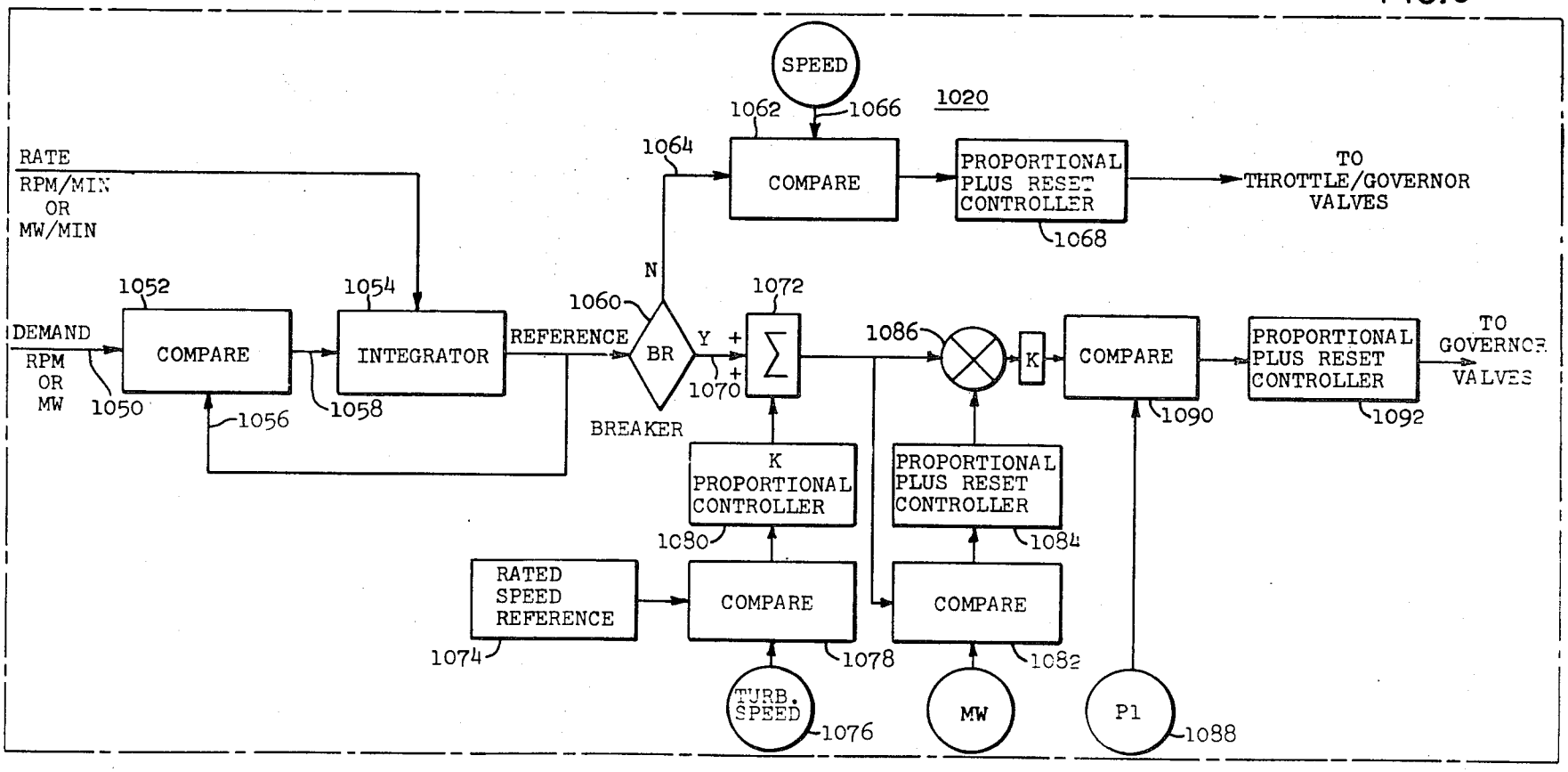
FIG. 5 shows a block diagram of a control program used in accordance with the principles of the invention.

With reference now to FIG. 5, a functional control loop diagram in its preferred form includes the CONTROL task or program 1020 which is executed in the computer 1010. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 5 at the input 1050 of a compare block 1052.

The rate input either in specified RPM per minute or specified megawatts per minute, depending upon which input is to be used in the demand function, is applied to an integrator block 1054. The 10 the rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signal may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a "two signal" speed value represented by box 1076. The two signal speed system provides turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively to correct load mismatch, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset controller function 1092.

During load control the megawatt loop comprising in part blocks 1082 and 1084 may be switched out of service leaving the speed loop 1310 and an impulse pressure loop operative in the DEH system 1100.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1–GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller input 1092 causes positioning of the governor valves GV1–GV8 in load control to achieve the desired megawatt demand while compensation is made for speed, megawatt and impulse pressure deviations from desired setpoints.

Figure 6:
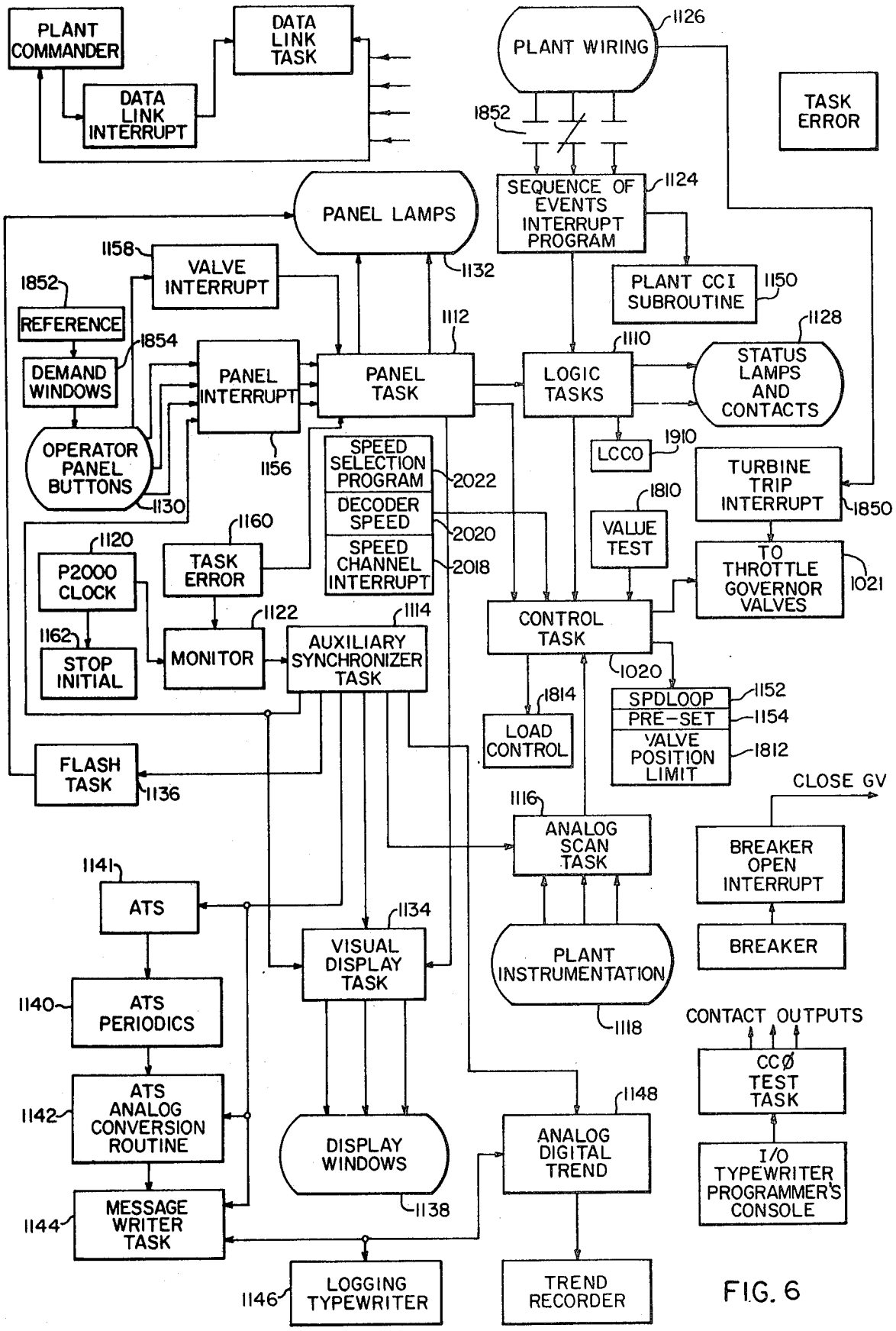
FIG. 6 shows a block diagram of the programs and subroutines of the digital Electro Hydraulic and the automatic turbine startup and monitoring program in accordance with the principles of the invention.

Making reference to FIG. 6, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 an an analog scan program 1116 which processes input process data. The analog scan task 1116 receives data from plant instrumentation 1118 external to the computer as considered elsehwere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are registered with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states, according to predetermined conditions and transmits this data to the control program 1020 where this information is utilized in determining the positioning control action for the throttle valves TV1–TV4, and the governor valves GV1–GV8. The logic task 1110 also controls the state of various lamps and relay type contact outputs in a predetermined manner.

Another important part of the DEH system is the OPERATOR'S PANEL program. The operator communicates through the panel with the DEH control programs by means of various buttons which have assigned functions. When any button is pressed, a special interrupt is generated; this interrupt triggers a PANEL INTERRUPT program which decodes the button pressed, and then bids the PANEL task. The PANEL program processes the button and takes the proper action, which usually means manipulating some panel lamps, as well as passing on the button information to both the LOGIC and the CONTROL tasks.

The Operator's Panel also has two sets of display windows which allow display of all turbine program parameters, variables, and constants. A visual display task presents this information in the windows at the request of the operator through various dedicated display buttons and a numerical keyboard. The visual display values are periodically updated in the windows as the quantity changes.

Certain important turbine operating conditions are communicated to the DEH operator by way of flashing lamps on the panel. Therefore a special FLASH program is part of the DEH system. Its function is to monitor and detect such contingency conditions, and flash the appropriate lamp to alert the operator to the state.

E. SPEED LOOP SUBROUTINE

Figure 7:
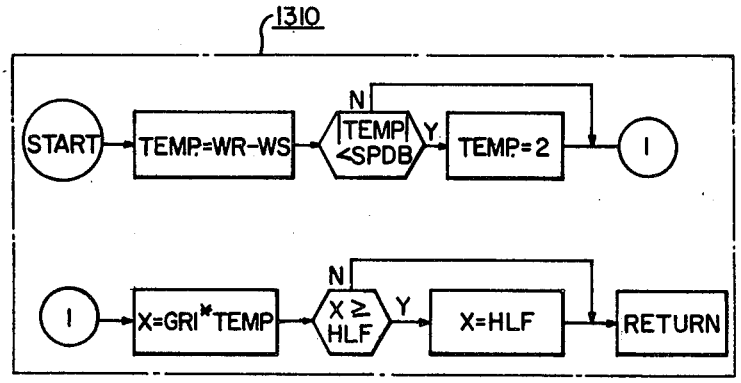
FIG. 7 shows a flow chart of a speed loop (SPDLOOP) subroutine which is operable in accordance with the principles of the invention.

Making reference now to FIG. 7, a speed loop program 1310 which functionally is part of the arrangement shown in FIG. 5 is shown in greater detail. The speed loop (SPDLOOP) program normally computes data required in the functioning of the speed feedback loop in the load control comprising as shown in FIG. 5 the rated speed reference 1074, the actual turbine speed 1076, the compare function 1078, the proportional controller 1080 and the summing function 1072. During the load control, the speed feedback loop adjusts the load reference (and thus the governor valves) to correct for any turbine speed deviation from rated speed. The speed feedback loop uses a proportional controller to accomplish this function. The speed loop subroutine 1310 is called upon to perform speed control loop functions by the control program 1020.

The speed loop (SPDLOOP) subroutine is called by the CONTROL TASK during the load control mode and when switching occurs between actual speed signals. Subroutine form reduces the requirement for storage space thereby reducing the computer expense required for operation of the DEH system 1100.

The deadband function 1312 provides for bypassing small noise variations in the speed error generated by the compare function 1078 so as to prevent turbine speed changes which would otherwise occur. Systems without a deadband continuously respond to small variations which are random in nature resulting in undue stress in the turbine 10 and unnecessary, time and duty cycle consuming operation of the control system. A continuous hunting about the rated speed due to the gain of the system would occur without the deadband 1312. The speed regulation GR1 at 1314 is set to yield rated megawatt output power speed correction for a predetermined turbine speed error. The high limit HLS at 1316, provides for a maximum speed correction factor.

The turbine speed 1076 is derived from three transducers. The turbine digital speed transducer arrangement is that disclosed in greater element and system implementation detail in the aforementioned Reuther Application Ser. No. 412,513. Briefly, in the preferred embodiment for determining the speed of the turbine, the system comprises three independent speed signals. These speed signals consist of a very accurate digital signal generated by special electronic circuitry from a magnetic pickup, an accurate analog signal generated by a second independent magnetic pickup, and a supervisory analog instrument signal from a third independent pickup. The DEH system compares these signals and through logical decisions selects the proper signal to use for speed control or speed compensated load control. This selection process switches the signal used by the DEH control system 1100 from the digital channel signal to the accurate analog channel signal or vice versa under predetermined dynamic conditions. In order to hold the governor valves at a fixed position during this speed signal switching the control program 1020 uses the speed loop subroutine 1310 and performs a computation to maintain a bumpless speed signal transfer.

Two FORTRAN statements signify the operations of the speed loop subroutine program flow chart 1310. These statements are:

CALL SPDLOOP

REF1=REFDMD+X

Variables in the flow chart 1310 are defined as follows:

| FORTRAN VARIABLES | ENGLISH LANGUAGE EQUIVALENT |
|---|---|
| REFMD | Load reference |
| WR | The turbine rated speed |
| REF1 | Corrected load reference |
| WS | The actual turbine speed |
| TEMP | Temporary storage location variable |
| SPDB | The speed deadband |
| GR1 | The speed regulation gain (normally set to yield rated megawatt speed correction for a 180 rpm speed error) |
| X | Speed correction factor |
| HLF | The high limit function |

F. PLANT CONTACT CLOSURE INPUT (PLANTCCI) SUBROUTINE

A plant contact closure input subroutine 1150 as shown in FIG. 6, scans all the contact inputs tied to the computer through the plant wiring 1126 and sets logic data images of these in designated areas within the memory.

Various situations call for the PLANTCCI subroutine. The most common case represents a basic design feature of the DEH system; that is, the situation in which a change of state of any contact input triggers a sequence of events interrupt. A corresponding interrupt program then calls the PLANTCCI subroutine to do a scan of all contact inputs and to update the computer contact image table. Thus (under normal conditions) a contact scan is carried out only when necessary. The plant contact closure input subroutine 1150 is also utilized when power to the computer 210 is turned on or when the computer buttons reset-run-reset are pressed on a maintenance panel 1410. Under these circumstances, a special monitor power-on routine 1412 is called upon. This program executes the computer STOP/INITIALIZE task 1414 described previously, which in turn calls the plant contact closure input subroutine 1150 for performance of the initializing procedure.

The operator can also call the plant contact closure input subroutine 1150 through the auxiliary synchronizer program 1114, if desired, whereby a periodic scan of the entire computer CCI system is implemented for checking the state of any one or group of relays in the CCI system.

This call is contingent upon the entry of a non-zero value for the constant PERCCI from the DEH Operator's Panel keyboard.

OPERATOR'S PANEL AND FLASH PROGRAM

Figure 8:
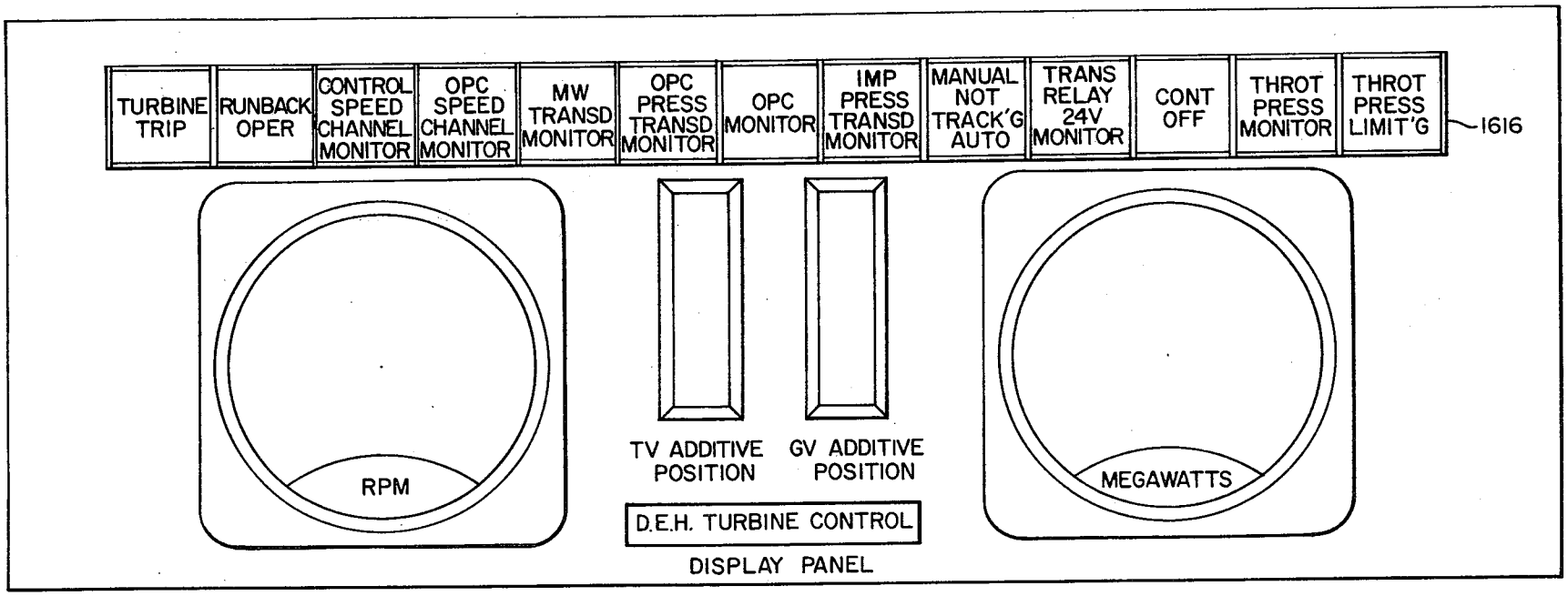
FIG. 8 shows a view of a part of an operator's control panel which is operable in accordance with the principles of the invention.
Figure 9:
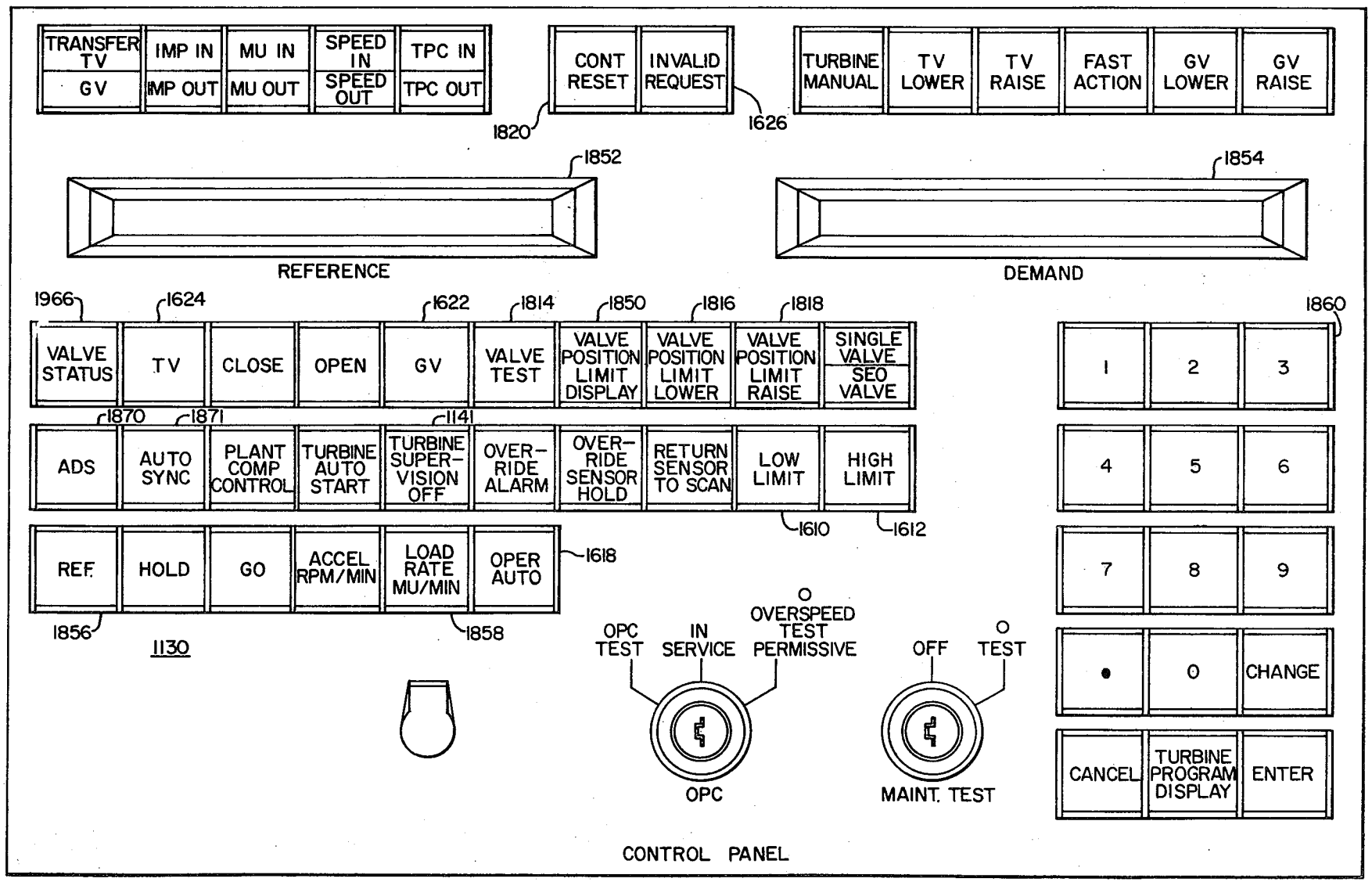
FIG. 9 shows a view of a part of the operator's control panel which is operable in accordance with the principles of the invention.
Figure 10:
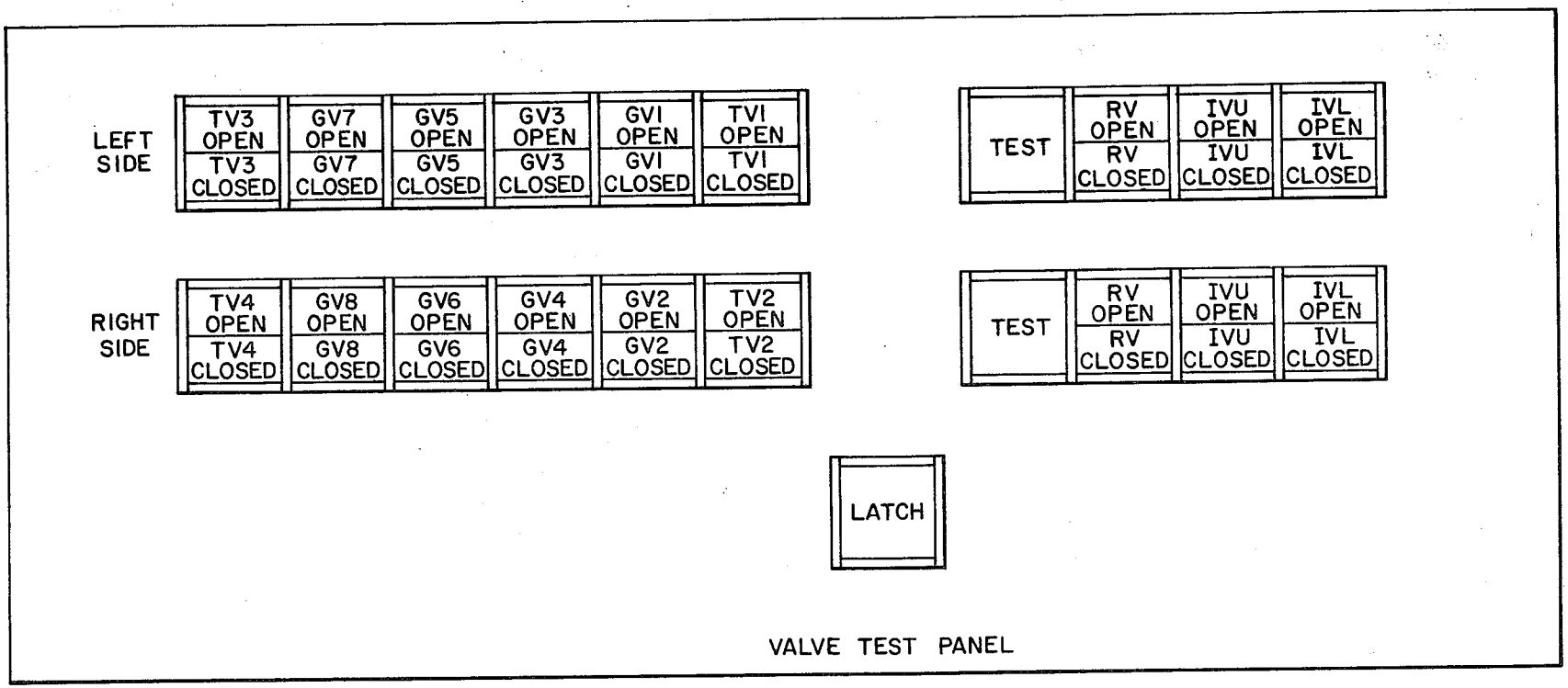
FIG. 10 shows a view of a portion of the operator's control panel which is operable in accordance with the principles of the invention.

Referring now to FIGS. 8, 9 and 10 the control panel 1130 for the digital electrohydraulic system 1100 is shown in detail. Specified functions have control panel buttons which flash in order to attract the attention of an operator.

The control of the operation of the DEH control system 1100 is greatly facilitated for the operator by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time. Further, it is noteworthy that manual and automatic operator controls are at the same panel location for good operator interface under all operating conditions. More detail on the functioning of the panel pushbuttons is presented in Appendix 2 and elsewhere in the description of the DEH programs herein.

In addition the layout of the panel 1130 of FIGS. 8, 9 and 10 is unique and very efficient from operation and operator interface considerations. The control of the DEH system 1100 by the buttons of the panel 1130 and the software programs thereto provides improved operation of the computer 210 and turbine generator 10.

Software details of the panel 1130 interface are available in the appendices 3, 4, 5 and 6.

G. ANALOG SCAN PROGRAM

In order to carry out its function, a computer control system must be provided with input signals from the process or plant variables which are to be controlled. However, the vast majority of real process variables (for example pressure, temperature and position) are analog or continuous in their natural form, whereas the organization and internal structure of computers is digital or discontinuous in nature. This basic difference in information format between the controller and the controlled process must be overcome with interfacing equipment which converts process signals to an appropriate computer numerical value.

A device which can accomplish this function is the analog-to-digital (A/D) converter. The A/D converter provides the interface between plant analog instrumentation and the digital control system. Normally the analog signal as picked up from a transducer is in the millivolt or volt range, and the A/D converter produces an output bit pattern which may be stored in computer memory. A/D converters can only convert a limited number of analog inputs to digital form in a given interval of time. The usual method of stating this limit is to indicate the number of points (analog inputs) which can be converted in 1 sec. Thus, the A/D converter used in the DEH system has a capacity of 40 pps. Since the total number of analog inputs to the DEH system may be as high as 224, depending on the type of turbine to be controlled and the control system options selected, most of these must be scanned at a reduced frequency.

The nature of the plant variables which represent the analog inputs, and the sampling frequency of control programs using these inputs, are normally considered when one determines the scanning frequency of various analog input signals. In the DEH system, the control programs execute once a second and the primary analog signals used by the control system are generated megawatts, impulse pressure, throttle pressure, turbine speed and valve position. Since each of these variables may change a significant amount in a few seconds, all of these are scanned once a second. On the other hand, the majority of the analog inputs to the ATS program are temperatures which require minutes before significant changes in them may be observed. Consequently, all temperatures in the DEH system are scanned once a minute. The ATS program also requires a group of vibrations, which are scanned once every 5 sec, and a group of miscellaneous variables which are scanned once every 10 sec.

The analog scan program 1116, shown in FIG. 6 periodically scans all analog inputs to the DEH system 1100 for control and monitoring purposes. The function of the analog scan program 1116 is performed in two parts. The first part of the analog scan program 1116 comprises the scanning of a first group of analog inputs. Values of scanned inputs are converted to engineering units and the values are checked against predetermined limits as required for computations in the DEH computer.

The second part of the function of the analog scan program 1116 comprises the scanning of the analog inputs required for the automatic turbine startup program as shown in FIG. 6. Conversion and limit-checking of this latter group of inputs is performed by another program. The automatic turbine startup program is shown in FIG. 6 as the ATS periodic program 1140, the ATS analog conversion routine 1142 and the ATS message writer program 1144.

H. LOGIC TASK

The LOGIC task determines the operational status of the DEH turbine control system from information provided by the plant, the operator, and other DEH programs.

Figure 11:
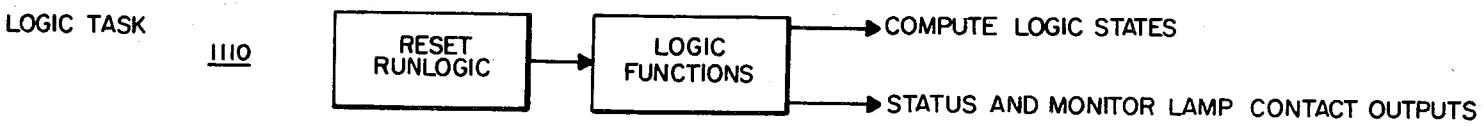
FIG. 11 is a simplified block diagram of a portion of the logic function which is operable in accordance with the principles of the invention.
Figure 12:
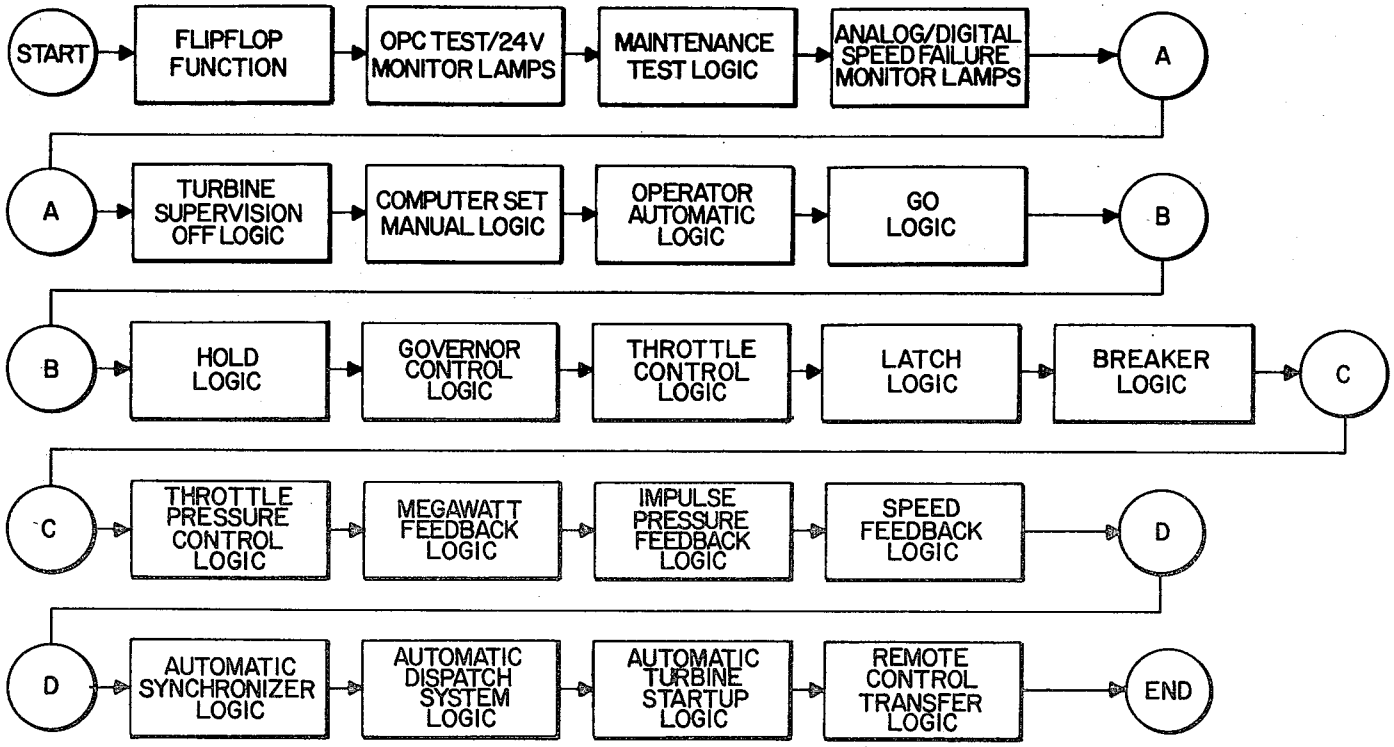
FIG. 12 is a block diagram of the logic program which is operable in accordance with the principles of the invention.

In FIG. 11, the functioning of the logic program 1110 is shown. FIG. 12 shows a more explicit block diagram of the logic program 1110.

The mechanism for actual execution of the LOGIC program is provided by the AUX SYNC task, which runs every 1/10 sec and carries out the scheduled and demand bidding of various tasks in the DEH system. AUX SYNC checks the state of the RUNLOGIC flag and, if it is set, bids the LOGIC task immediately. Thus, the maximum response time for LOGIC requests is 1/10 sec; on the average the response will be much faster than this.

In order to allow immediate rerunning of the LOGIC task should system conditions require, the LOGIC program first resets RUNLOGIC. Thus any other program may then set RUNLOGIC and request a bid which will be carried out by the AUX SYNC program within 1/10 sec. There are two major results of the LOGIC task: the computation of all logic states necessary for proper operation of the DEH system, and the processing of all status and monitor lamp contact outputs to inform the plant control system and operating personnel of the state of the DEH system.

The logic program 1110 controls a series of tests which determine the readiness and operability of the DEH system 1100. One of these tests is that for the overspeed protection controller which is part of the analog backup portion of the hardwired system 1016 shown in FIG. 4. Generally, the logic program 1110 is structured from a plurality of subroutines which provide the varying logic functions for other programs in the DEH program system, and the various logic subroutines are all sequentially executed each time the logic program is run.

COMPUTER SET MANUAL LOGIC

When the DEH system is in automatic control, it is possible for certain conditions to occur which require transfer to manual operator control. One of these is the case in which the maintenance test switch is moved to the test position. Even though a wired connection places the control in manual operation, the DEH LOGIC program sets a contact output requesting transfer to manual as a backup. The second situation occurs when the turbine is on automatic speed control and all speed input signals fail, as determined by the speed selection program in the CONTROL task. This speed channel failure will also require transfer to manual operation by a contact output from this LOGIC task.

Figure 13:
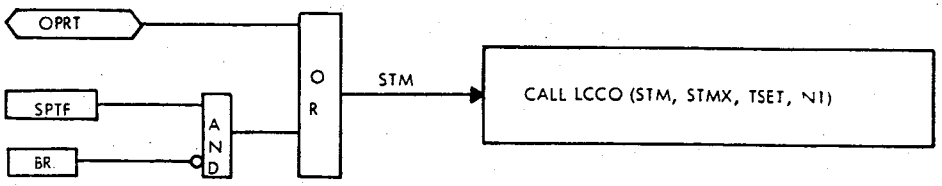
FIG. 13 is a flow chart of a transfer to manual operation subroutine which is operable in accordance with the principles of the invention.

FIG. 13 shows a flow chart of a transfer to manual operation subroutine. STM is the logical variable to switch to turbine manual control, and is set by the maintenance test contact input (OPRT) or the speed channel failure variable (SPFT) while on speed control (i.e. the main breaker (BR) is not set). A call to the LCCO subroutine is then made.

BREAKER LOGIC

The state of the main circuit breaker which connects the generator to the power system determines a primary control strategy of the DEH system. When the breaker is open, the DEH system is on speed control and thus positions the throttle and governor valves to maintain speed demand as requested by the operator, an automatic startup program, or an automatic synchronizer. When the breaker is closed, the DEH system is on load control and thus positions the governor valves to maintain load demand as requested by the operator or by an automatic dispatching system.

The function of the breaker logic progrom is to detect changes in the state of the main breaker and take the appropriate action. When the breaker opens, it is necessary to reset the breaker flip-flop to place the DEH control system on speed control; in addition, both the REFERENCE AND DEMAND are set to synchronous speed, and the speed integral controller is reset to zero. The control system will then position the governor valves to maintain synchronous speed. When the breaker closes and the unit is synchronized to the line, the breaker logic program must set the breaker flip-flop to place the DEH system on load control; in addition both the REFERENCE and DEMAND are set to pick up an initial magawatt load so that the turbine does not tend to motor. The control system will then position the governor valves to maintain this initial load.

Referring again to FIG. 1, upon synchronization of the turbine system 10 with a power grid, not shown, the governor valves GV1 through GV8 must allow wufficient steam to flow through the turbine system 10 to overcome turbine system losses. Otherwise, upon synchronization of the generator 16 with other generators in the power grid by closing the breakers 17, the turbine system 10 would as already indicated have a tendency to motor. The DEH control system 1100, in order to prevent motoring and subsequent damage to the low pressure turbine section 24, automatically opens the governor valves GV1 through GV8 such that a predetermined load is picked up by the generator 16 upon synchronization.

Figure 14:
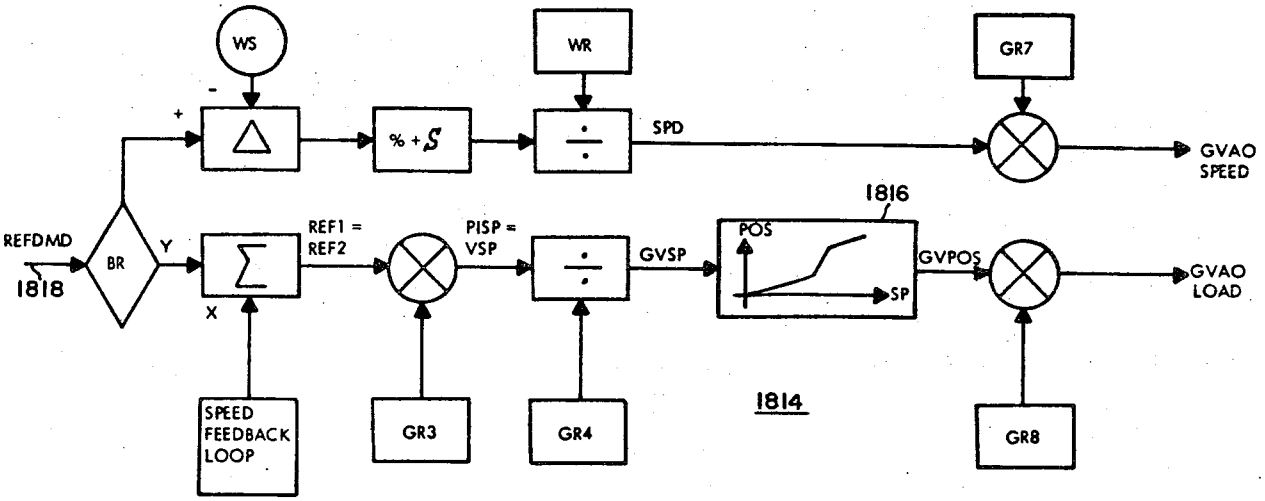
FIG. 14 is a block diagram of a load control system which is operable in accordance with the principles of the invention.

The value of the initial megawatt pickup in defined as MWINIT upon synchronization is entered from the keyboard 1860 in FIG. 9 and is typically set at about 5% of the rating of the turbine-generator 10. In the load control system 1814, as shown in FIG. 14, the actual megawatt pickup is modified by a factor which is the ratio of the rated throttle pressure to the existing throttle pressure at synchronization. This factor is utilized by the DEH system 1100 in maintaining approximately the same initial megawatt load pickup whether the turbine system 10 is synchronized at rated throttle pressure or at some lower or even higher throttle pressure.

MEGAWATT FEEDBACK LOGIC

Megawatt feedback is one of the two major loops used on turbine load control to maintain the governor valves at the correct position. The other feedback is impulse pressure; between these two loops it is possible to adapt the computer outputs to account for valve nonlinearities and to assure that the megawatt setting in the reference window is actually being supplied by the turbine/generator.

The megawatt feedback logic places the megawatt loop in service on request from an operator's panel pushbutton, providing all permissive conditions are satisfied, and removes the loop from service from the operator's panel pushbutton or when any condition exists which requires removing the megawatt feedback.

Placing the loop in service or removing it is done bumplessly, so that the governor valves remain at the same position. In addition, the REFERENCE and DEMAND values are automatically adjusted to agree with the new state of the DEH control system.

Figures 17, 18:
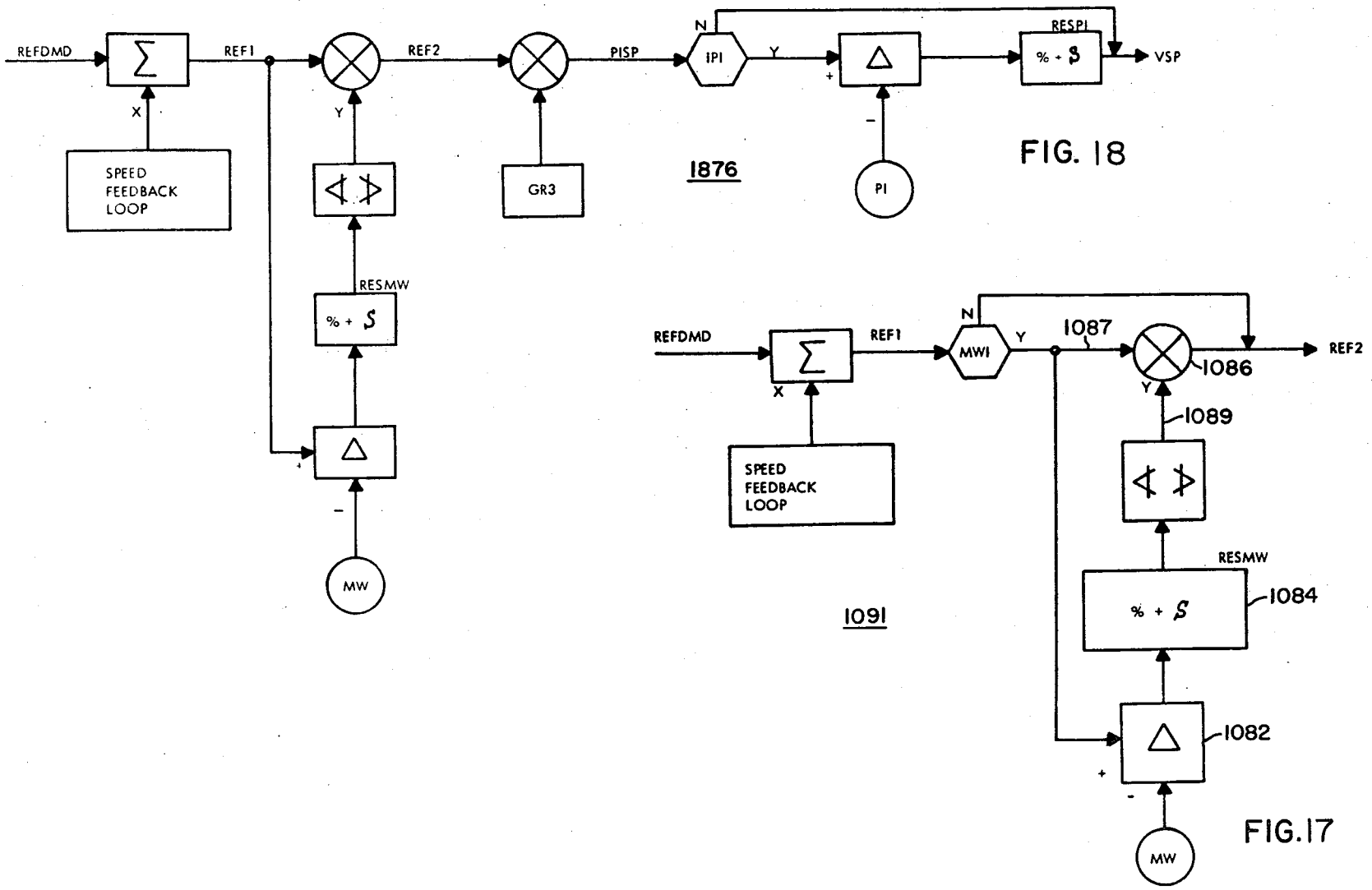
FIG. 17 is a block diagram of a megawatt feedback loop subroutine which is operable in accordance with the principles of the invention.
FIG. 18 is a block diagram of an impulse pressure loop with megawatt loop in service which is operable in accordance with the principles of the invention.

Referring to FIG. 17, a block diagram of the magawatt feedback loop is shown in greater detail than in FIG. 5. It should be noted that the speed compensated reference 1087, at the input of multiplication function 1086, is multiplied by the megawatt compensation 1089. The multiplication of the signals instead of a differencing provides an additional safety feature since the loss of either of the signals 1087 or 1089 will produce a zero output rather than a runaway condition.

IMPULSE PRESSURE FEEDBACK LOGIC

Impulse pressure feedback is the other of the two major loops used in the turbine load control to maintain the governor valves at the correct position. The impulse pressure feedback logic places the impulse pressure feedback loop in service on request from an operator's panel pushbutton, providing all permissive conditions are satisfied, and removes the loop from service on request from the operator or when any condition exists which requires removing impulse pressure feedback. Placing the loop in service or removing it is done automatically and bumplessly, so that the governor valves remain at the same position.

The impulse pressure feedback logic is shown in greater detail in FIG. 18. With a digital computer, bumpless transfer is achieved without the use of elaborate external circuitry because of the digital computational nature of the machine. A value can be computed instantaneously and inserted in the integrator 1218 of the proportional plus reset controller subroutine 1068. In the preferred embodiment of the Digital Electro-Hydraulic control system 1100, the proportional plus reset controller 1168 is utilized by the following functions: the megawatt feedback loop 1091, the impulse pressure feedback loop 1816 and the speed feedback loop made up of the rated speed reference 1074, the compare function 1076 and the actual turbine speed function 1076.

SYNCHRONIZER LOGIC

During the process of accelerating a turbine on automatic speed control, the normal steps of operation may be summarized as follows: latch and roll the turbine on throttle control, accelerate to near synchronous speed, transfer to governor valve control, accelerate to synchronous speed, and synchronize the turbine with the power system. Most turbines are brought on the line with conventional automatic synchronizing equipment which carefully matches turbine conditions with power system conditions before automatically closing the main generator breaker.

The DEH control system 1100 provides an interface with synchronizing equipment by turning over supervision of the turbine reference and demand to the automatic synchronizer, which provides raise and lower pulses to the DEH system via contact inputs. Each pulse will raise and lower the turbine speed reference one rpm, thus providing the mechanism for adjusting the turbine speed to the power system. Provision has been made in the DEH system to allow selection of the auto sync mode through a pushbutton on the operator's panel or from an automatic turbine startup program, while the auto sync mode may be rejected by simply pressing the OPER AUTO pushbutton on the panel. The automatic synchronizer (auto sync) logic program detects those conditions concerned with auto sync, and sets all logical conditions accordingly.

Figure 19:
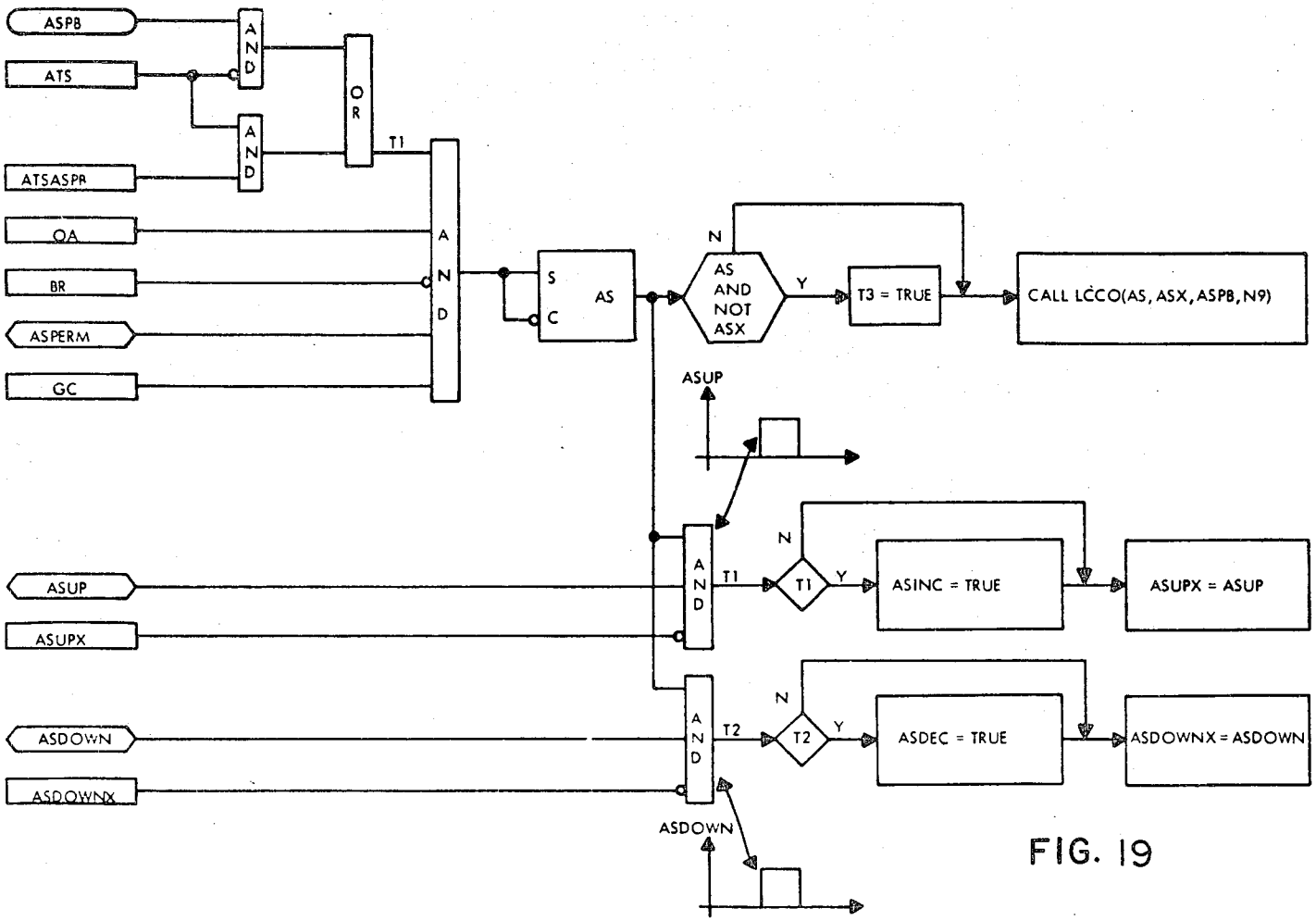
FIG. 19 is a flow chart of an automatic synchronize logic program which is operable in accordance with the principles of the invention.

The turbine 10 operates in accordance with actions generated by the DEH control program in response to the synchronizer signals. FIG. 19 shows a flow chart of the automatic synchronizer logic program.

Because of the extreme accuracy of the ATS program 1141 in controlling the speed of the turbine 10 synchronization can be and preferably is performed without external automatic synchronizer equipment.

During the process of operating a turbine on automatic load control, the normal method of changing load is by entering new values of load demand from the keyboard, as described in the operating instructions. Then by using the GO and HOLD pushbuttons in conjunction with the load rate pushbutton, the operator may supervise the loading on the turbine which is actually carried out by the DEH system of control programs. This will result in the desired load being supplied to the power system by the turbine/generator.

Another method of supervising load on the turbine is through use of a remote automatic dispatching system. By turning over supervision of the turbine reference to an ADS operating mode, which provides raise and lower pulses whose width determines the requested load change, the DEH control system allows the turbine loading to be coordinated by a central dispatching office which can allocate total utility load on an economic basis to all units in the power system. Provision has been made in the DEH system to allow selection of the automatic dispatch mode through a pushbutton 1870 (FIG. 9) on the operator's panel; in addition, the ADS mode may be rejected by simply pressing the operator automatic pushbutton on the panel. The automatic dispatch logic program detects those conditions concerned with ADS, and sets all DEH states accordingly.

AUTOMATIC DISPATCH LOGIC

Figure 20:
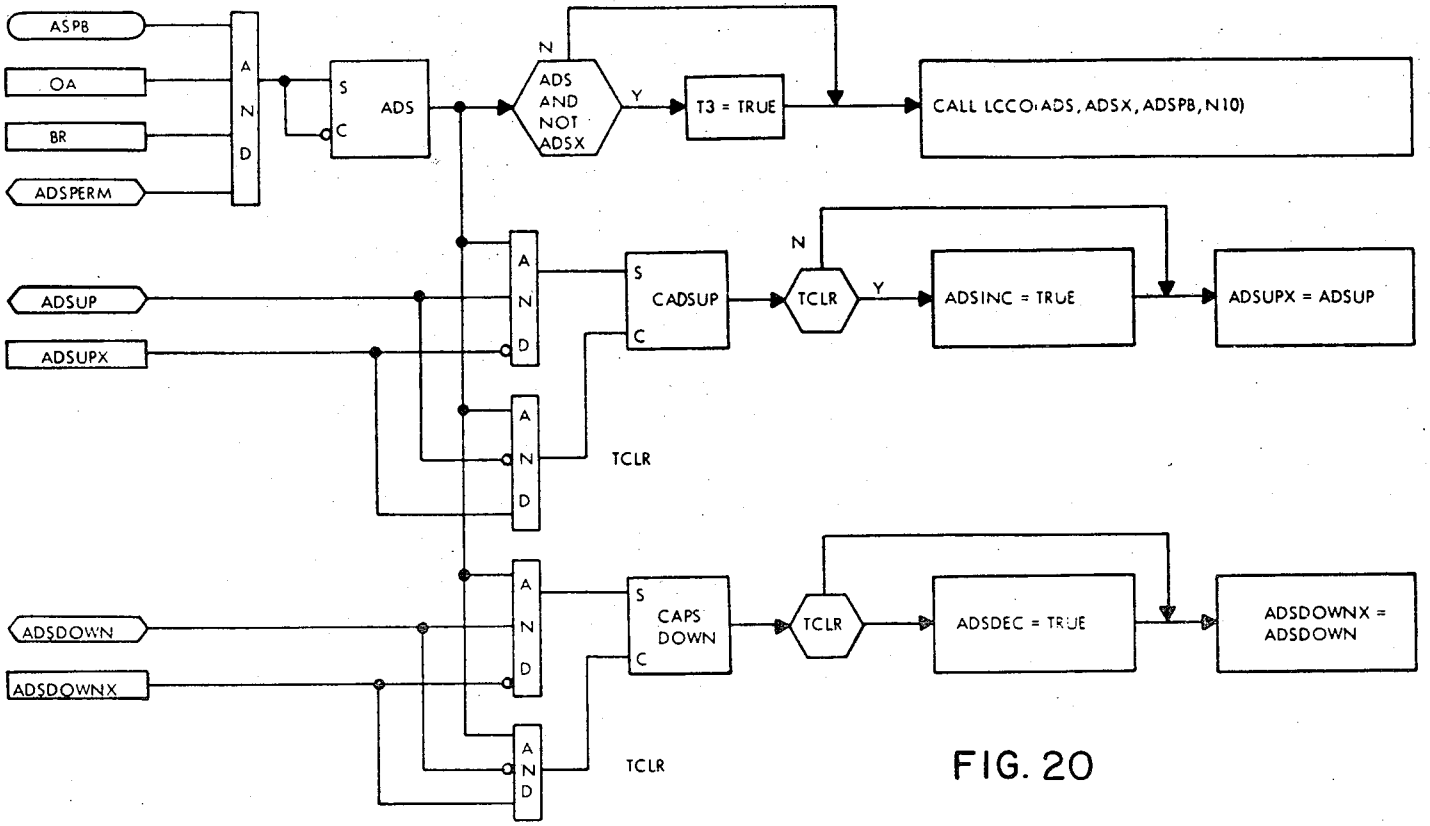
FIG. 20 is a flow chart of an automatic dispatch logic program which is operable in accordance with the principles of the invention.

A flow chart for the automatic dispatch logic program is shown in FIG. 20. It is triggered into operation on demand for automatic dispatch in order to interface the remote data with the DEH system.

AUTOMATIC TURBINE STARTUP (ATS) LOGIC

Modern methods of starting up turbines and accelerating to synchronous speed require careful monitoring of all turbine metal temperatures and vibrations to assure that safe conditions exist for continued acceleration. Until recently, these conditions have been observed by plant operators visually on various panel instruments. However, all of the important variables are rarely available from the plant instrumentation, and even if they were, the operator cannot always be depended upon to make the right decision at a critical time. In addition to these factors, it is impossible to instrument the internal rotor metal temperatures, which are extremely important for indicating potentially excessive mechanical stresses.

To improve the performance at startup, automatic turbine accelerating programs have been written and placed under computer control. Such programs monitor large numbers of analog input signals representing all conceivable turbine variables, and from this information the program makes decisions on how and when to accelerate the unit. In addition, these programs numerically solve the complex heat distribution equations which describe temperature variations in the critical rotor metal parts. From these thermal computations it is possible to predict mechanical stresses and strains, and then to automatically take the proper action in the acceleration of the turbine.

The DEH system has such an automatic turbine startup program available as an optional item. Besides supervising the acceleration as described above, the program provides various messages printed on a typewriter to keep the operator informed as to the turbine acceleration progress. In addition, a group of monitor lamps are operated to indicate key points in the startup stages and to indicate alarm or contingency conditions. The automatic turbine startup logic program detects those conditions concerned with this DEH feature and sets all logical states accordingly.

REMOTE TRANSFER LOGIC

In the DEH turbine control system philosophy, the operator has overall authority in a control system hierarchy which has three general states: manual operation, operator automatic control, and remote automatic control. The manual operating mode is a contingency state which is used only when the computer is not available, as when the software control system is being tuned or modified. The operator automatic mode is the normal operating state during which speed/load demand and all other operating data are entered and displayed from the keyboard by the operator. Remote automatic control modes are those in which speed/load demand and rate are supervised from a source outside the basic DEH system.

Figure 22:
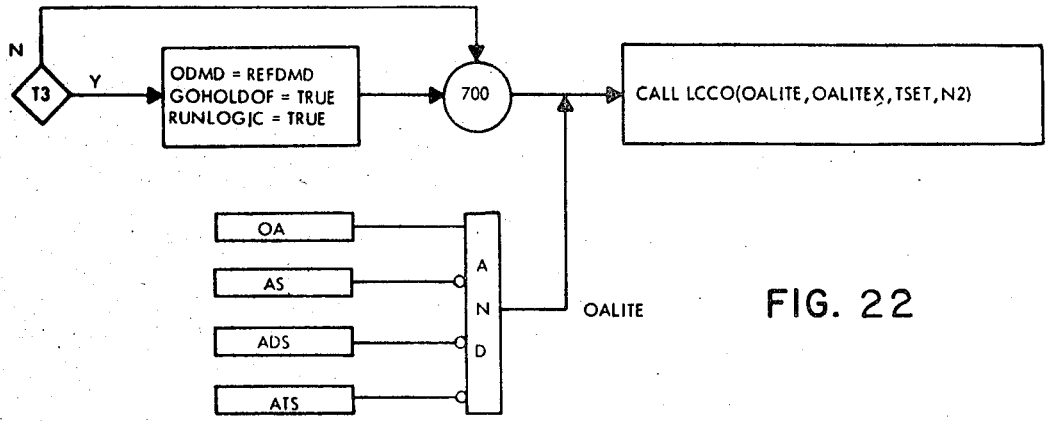
FIG. 22 is a flow chart of a remote transfer logic subroutine which is operable in accordance with the principles of the invention.

In order to allow the DEH system 1100 to provide for automatic turbine operation from an independent source or a remote location, a remote transfer logic program shown in flow chart form in FIG. 22 is provided. In the preferred embodiment of the DEH system 1100, the available remote modes place the DEH system under control of the external automatic synchronizer system, the external automatic dispatching system or the automatic turbine startup system which is implemented within the DEH computer. An operator has the capability of choosing whichever mode is permissible and desired at a particular moment.

I. PANEL TASK

The DEH Operator's Panel is the focal point of turbine operation; it has been designed to make use of the latest digital techniques to provide maximum operational capability. The Operator's Panel provides the primary method of communicating information and control action between the operator and the DEH Control System. This is accomplished through a group of pushbuttons and a keyboard (which together initiate a number of diverse actions), and two digital displays (which provide the operator with visual indication of internal DEH system numerical values).

When pressed, any of the buttons on the Operator's Panel provide momentary action during which a normally-open contact is connected to an electronic diode matrix. Operation of a button energizes a common computer interrupt for the Operator's Panel and applies voltage to a unique combination of 6 contact inputs assigned as a pushbutton decoder. The diode matrix may be used to identify up to 60 pushbuttons. When a button is pressed, the associated interrupt is read within 64$\mu$ sec, and the corresponding contact inputs scanned and stored in computer memory as a bit pattern for further processing.

Each of the buttons on the panel are backlighted. When a button is pressed and appropriate logical conditions exist, the lamp is turned on to acknowledge to the operator that the action he initiated has been carried out. Should the proper logical conditions not be set, the lamp is not turned on. This informs the operator that the action he requested cannot be carried out.

A few of the buttons are of the digital push-push type which when pushed once initiate an action, and when pushed again suppress that action. Some of these buttons also contain a split lens which indicates one action in the upper half of the lamp and another (usually opposite) action in the lower lens. In addition, certain button backlights are flashed under particular operating circumstances and conditions.

The buttons and keys on the Operator's Panel may be grouped in broad functional groups according to the type of action associated with each set of buttons. A brief description of these groups follows:

1. CONTROL SYSTEM SWITCHING—These buttons alter the configuration of the DEH Control System by switching in or out certain control functions. Examples are throttle pressure control and impulse pressure control.
2. DISPLAY/CHANGE DEH SYSTEM PARAMETERS—These buttons allow the operator to visually display and change important parameters which affect the operation of the DEH system. Examples are the speed and load demand, high and low load limits, speed and load rate settings, and control system tuning parameters.
3. OPERATING MODE SELECTION—This group of buttons provides the operator with the ability to select the turbine operating mode. Examples are permitting an Automatic Synchronizer or an Automatic Dispatch System to set the turbine reference, or selecting local operator automatic control of the turbine (which includes hold/go action).
4. VALVE STATUS/TESTING/LIMITING—This group of buttons allows valve status information display, throttle/governor valve testing, and valve position limit adjustment.
5. AUTOMATIC TURBINE STARTUP—This group of buttons is used in conjunction with a special DEH program which continuously monitors important turbine variables, and which also may start up and accelerate the turbine during wide-range speed control.
6. MANUAL OPERATION—These buttons allow the operator to manually control the position of the turbine valves from the Operator's Panel. The DEH PANEL task has no direct connection with this group of buttons.
7. KEYBOARD ACTIVITY—These buttons and keys allow numerical data to be input to the DEH system. Such information may include requests for numerical values via the display windows, or may adjust system parameters for optimum performance.

Figure 23:
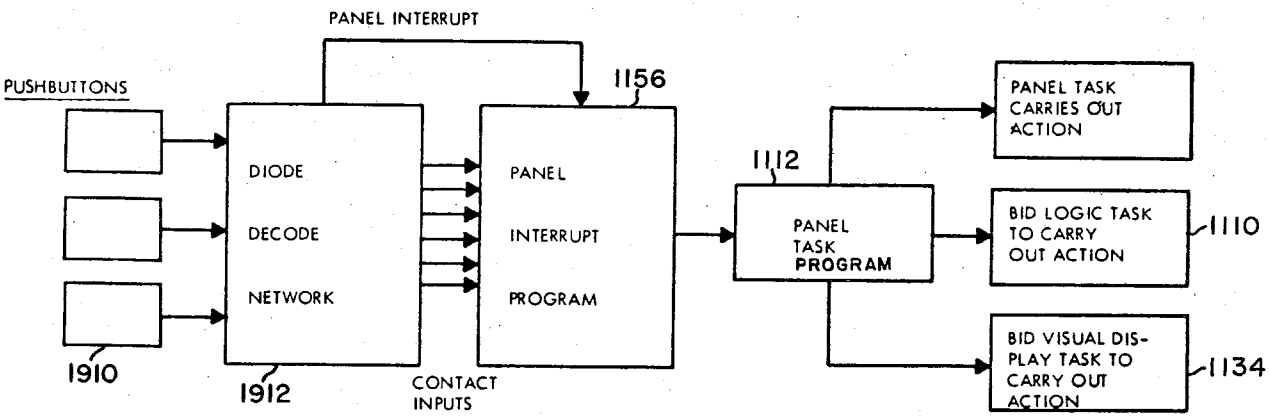
FIG. 23 is a block diagram showing a panel task interaction function which is operable in accordance with the principles of the invention.
Figure 24:
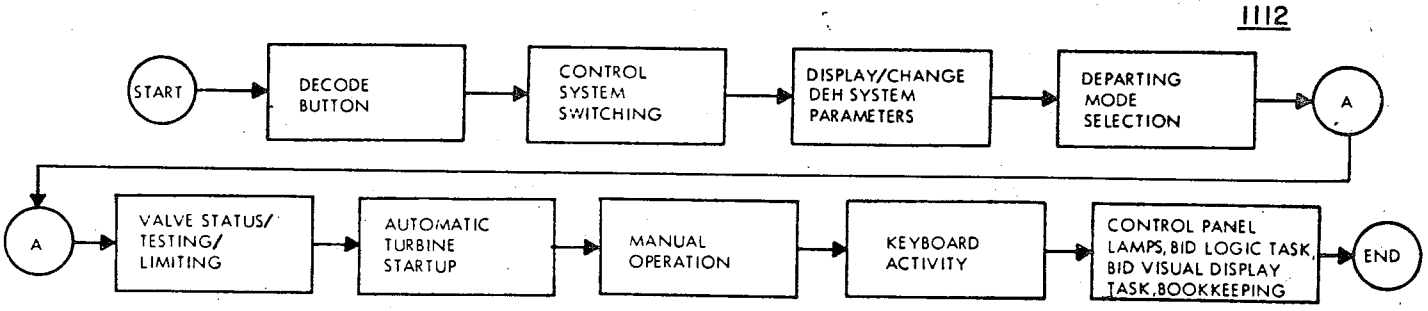
FIG. 24 is a block diagram of a panel program which is operable in accordance with the principles of the invention.

The panel task 1112 responds to the buttons pressed on the operator's panel 1130 by an operator of the DEH control system 1100. The control panel 1130 is shown in FIGS. 8 and 9. Referring now to FIGS. 23 and 24, interactions of the panel task 1112 are shown in greater detail. Pushbuttons 1110 are decoded in a diode decoding network 1912 which generates contact inputs to activate the panel interrupt program 1156. The panel interrupt program scans the contact inputs and bids the panel task 1112 whereby the pressed button is decoded and either the panel task 1112 carries out the desired action or the logic task 1110 is bid or the visual display task 1134 is called to carry out the desired command.

J. CONTROL PROGRAM

Automatic control of turbine speed and load requires a complex, interacting feedback control system capable of compensating for dynamic conditions in the power system, the boiler and the turbine-generator. Impulse chamber pressure and shaft speed from the turbine, megawatts from the generator, and throttle pressure from the boiler are used in the controlled operation of the turbine.

In addition to the primary control features discussed above, the DEH system also contains provisions for high and low load limits, valve position limit, and throttle pressure limit; each of these can be adjusted from the Operator's Panel. A number of auxiliary functions are also available which improve the overall turbine performance and the capabilities of the DEH system. Brief descriptions of these follow:

1. Valve position limit adjustment from the Operator's Panel.
2. Valve testing from the Operator's Panel.
3. Speed signal selection from alternate independent sources.
4. Automatic instantaneous, and bumpless operating-mode selection from the Operator's Panel.
5. A continuous valve position monitor and contingency-alert function for the operator during automatic control.
6. A digital simulation and training feature which allows use of the Operator's Panel and most of the DEH system at any time on manual control, without affecting the turbine output or valve position. This powerful aid is used for operator and engineer training, simulation studies, control system tuning or adjustment, and for demonstration purposes.

In order to achieve these objectives, the CONTROL task is provided with analog inputs representing the various important quantities to be controlled, and also is supplied with contact inputs and system logical states.

Figure 25:
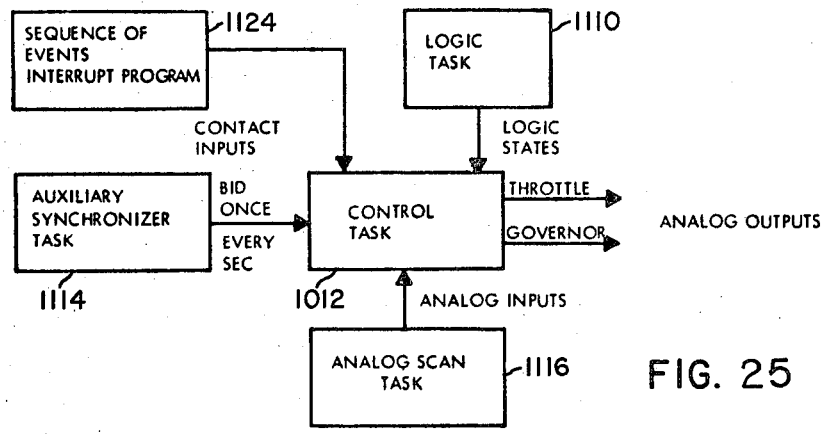
FIG. 25 is a block diagram showing a control task interface which is operable in accordance with the principles of the invention.
Figure 26:
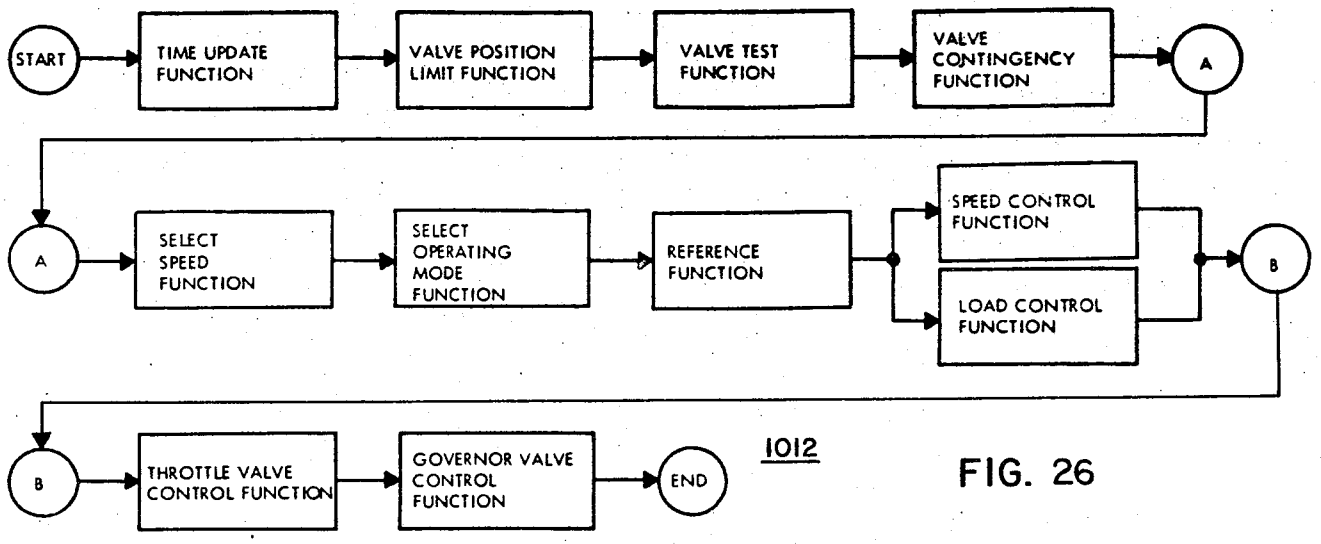
FIG. 26 is a block diagram showing a control program which is operable in accordance with the principles of the invention.

The control program 1012 are related to programs are shown in greater detail in FIG. 25. In the computer program system, the control program 1012 is interconnected with the analog scan program 1116, the auxiliary sync program 1114, the sequence of events interrupt program 1124 and the logic task 1110. FIG. 26 shows a block diagram of the control program 1012. The control program 1012 accepts data from the analog scan program 1116, the sequence of events interrupt program 1124 and is controlled in certain respects by the logic program 1110 and the auxiliary synchronizing program 1114. The control program 1012, upon receiving appropriate inputs, computes the throttle valve TV1–TV4 and the governor valve GVI–GV8 outputs needed to satisfy speed or load demand.

The control program 1012 of the DEH control system 1100 functions, in the preferred embodiment, under three modes of DEH system control. The modes are manual, where the valves GV1–GV8 and TV1–TV4 are positioned manually through the hardwired control system and the DEH control computer tracks in preparation for an automatic mode of control. The second mode of control is the operator automatic mode, where the valves GV1–GV8 and TV1–TV4 are positioned automatically by the DEH computer in response to a demand signal entered from the keyboard 1130, of FIG. 9. The third mode of control is remote automatic mode, where the valves GV1–GV8 and TV1–TV4 are positioned automatically as in the operator automatic mode but use the automatic turbine startup program 1141 or an automatic synchronizer or an automatic dispatch system for setting the demand value.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode—pulse type contact input for adjusting the turbine speed reference and speed demand and moving the turbine 10 to synchronizing speed and phase.
2. Automatic turbine startup program mode—provides turbine speed demand and rate.
3. Operator automatic mode—speed, demand and rate of change of speed entered from the keyboard 1860 on the operator's panel 1130 shown in FIG. 9.
4. Maintenance test mode—speed demand and rate of change of speed are entered by an operator from the keyboard 1860 on the operator's control panel 1130 of FIG. 9 while the DEH system 1100 is being used as a simulator or trainer.
5. Manual tracking mode—the speed demand and rate of change of speed are internally computed by the DEH system 1100 and set to track the manual analog back-up system 1016 as shown in FIG. 4 in preparation for a bumpless transfer to the operator automatic mode of control.

With the breaker 17 closed and the turbine 10 in the level mode control, the following modes of operation may be selected:

1. Throttle pressure limiting mode—a contingent mode in which the turbine load reference is run back or decreased at a predetermined rate to a predetermined minimum value as long as a predetermined condition exists.
2. Run-back mode—a contingency mode in which the load reference is run back or decreased at a predetermined rate as long as a predetermined condition exists.
3. Automatic dispatch system mode—pulse type contact inputs are supplied from an automatic dispatch system to adjust turbine load reference and demand when the automatic dispatch system button 1870 on the operator's panel 1130 is depressed.
4. Operator automatic mode—the load demand and the load rate are entered from the keyboard 1830 on the control panel 1130 in FIG. 18.
5. Maintenance test mode—load demand and load rate are entered from the keyboard 1860 of the control panel 1130 in FIG. 9 while the DEH system 1100 is being used as a simulator or trainer.
6. Manual tracking mode—the load demand and rate are internally computed by the DEH system 1100 and set to track the manual analog back-up system 1016 preparatory to a bumpless transfer to the operator automatic mode of control.

The select operating mode function responds immediately to turbine demand and rate inputs from the appropriate source as described above. This program determines which operating mode is currently in control by performing various logical and numerical decisions, and then retrieves from selected storage locations the correct values for demand and rate. These are then passed on to the succeeding DEH control programs for further processing and ultimate positioning of the valves. The select operating mode function also accommodates switching between operating modes, accepting new inputs and adapting the DEH system to the new state in a bumpless transfer of control.

Various contact inputs are required for raise and lower pulses, manual operation, maintenance test, and so forth; these are handled by the SEQUENCE OF EVENTS interrupt program and the PLANTCCI subroutine, which performs a contact input scan. In addition, certain panel pushbuttons affect the operating mode selection; these are handled by the PANEL INTERRUPT program and the PANEL task, which decode and classify the pushbuttons pressed. The LOGIC task then checks all permissive conditions and current control system status, and computes the appropriate logical states for interpretation by the CONTROL task and the SELECT OPERATING MODE program.

Figure 27:
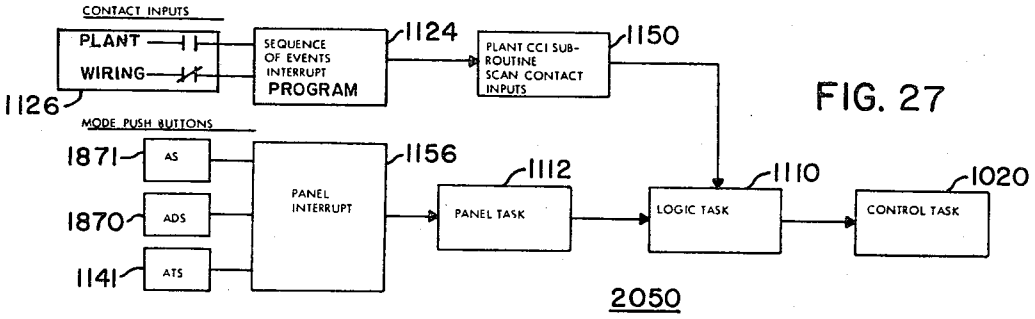
FIG. 27 shows a block diagram of an operating mode selection function which is operable in accordance with the principles of the invention.

Referring now to FIG. 27, a block diagram is shown illustrating the select operating mode function 2050. Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activate the panel interrupt program 1156 which calls the panel program 1112 for classification and which in turn calls upon the logic program 1110 to compute the logic states involved. The logic task program 1110 calls the control task program 1020 to select the operating mode in that program.

Figure 28A:
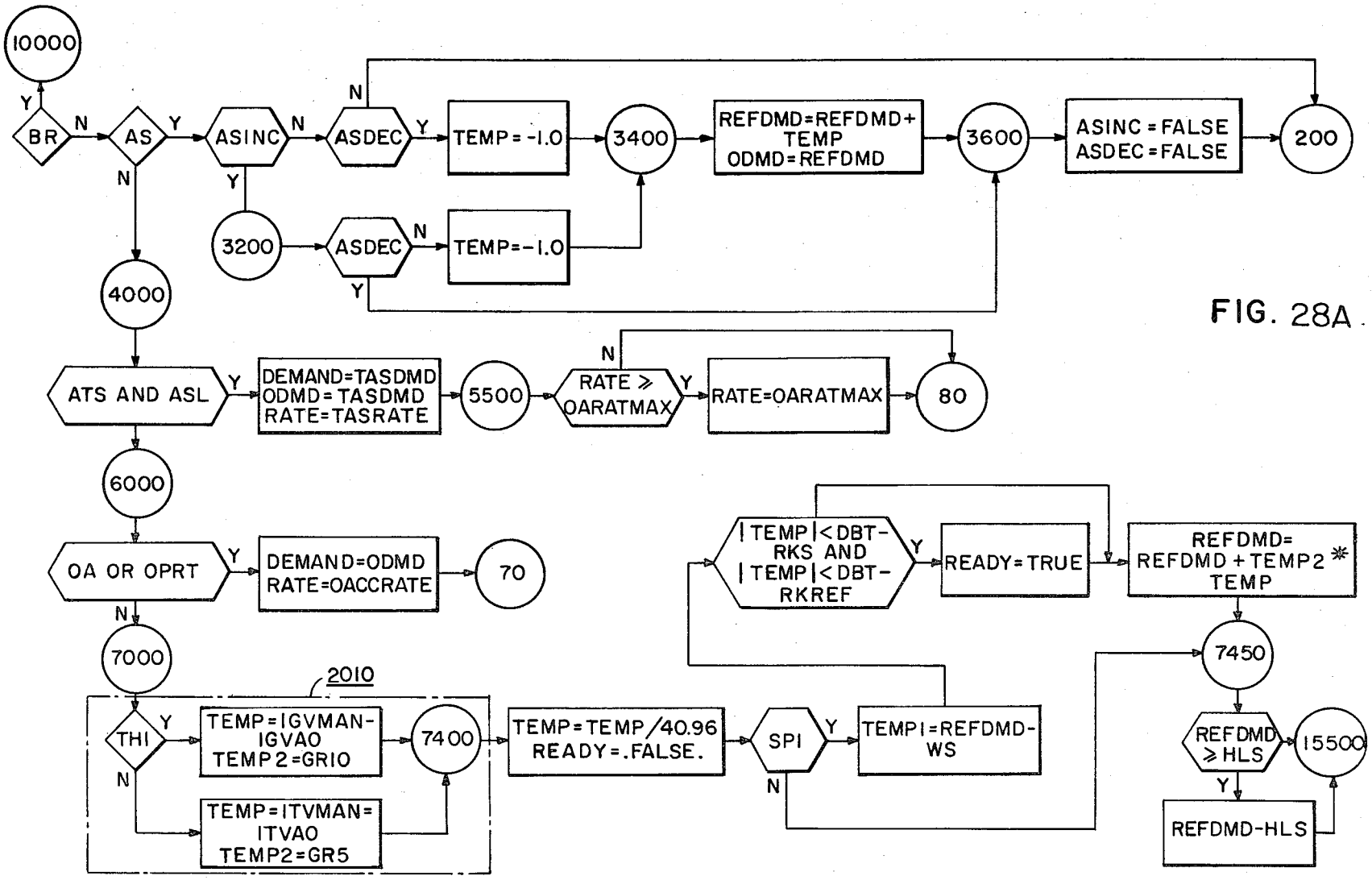
FIGS. 28A and 28B show a flow chart of a select operating mode function which is operable in accordance with the principles of the invention.
Figure 28B:
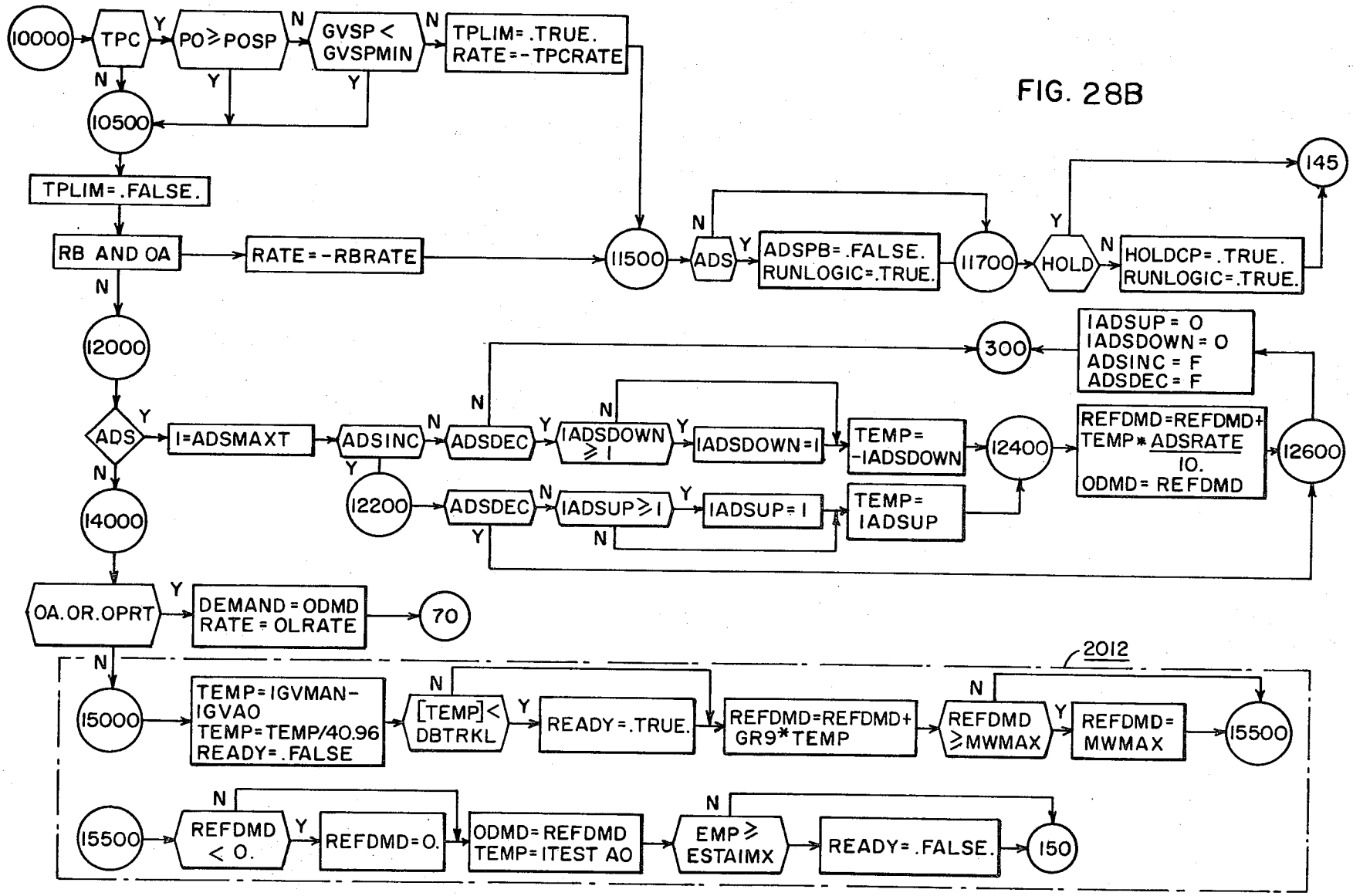

In FIGS. 28A and 28B a flow chart of the select operating mode logic is shown. As one example of mode selection referring to a path 2023, after a statement 7000, provisions are made for a bumpless transfer from an automatic or test mode to an operator mode. The bumpless transfer is accomplished by comparing the computer outputs and the operator mode output signals for the governor valve GV1–GV4 positions. The DEH system 1110 inhibits any transfer until the error between the transferring output and the output transferred is within a predetermined deadband (DBTRKS). Bumpless transfer is accomplished by the DEH control system 1100 by comparing output from one mode of control of the governor valves GV and the throttle valves TV and the same output from another output mode controlling the same parameters. The flow chart of FIGS. 28A and 28B shows mode selection for a complete operating system. In a hardwired or analog control system, the analog parameter output, to be transferred to must continuously track the parameter output to be transferred from. This tracking method is expensive and cumbersome since it has to be done continuously and requires complex hardware. However, in a digital system, such as the DEH control system 1100, the equating of the two parameter outputs need be performed only on transfer. Therefore, great economy of operation is achieved.

SPEED/LOAD REFERENCE FUNCTION

Figure 29:
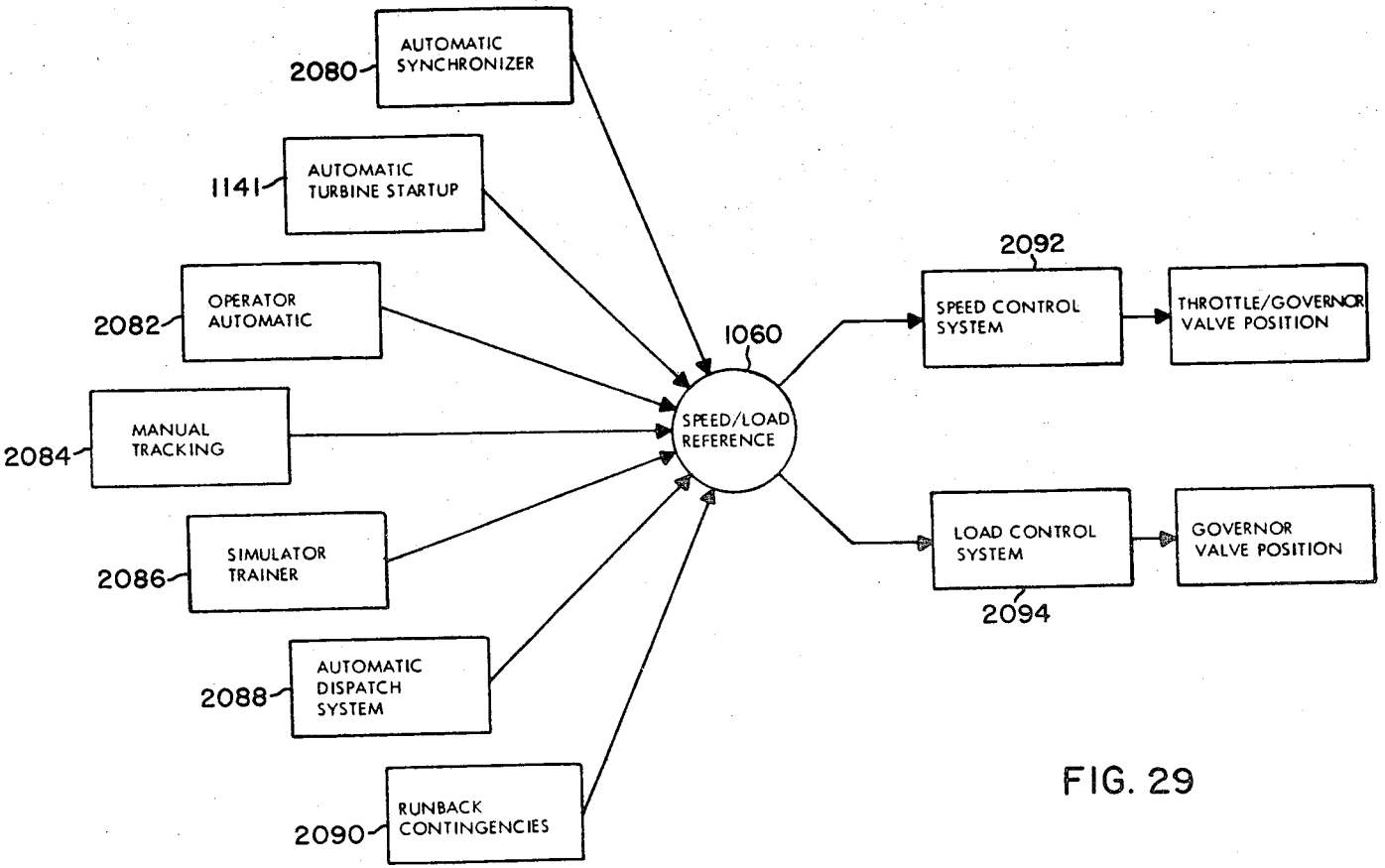
FIG. 29 shows a symbolic diagram of the use of a speed/load reference function which is operable in accordance with the principles of the invention.

In the DEH turbine controller, the speed/load reference is the central and most important variable in the entire control system. The reference serves as the junction or meeting place between the turbine speed or load demand, selected from any of the various operating modes discussed in the last section, and the Speed or Load Control System, which directs the reference through appropriate control system strategy to the turbine throttle and governor valves to supply the requested demand. FIG. 29 is a diagram which indicates the central importance of the reference in the DEH control system.

The speed/load reference function increments the internal turbine reference at the selected rate to meet the selected demand. This function is most useful when the turbine is on Operator Automatic, on the AUTOMATIC TURBINE STARTUP program, or in the Simulator/Trainer modes. This is because each of these control modes requests unique rates of change of the reference, while the remaining control modes, such as the Automatic Synchronizer and the Automatic Dispatch System, move the reference in pulses or short bursts which are carried out in one step. The Runback and Throttle Pressure contingency modes use some of the features of the reference function, but they bypass much of the subtle reference logic in their hurry to unload the turbine.

For these modes which request movement of the reference at a unique rate, the reference function must provide the controlled motion. Not only must the rate be ramped exactly, but the logic must be such that, at the correct time, the reference must be made exactly equal to the demand, with no overshoot or undershoot. In addition, the reference logic must be sensitive to the GO and HOLD states, and must start or stop movement instantly if requested to do so. Finally, the reference system must turn off the GO and HOLD lamps, if conditions dictate, by passing on to the LOGIC task the proper status information to accomplish this important visual indication feature.

The decision breaker function 1060, of FIG. 5, is identical to the speed/load reference function 1060, of FIG. 29. A software speed control subsystem 2092 of FIG. 29, corresponds to the compare function 1062, the speed reference 1066 and the proportional plus reset controller function 1068, of FIG. 5. The software load control subsystem 1094, of FIG. 29, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 5. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selected rate to meet a selected demand.

SPEED CONTROL FUNCTION

Figure 30:
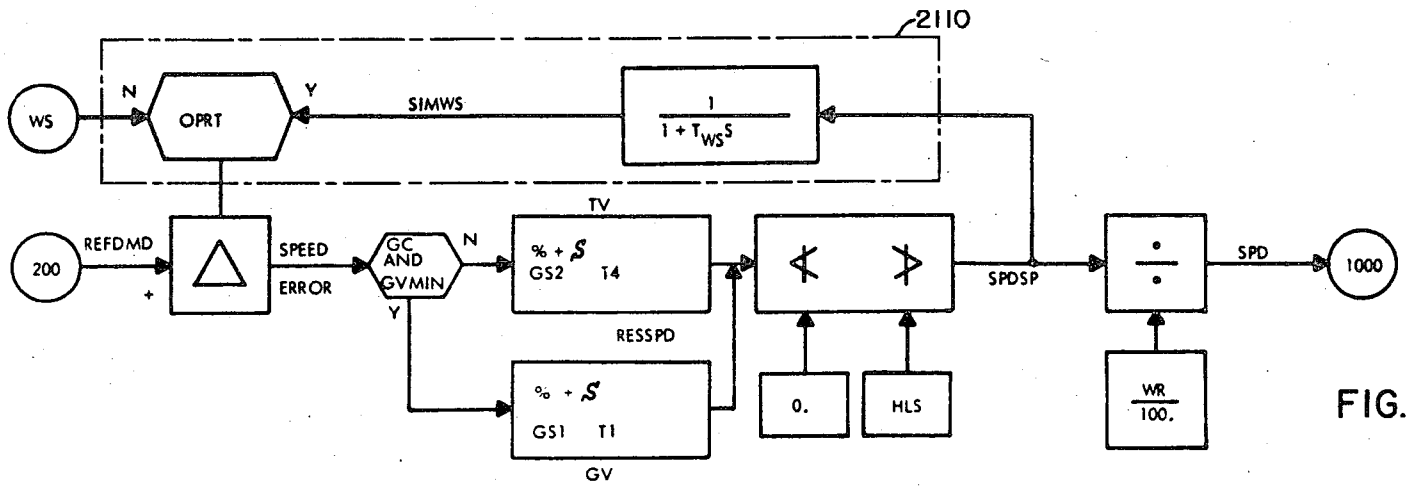
FIG. 30 is a block diagram showing a speed control function which is operable in accordance with the principles of the invention.

The speed control function positions the throttle and governor valves to achieve the existing speed reference with optimum dynamic and steady state response. This is accomplished by using individual proportional-plus-reset controllers for throttle and governor valve speed control, as shown in FIG. 30. The speed error between the turbine speed reference and actual speed drives the appropriate controller, which then reacts by positioning the proper valves to reduce the speed error to zero. The speed controller outputs are low-limit checked against zero and high-limit checked against the quantity HLS, which is a keyboard-entered constant set at 4200 rpm. This prevents the controllers from reaching a reset-windup condition which may inadvertently occur in old circumstances. The speed controller output is then suitably ranged from 0 to 100 percent and sent downstream as the quantity SPD in the CONTROL task to the THROTTLE and GOVERNOR VALVE programs.

LOAD CONTROL FUNCTION

Figure 31:
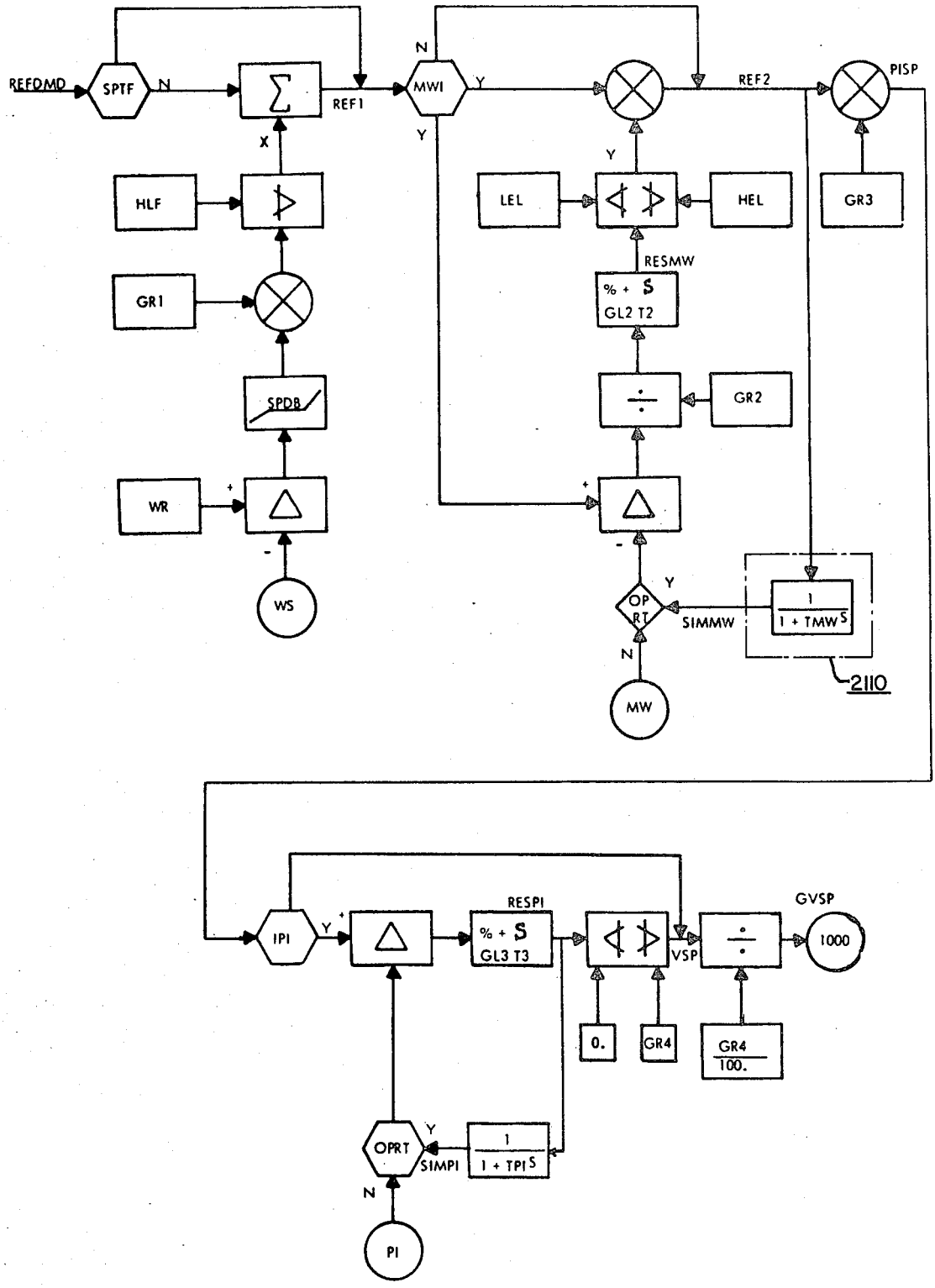
FIG. 31 shows a block diagram of the load control system which is operable in accordance with the principles of the invention.
Figure 32:
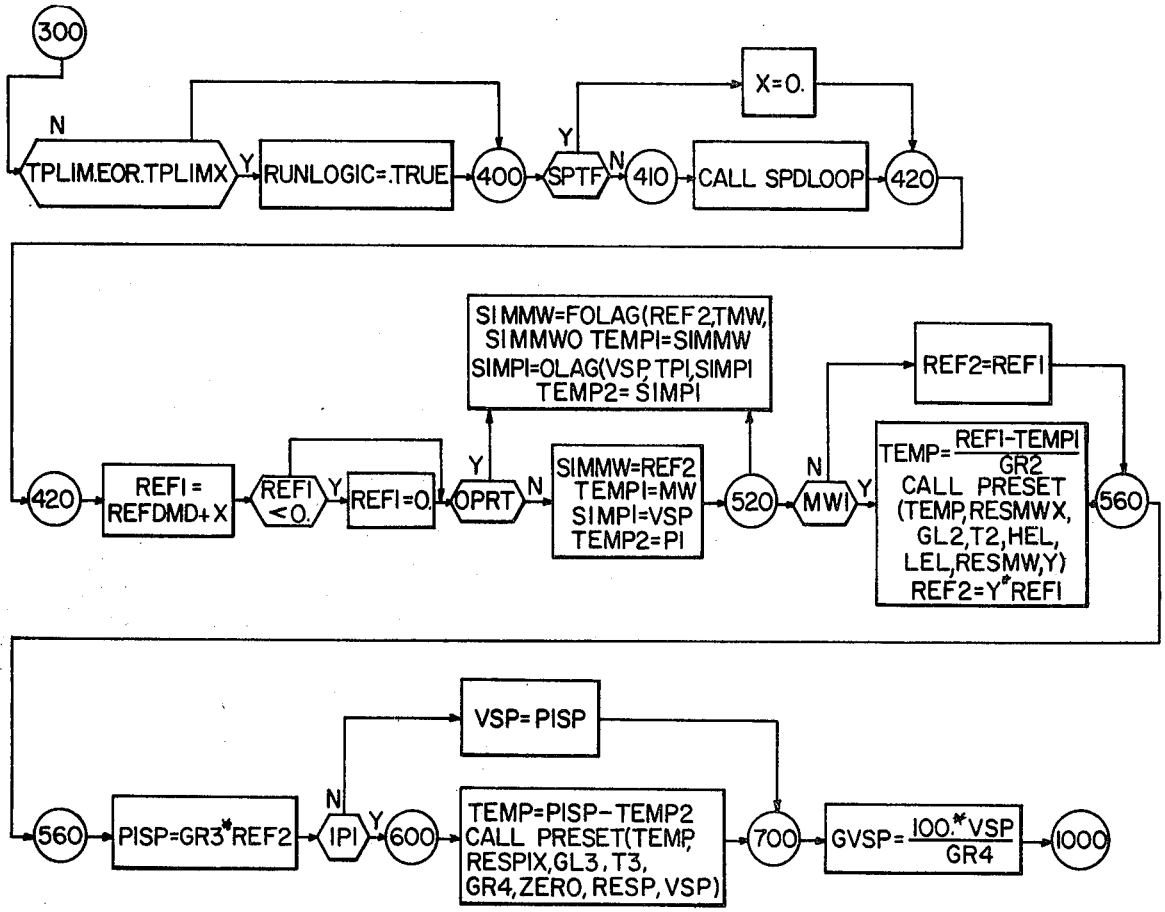
FIG. 32 includes a flow chart of the load control system which is operable in accordance with the principles of the invention.

The load control function positions the governor valves to achieve the existing load reference with optimum dynamic and steady state response. This is accomplished with a feedforward-feedback control system strategy designed to stabilize interactions between the major turbine-generator variables: impulse chamber pressure, megawatts, shaft speed and valve position. FIGS. 31 and 32 show the control system which satisfies these objectives.

The main feedforward path is represented by the turbine load reference value (REFDMD), which is computed by the operating mode selection function described earlier. The feedforward variable (REFDMD) is compensated with two feedback trim factors to account for frequency (speed) participation and megawatt mismatch. The speed compensation is provided by a proportional feedback loop in which the droop regulation gain (GR1) is adjusted to yield rated megawatts correction for 180 rpm speed error. This speed feedback factor (X) is then summed with the turbine load reference (REFDMD) to produce the speed-corrected load reference (REF1).

A special feature which as been incorporated in the speed feedback loop is a software speed-deadband; this non-linear function filters out high-frequency low amplitude noise on the speed input signal, thus keeping the load control system from responding to such meaningless information. The width of the speed deadband may be adjusted from the keyboard by setting the appropriate value into the constant SPDB. Another special feature of the speed deadband is the method of implementing this function in comparison with most standard control systems. The common way to incorporate the speed deadband in previous systems is to allow speed errors greater than the width of the deadband to enter the control system completely. This has been found to shock many systems into oscillatory conditions which may have undesirable effects. In the DEH Control System the speed error, when it is larger than the deadband, is smoothly entered into the speed compensation factor by a linear relationship. Thus the shock effect of a sudden speed error is removed completely.

The megawatt feedback loop provides a trim correction signal which is applied to the speed-compensated load reference (REF1) in a product form to yeild the speed-and-megawatt corrected load reference (REF2). An additional highly desirable feature of megawatt feedback in the DEH system is that with it the reference and demand display windows on the Operator's Panel are calibrated in actual megawatts when the loop is in service. A proportional-plus-reset controller is used to reduce megawatt error to zero, with the loop providing a feedback factor (Y) which floats around unity (1.0) in performing its corrective action. As usual, high and low limits are provided to prevent reset windup and to bound the range of megawatt compensation.

The load reference (REF2), now corrected for speed and megawatt errors, becomes the set point for the impulse pressure cascade feedback loop or the direct demand for valve position, depending on whether the impulse pressure loop is in or out of service. REF2 is multiplied by a ranging gain (GR3) to convert to impulse pressure set point (PISP) in psi. If the loop is in service, then a proportional-plus-reset controller is implemented to drive the impulse pressure error to zero; as always, high and low limits restrict the range of variation of the controller to eliminate the possibility of reset windup. The final governor valve set point (VSP), whether it is generated by the feedback loop or directly from the load reference (REF2), is then converted into a percent valve demand (GVSP) by suitable ranging and is sent downstream in the control task to the THROTTLE and GOVERNOR VALVE programs.

The load control function block diagram shown in FIGS. 31 and 32 is an expansion of the load control, shown in FIG. 5, incorporating the speed loop subroutine and proportional control.

THROTTLE VALVE CONTROL FUNCTION

Figure 33:
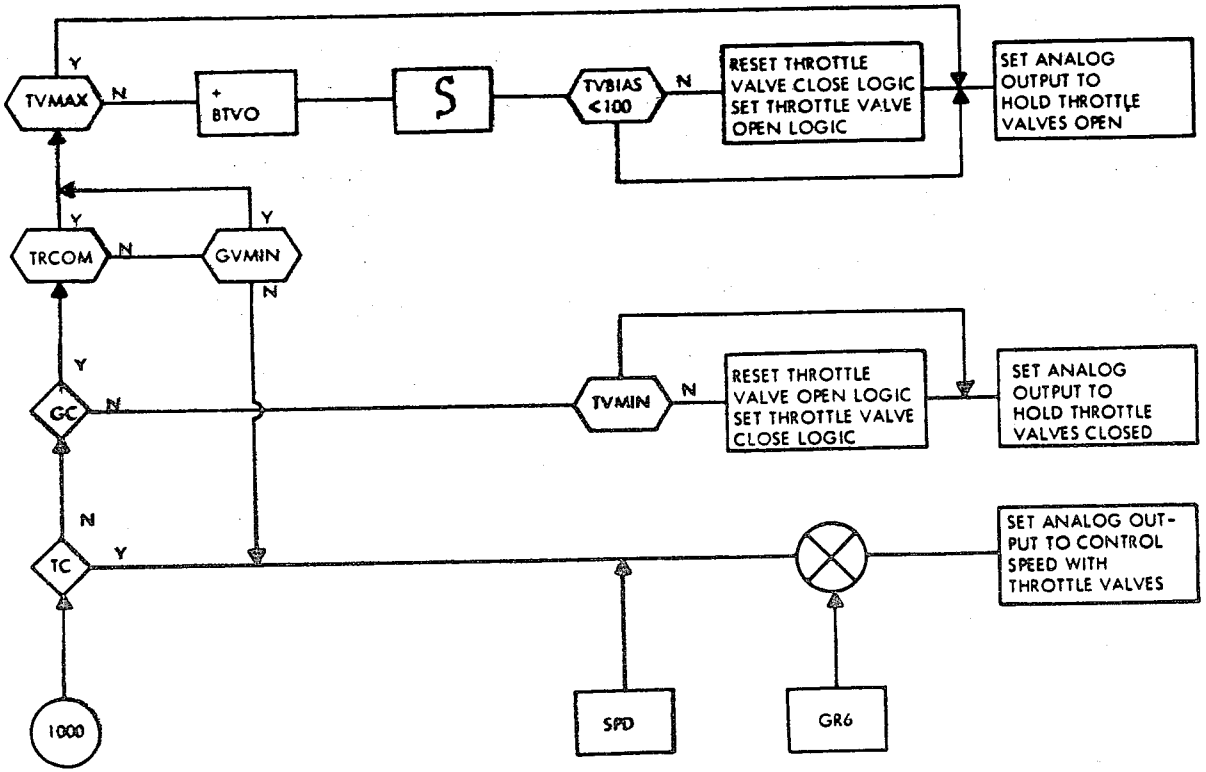
FIG. 33 shows a block diagram of the throttle valve control function which is operable in accordance with the principles of the invention.

The throttle valve control function (FIG. 33) computes the correct value of the throttle valve analog output at all times. When the DEH system is on automatic control, this analog output actually positions the throttle valves; when the DEH system is on manual control, this analog output tracks the backup system preparatory to transfer to automatic control.

To accomplish its objective, the throttle valve control function must interrogate various turbine logical and numerical states, and proceed to act on the outcome of these decisions. There are five distinct situations which must be detected by these logical and numerical interrogations. A brief description of these follow; refer to Figure for the method of performing these tests and the major actions taken.

1. The turbine is unlatched and in neither throttle nor governor valve control. During this time the throttle valves are held closed by the throttle valve control function.
2. The turbine is latched and in positive throttle valve control while the DEH system is in wide-range speed control. During this time the throttle valve control function accepts the output of the speed controller (SPD) and positions the throttle valves accordingly.
3. The DEH system is in a transition period, transferring from throttle to governor valves during wide-range speed control. For this interval of time, the throttle valves are still in positive control and the throttle valve control function continues to accept the speed controller output (SPD) and positions the throttle valves accordingly.
4. The DEH system remains in the transition period of transferring from throttle to governor valve control, but now the governor valves are in positive control. During this time the throttle valve control function drives the throttle valves to the wide-open position with a throttle valve bias integrator (TVBIAS), which has a constant input (BTVO) incrementing the integrator.

5. The transition period is over and the transfer from throttle to governor valve control is complete; the turbine is now on either wide-range speed control or the power system. During this time the throttle valve control function keeps the throttle valves wide open.

GOVERNOR VALVE CONTROL FUNCTION

Figure 34:
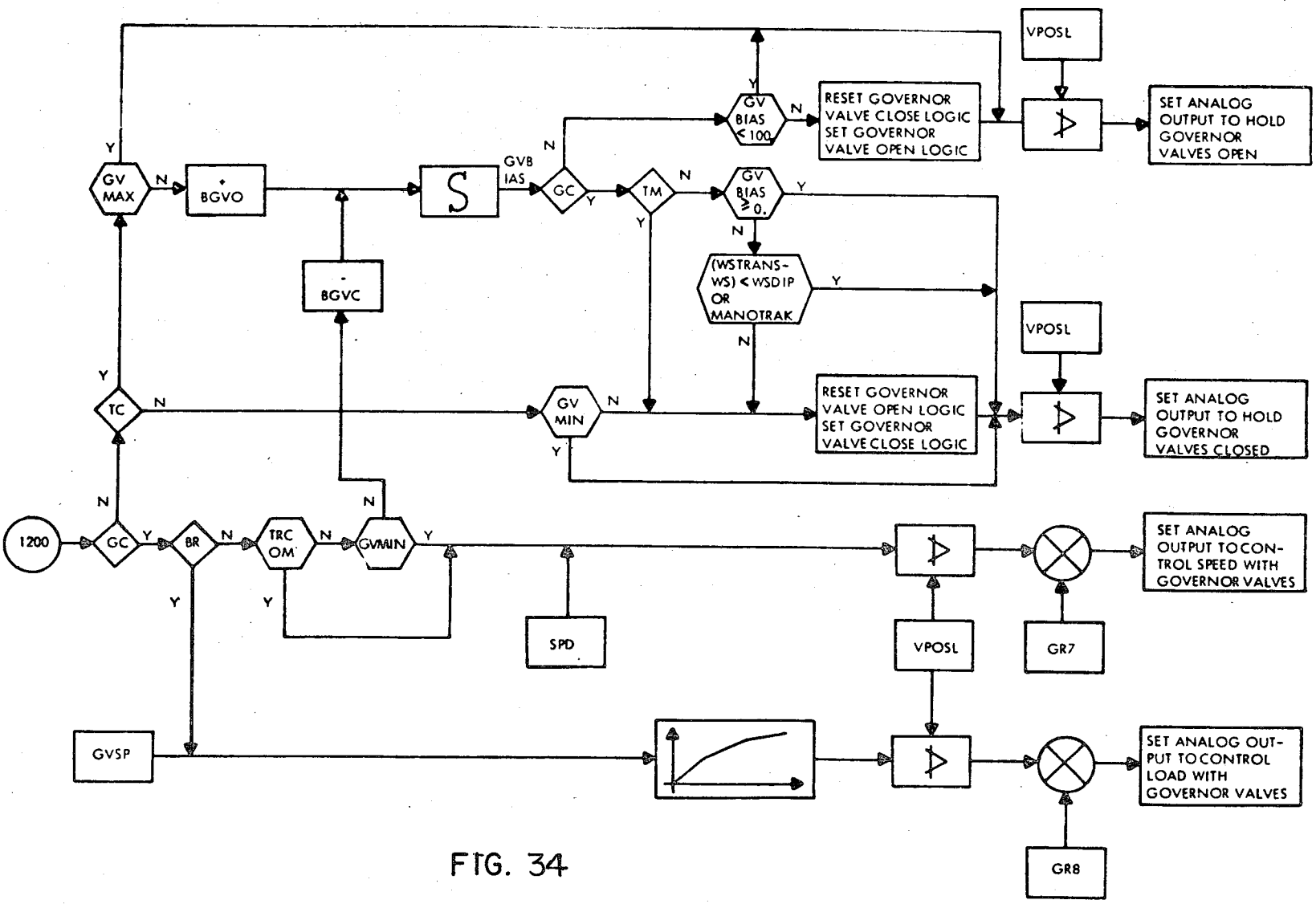
FIG. 34 shows a mixed block diagram of a governor control function program which is operable in accordance with the principles of the invention.
Figure 35:
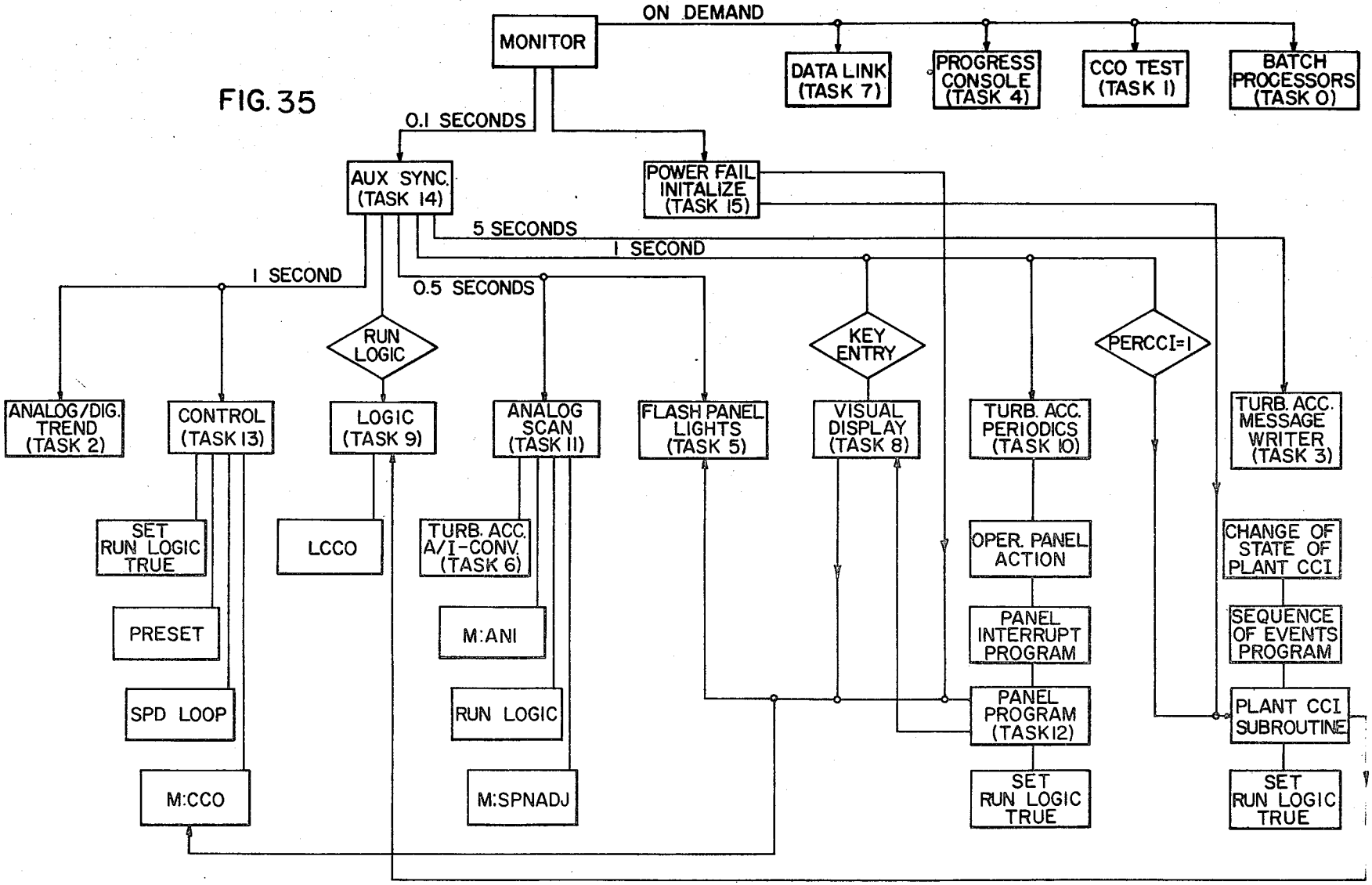
FIG. 35 shows a block diagram of the Digital Electro Hydraulic System which is operable in accordance wih the principles of the invention.

The governor valve control function (FIG. 34) computes the correct value for the governor valve analog output at all times. When the DEH system is on automatic control, this analog output actually positions the governor valves; when the DEH system is on manual control, this analog output tracks the backup system preparatory to transfer to automatic control.

To accomplish its objective, the governor valve control function must interrogate various turbine logical states and proceed to act on the outcome of these decisions. There are five distinct situations which must be detected by these logical interrogations. A brief description of these follows; refer to Figure for the method of performing these tests and the major action taken.

1. The turbine is unlatched and in neither throttle nor governor control. During this time the governor valves are held closed by the governor valve control function.
2. The turbine is latched and in positive throttle valve control while the DEH system is in wide-range speed control. During this time the governor valve control function drives the governor valves wide open with a governor valve bias integrator (GVBIAS).
3. The DEH system is in a transition period, transferring from throttle valve to governor valve control during wide-range speed operation. For this interval of time, the governor valve control function drives the governor valves to the closed position with the governor valve bias integrator (GVBIAS). The governor valve control function then waits for a decrease in turbine speed and for the Analog Backup System to track the computer outputs.
4. The DEH system remains in the transition period but now the governor valves are in positive control during wide-range speed operation. During this time the governor valve control function accepts the output of the speed controller (SPD) and positions the governor valves accordingly.
5. The main generator circuit breaker is closed and the DEH system is in load control. During this time the governor valve control function accepts the output of the load control system (GVSP) and positions the governor valves accordingly.

BUMPLESS TRANSFER

A flow chart path (FIG. 34) allows for the smooth and bumpless transfer from governor valve control to throttle valve control and vice versa. A function 2102 tests whether a governor valve bias integrator GVBIAS has reached zero. By forcing the DEH system 1100 to wait until the governor valve bias integrator GVBIAS has reached zero a bumpless transfer from governor to throttle valve control and vice versa is effectuated. Other bumpless transfer features are considered elsewhere herein.

K. DEH DATALINK

A DEH DATALINK shown in FIG. 6 allows the DEH control system 1100 to communicate with other computers such as a plant computer. In the preferred embodiment, the communication is initiated by the other computer, the plant computer. The DEH DATALINK waits for requests to send or receive information. In the operation of the DEH DATALINK any core location can be interrogated and numerous setpoint values can be changed.

LOGIC TASK

The LOGIC task is assigned priority level 9 and is bid by the AUX SYNC program on demand by other tasks in the DEH system.

Its size is 1092 words, its data pool size is 147 words, and its header is 9 words for a required storage of 1248 locations. LOGIC is linked as a separate task and loaded into the computer through the tape reader. The core area assigned to LOGIC is (1970 to $1E5F)_{16}$; this if $4FO_{16}$ ($1264_{10}$) locations, which allows a few spares. The LOGIC task is organized as a series of small subprograms which are executed sequentially and which address themselves to particular aspects of the total DEH Control System logical operation. The subprograms are in some cases quite simple, as when monitor lights are turned on or off, and in other cases they are quite complex, as when it is necessary to account for many permissive conditions to allow feedback loops to be put into service.

Maintenance Test

The MAINTENANCE TEST system is activated by a two-position key-lock switch on the Operator's Panel. The function of this switch is to allow tuning or adjusting of certain constants in the DEH Control System, or to allow operation of the DEH system in a simulation mode for training purposes. When such tests are to be performed, the maintenance test key is moved to the right position; this immediately switches the turbine to manual control by a wired connection and sets a contact input to the DEH system. The LOGIC task then reacts in three ways: first, a contact output is set which turns on a monitor lamp above and to the right of the maintenance test switch; second, another contact output is set which requests transfer to manual as a backup to the wired connection; and third, the manual-tracking portion of the DEH Control System is disabled.

When the maintenance test action is completed and the test switch returned to the off position, the LOGIC task resets the two contact outputs to turn off the maintenance test lamp and to release the request for manual control. In addition, this part of the program enables the manual-tracking system by resetting the turbine REFERENCE and DEMAND to zero and allowing the normal control programs to run.

Operation Automatic Logic

The state of manual or automatic operation of the DEH system is actually determined by circuitry in the analog backup system, and the DEH programs simply respond to these states. When the DEH system is in manual control, the analog backup system ignores the computer output signals and positions the valves according to its up/down counter circuitry. Conversely, when the DEH system is in automatic control, the analog backup system uses the computer outputs to position the valve and adjusts its up/down counter to track the computer outputs.

When transfer is made to manual, either by pushbutton or computer request, the analog backup system opens contacts carrying the computer outputs to the valves and simultaneously closes contacts carrying backup system outputs to the valves. In addition, a contact input is sent to the DEH system LOGIC task indicating manual operation. When transfer is made to automatic control by pressing the OPERATOR AUTOMATIC pushbutton, and assuming that the computer system is tracked and ready for automatic, the analog backup system opens contacts carrying its own signals to the valves and simultaneously closes contacts carrying the computer outputs to the valves. The operator automatic logic thus merely updates internal computer variables to the state of manual or automatic control as determined by the backup system.

In updating the DEH system programs to the existing control state, the internal operator automatic variable (OA) is set to the logical inverse of the manual contact input represented by TM. Then a decision is made to determine if the system has just been switched to automatic by comparing OA and its last value (OAX). If automatic has just occurred, ready tracking flags are reset; if not, no action is taken. In either case, the last value (OAX) is set to the current automatic state (OA) for use in the next bid of the LOGIC task.

Go Logic

When the DEH system is on operator automatic control, the turbine speed/load (DEMAND) is entered from the keyboard. The operator then may allow the turbine reference to adjust to the demand by pressing the GO pushbutton. When the operator does this, the GO lamp is turned on and logical states are set to begin moving the reference in the CONTROL task. When the reference equals the demand, the GO lamp is turned off. The GO logic detects the various conditions affecting the GO state and sets the status and lamp accordingly.

The GO pushbutton (GOPB), which is updated by the PANEL task, is the set signal for the GO flip-flop. The reset or clear signal, which will override the set signal, can occur from a number of different conditions as follows: the HOLD pushbutton (HOLDPB) as updated by the PANEL task, a computed hold condition (HOLDCP) as set by the CONTROL or LOGIC tasks, the DEH system not being in operator automatic control (OA) or in the maintenance test condition (OPRT) (during which the system may be used as a simulator/-trainer), or the condition in which the reference has reached the demand and the CONTROL task sets the GOHOLDOF state to clear the GO lamp.

Hold Logic

When the DEH system is an operator automatic control, the turbine speed/load (DEMAND) is entered from the keyboard. The operator may then inhibit the turbine reference from adjusting to the demand by pressing the HOLD pushbutton. When the operator does this, the HOLD lamp is turned on and logical states are set to prohibit the reference from moving in the CONTROL task. The HOLD logic detects the various conditions affecting the HOLD state and sets the status and lamp accordingly.

The HOLD pushbutton state (HOLDPB), which is set by the PANEL task, or the hold state (HOLDCP) computed by the CONTROL or LOGIC tasks, acts as the set signal for the HOLD flip-flop. The reset or clear signal, which will override the set signal, can occur from a number of different conditions as follows: the DEH system not being on operator automatic control (OA) or in the maintenance test condition (OPRT) (during which the system may be used as a simulator/-trainer), the GO flip-flop being set and thus overriding the HOLD state, or the condition in which the reference has reached the demand and the CONTROL task sets the GOHOLDOF state to clear the HOLD lamp. The HOLD logic program than resets the computed hold state (HOLDCP) and the GOHOLDOF state, so that they may be used in future decisions by the CONTROL and LOGIC tasks.

Governor Control Logic

Control of turbine steam flow with the governor valves is required during speed and load control. Normally governor control is initiated when the turbine has been accelerated to near synchronous speed, after which the unit is brought up to synchronous speed, synchronized and then load with the governor valves as the normal mode of operation.

The governor control logic detects turbine latch and unlatching conditions, transfer from throttle valve to governor valve control, and manual operation of the governor valves. When any of these conditions occur, the governor logic must align the DEH system to the appropriate governor control state.

The governor control flip-flop (GC) may be set by a number of conditions, the most common of which occurs on automatic control when the operator presses the transfer TV/GV pushbutton (TRPB). Assuming that the governor valves are at their maximum open position as indicated by GVMAX and that the automatic turbine startup mode (ATS) is not selected, then the governor flip-flop will be set. An alternate path for setting this flip-flop occurs if the automatic turbine startup program (ATS) requests transfers via the logical variable ATSTRPB. In addition, when the throttle valves reach about 90 percent position, a contact input (THI) is activated by the analog backup system, and this contact sets the GC flip-flop. This last case occurs when the turbine is a manual control. Finally, the governor control flip-flop is reset when the turbine latch contact input (ASL) is released.

Following the GC flip-flop, a decision is made to determine if the system has just switched to governor control by comparing GC with its last state (GCX). If transfer has just occurred, the turbine speed (WS) at this instant is saved as WSTRANS, the speed at throttle/-governor valve transfer. This value is used in the CONTROL task for a special valve position control logic decision. The last operation in the governor control program is to call the LCCO subroutine to update the GC lamp.

Throttle Valve Control Logic

Control of the turbine steam flow with the throttle valves is required when the turbine is initially rolled and during speed control up to the point of transfer to governor valve control. After this the throttle valve are kept wide open during normal operation. The throttle control logic detects turbine latch and unlatching conditions, transfer from throttle to governor valve control, and manual operation of the throttle valves. When any of these conditions occur the throttle logic must then align the DEH system to the appropriate throttle control state.

The throttle control state (TC) is simply the logical inverse of the governor control state (GC) when the turbine is latched. However, the throttle control lamp flip-flop (TCLITE) may be set by either TC or by manual operation (TM) while the throttle valves are below 90 percent open as indicated by the contact input (THI) not being set. The TCLITE flip-flop is reset by the contact input (THI) indicating throttle valves wide open or by the turbine latch contact input (ASL) not set.

The throttle control logic also indicates that the transfer from the throttle to governor valve state (TRTVGV) is underway when governor control (GC) exists but the throttle valves are not yet wide open. In addition, the transfer complete state (TRCOM) is set when the throttle valves are wide open on governor control as indicated by THI. Finally, the program sets various contact output to pass this information on to the plant an operating personnel by calling the LCCO subroutine.

Turbine Latch Logic

Before the turbine can be rolled and accelerated, it must be mechanically latched; this means the hydraulic fluid system must be prepared to move the throttle and governor valves, and a series of safety features as described in the turbine instruction book must be satisfied. After the turbine is latched, if unlatching should occur at any future time during speed or load control, then the control system must trip the turbine and close all valves immediately. The turbine latch logic detects latching or unlatching, and instantly sets the turbine reference and the control system to the proper states. A decision is made to determine if the turbine has just unlatched by comparing the current latch state (ASL) with the last state (ASLX). If unlatched has just occurred, then the DEH turbine reference given by REFDMD, the demand given by ODMD, and the speed integral controller given by RESSPD are immediately reset to zero. If the turbine has not unlatched, then a decision is made to determine if the turbine has just latched by a similar comparison of ASL and ASLX. If the unit has just latched, the DEH reference (REFDMD) and demand (ODMD) are set to the existing speed so that the control system may "catch the unit on the fly" should it be decelerating. The speed integral controller (RESSPD) is set to a zero value, from which point the control system will act to control the throttle valves.

Breaker Logic

The necessary and sufficient condition which must be satisfied when transferring from speed to load control is that the governor valve analog output must remain constant. This may be expressed as:

$$GVAO_{LOAD}=GVAO_{SPEED} \quad (1)$$

The computed values for these outputs may be written by referring to FIG. 14. This diagram shows the path taken by the CONTROL program on initial load control, when the megawatt and impulse pressure feebacks are out of service, and on speed control prior to breaker closing. The expressions for the two governor valve analog outputs given in Equation (1) above follow.

$$GVAO_{LOAD}=GR8 * GVPOS$$

$$GVAO_{SPEED}=GR7 * SPD$$

These may be substituted into Equation (1) and solved for the governor valve position (GVPOS) in terms of the governor valve speed position (SPD) and ranging gains (GR7 and GR8).

$$GVPOS = \frac{GR7}{GR8} * SPD \quad (2)$$

The required position (GVPOS) may in turn be related to the governor valve set point (GVSP) and the governor valve characterization curve. This relationship follows.

$$GVPOS = \frac{POS(2)}{SP(2)} * GVSP \quad (3)$$

POS(2) and SP(2)are points on the valve characterization and represent the slope of the first segment of the curve. Substitution of Equation (3) into (2) and solution for GVSP yields the required set point for correct valve position.

$$GVSP = \frac{SP(2)}{POS(2)} * \frac{GR7}{GR8} * SPD \quad (4)$$

Referring to the load control system an expression for the governor valve set point can be written in terms of additional computed quantities as follows:

$$GVSP = \frac{VSP}{GR4} \quad (5)$$

VSP is the governor valve set point in psi and GR4 is a ranging constant to convert to percent position. Substitution of Equation (5) into (4) produces the necessary value of VSP.

$$VSP = GR4 * \frac{SP(2)}{POS(2)} * \frac{GR7}{GR8} * SPD \quad (6)$$

Note that immediately after synchronizing, the impulse pressure loop is out of service. In this case, then the governor valve set point (VSP) in psi is identical to the impulse pressure set point (PISP) in psi. This is given below.

$$VSP=PISP \quad (7)$$

Substitution of Equation (7) into (6) yields the required value of PISP.

$$PISP = GR4 * \frac{SP(2)}{POS(2)} * \frac{GR7}{GR8} * SPD \quad (8)$$

Now the impulse pressure set point (PISP) can be related to the megawatt set point (REF2) as follows:

$$PISP=GR3*REF2 \quad (9)$$

GR3 is a ranging gain which converts megawatts to psi. Substitution of Equation (9) into (8) allows computation of REF2.

$$REF2 = \frac{GR4}{GR3} * \frac{SP(2)}{POS(2)} * \frac{GR7}{GR8} * SPD \quad (10)$$

Note that at the instant of synchronization, the megawatt feedback loop is out of service and that the speed error is essentially zero (otherwise the unit would not have been synchronized). Thus, the expression for the turbine reference is:

$$REFDMD = REF2 \quad (11)$$

Substitution of Equation (11) into (10) yields the desired result:

$$REFDMD = \frac{GR4}{GR3} * \frac{SP(2)}{POS(2)} * \frac{GR7}{GR8} * SPD \quad (12)$$

Equation (12) thus gives the required value which must be set into the turbine reference when the main breaker closes to maintain governor valve position on transfer from speed to load control. When this is added to the throttle-pressure modified initial megawatt pickup discussed above, the DEH Control System will make a smooth transfer from speed to load control with no potential motoring action by the turbine.

Figure 15:
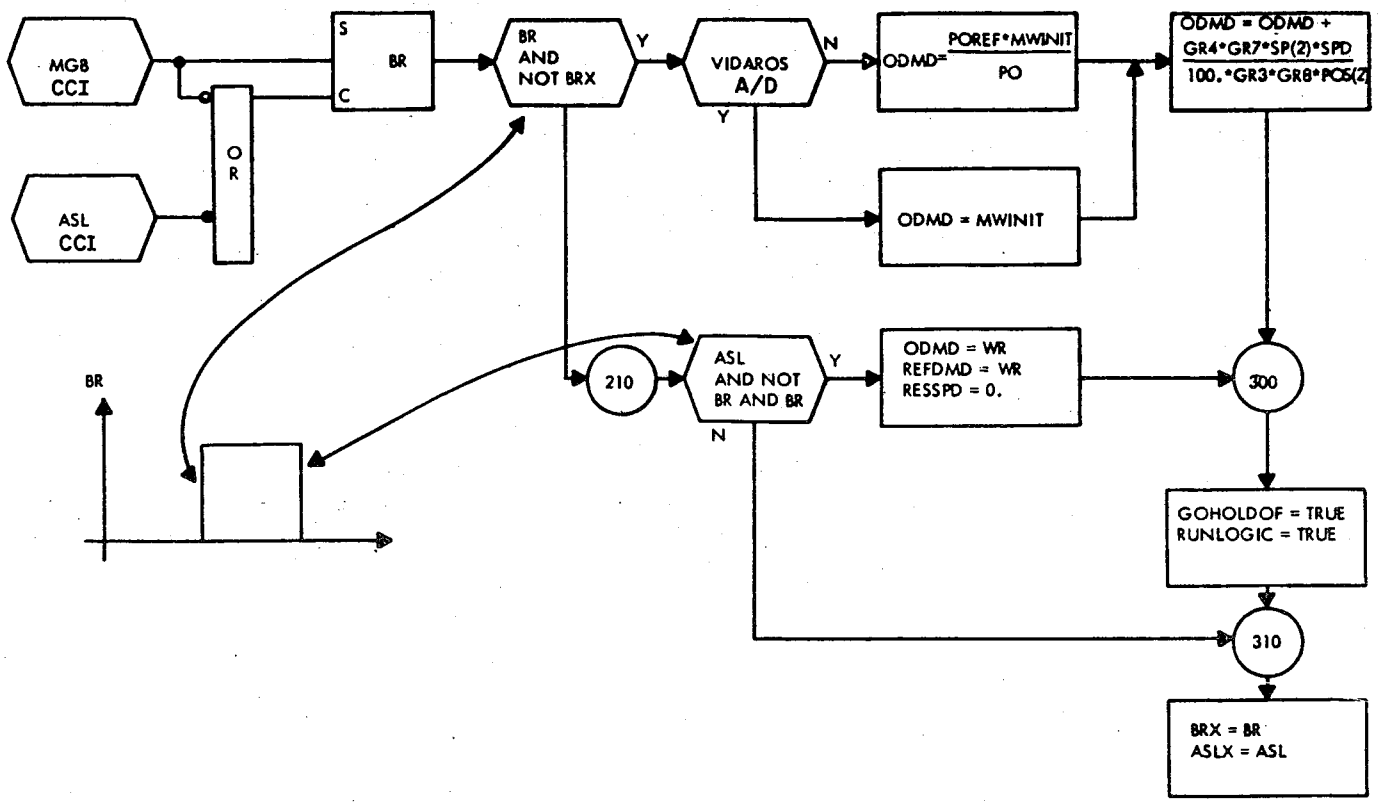
FIG. 15 is a flow chart of a breaker logic program which is operable in accordance with the principles of the invention.

As shown in FIG. 15, the main generator breaker contact input (MGB) sets the breaker flip-flop (BR), while loss of either MGB or the latch contact input (ASL) resets the BR flip-flop. Then a test is made to determine if the breaker just closed by comparing BR with its last state (BRX) as indicated by the leading edge of the BR pulse. If the breaker just closed, then the initial megawatt pickup (MWINIT) modified by throttle pressure ratio is computed as discussed above, the equivalent load governor position as given in Equation (12) is computed, and these are added together to form the new load REFERENCE and DEMAND.

If the breaker did not close, then BR and BRX are tested to see if the breaker opened as indicated by the trailing edge of the BR pulse. If this is the case, the turbine REFERENCE and DEMAND are set to synchronous speed, and logical flags set to rerun the LOGIC task to update the DEH system status. The final operation in the program then is to set the last states (MGBX and ASLX) to the current values of MGB and ASL for succeeding bids of the LOGIC task.

Throttle Pressure Control Logic

Control of throttle pressure in a fossil fired power plant is primarily a function of the boiler control system. Traditional turbine control practice is to react defensively to throttle pressure variations such that protection of the turbine is guaranteed. The DEH Control System is designed to detect throttle pressure below a set point and to runback the turbine reference at a preselected rate until the throttle pressure condition is corrected. For this purpose, the throttle pressure detector 112 of FIG. 1, transmits a signal to the DEH computer which is compared to a predetermined pressure set by keyboard 1816 entry on the Operator's Panel 1130. The throttle pressure control logic allows the throttle pressure controller to be placed in service or to be taken out of service by the operator when the turbine is on automatic control. In addition, this logic will automatically remove the loop from service under certain contingency conditions or when the turbine is in speed control.

Figure 16:
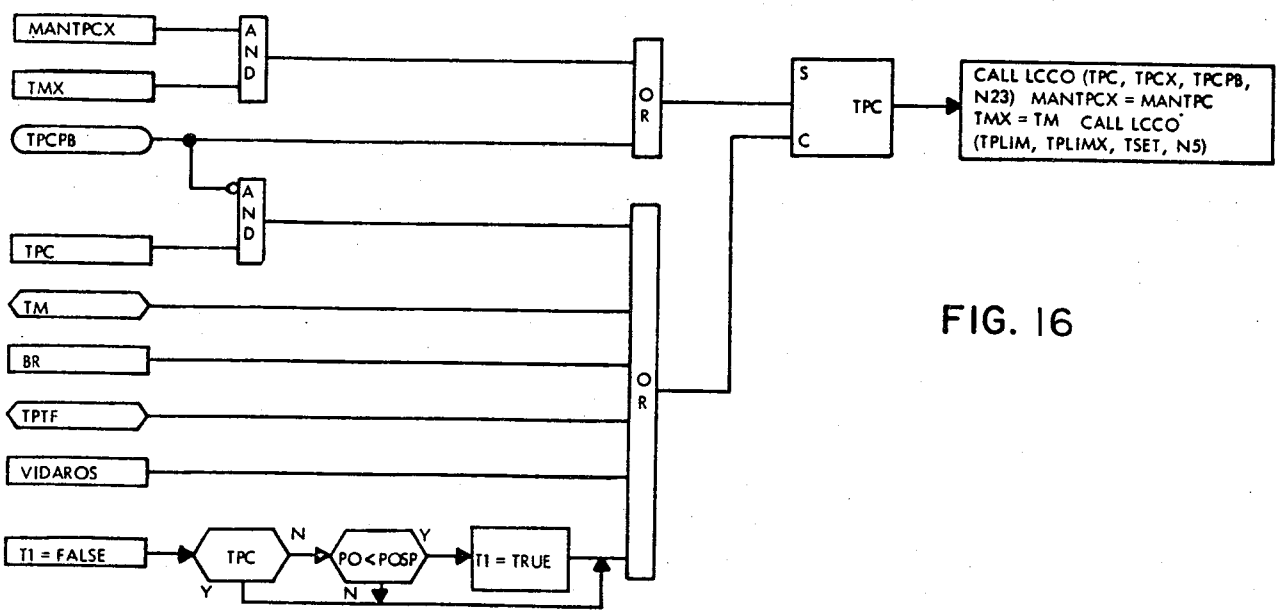
FIG. 16 is a flow chart of a logic pressure control logic subroutine which is operable in accordance with the principles of the invention.

With reference to FIG. 16, the throttle pressure control flip-flop (TPC) may be set by the throttle pressure pushbutton (TPCPB) on the Operator's Panel or by the analog backup system having its throttle pressure controller in service prior to transfer to automatic control; this latter case is given by the last state (MANTPCX) of the contact input (MANTPC) being set while in manual control. The TPC flip-flop is reset by a number of conditions; the panel pushbutton (TPCPB) when the loop is in service, breaker (BR) open, manual operation (TM), throttle pressure transducer failure (TPTF) which is a contact input from the backup system, the analog-to-digital converter out of service (VIDAROS), or an attempt to put the loop in service when the existing throttle pressure (PO) is below the set point (POSP). After evaluation of the TPC flip-flop, the program calls the LCCO subroutine to place the throttle pressure contact outputs in the correct state. Then the last values of the manual control and throttle pressure circuit are updated.

Megawatt Feedback Logic

To place the loop in service bumplessly, it is necessary to maintain constant governor valve position while inserting the megawatt proportional-plus-reset controller in the control system computations. This means that the integrator in this controller must be instantly set to the proper value, the reference must be reset to that value which will yield no change in governor valve position, and proper account must be taken of the speed feedback effect at the instant of putting the loop in service. A derviation of the equations necessary to guarantee these conditions follows.

REF2 is effectively the governor valve set point which must remain fixed in placing the loop in service, REFDMD is the turbine reference, X is the speed feedback effect and REF1 is the speed modified reference. When the loop is placed in service, the proper values of Y, the megawatt feedback factor, and RESMW, the megawatt integrator, must be computed, and REFDMD then readjusted to produce exactly the same value for REF2 to yield bumpless transfer. The necessary and sufficient condition for bumpless transfer then is that REF2 before and after the switching must be indentical, as shown in Equation (13).

$$REF2_{IN} = REF2_{OUT} \quad (13)$$

The value of REF2 before the switch is retained in computer memory, whereas the expression for REF2 after the loop is in may be determined result follows.

$$REF2_{IN} = Y*REF1_{IN} \quad (14)$$

Immediately after the switch, the value of REF1 must equal the existing analog input representing megawatts (MW), so that the integrator sees a zero error. Thus, an equation for this condition is:

$$REF1_{IN} = MW \quad (15)$$

Substituting Equations (13) and (15) into (14) and solving for the required value of the megawatt factor (Y) and therefore the megawatt integrator output (RESMW) yields the following result:

$$Y = RESMW = \frac{REF2_{OUT}}{MW} \quad (16)$$

Finally, to guarantee that the transfer will be bumpless the new value of REFDMD must be computed as follows.

$$REF1_{IN} = REFDMD_{IN} + X \quad (17)$$

Substituting Equation (15) into (17) and solving for REFDMD completes the required derivation.

$$REFDMD_{IN} = MW - X \quad (18)$$

The steps in the computation may be summarized: compute the new value of Y and RESMW from Equation (16), compute the new value of REFDMD from Equation (18), set the megawatt integrator last input (RESMWX) to zero, and place the loop in service.

To remove the megawatt loop from service bumplessly, a similar set of computations must be followed. The necessary and sufficient condition for bumpless transfer is to retain a constant value for REF2 as follows.

$$REF2_{OUT}=REF2_{IN}$$

The value of REF2 before the switch is retained in computer memory, whereas the expression for REF2 after the switch may be determined as given below.

$$REF2_{OUT}=REF1_{OUT}$$

Immediately after the switch, the value of REF1 must equal the value of REF2 before the switch, since the megawatt loop is now out of service.

$$REF1_{OUT}=REF2_{IN} \quad (19)$$

Finally, to guarantee the bumpless transfer, the new value of the reference REFDMD must be computed to satisfy Equation (19).

$$REF1_{OUT}=REFDMD_{OUT}+X \quad (20)$$

Substituting Equation (19) into (20) and solving for REFDMD yields the final result.

$$REFDMD_{OUT}=REF2_{IN}-X \quad (21)$$

Thus to take the megawatt loop out of service, the reference is reset to the value given in Equation (21) and the monitor lamp indication is reset.

The megawatt pushbutton, represented by MWIPB and updated by the PANEL program, sets the megawatt flip-flop (MWI), while this flip-flop may be reset by a number of conditions as follows: the main breaker (BR) open; a megawatt transducer failure (MWTF), which is a contact input set by the analog backup system; a valve position limit condition as indicated by VPLIM; an analog input failure (AIFAILMW) of the megawatt feedback signal as set by the ANALOG SCAN program; or the analog-to-digital converter out of service (VIDAROS). After evaluation of the megawatt flip-flop, decisions are made to determine if the megawatt loop has just been put into service or just taken out of service, assuming that the main breaker (BR) is closed. If the loop has just been put in, as indicated by the leading edge of the MWI pulse, then the bumpless transer computations listed in Equations (16) and (18) are executed. If the loop has just come out of service, as indicated by the trailing edge of the MWI pulse, then the bumpless transer computation listed in Equation (21) is executed. In both cases a call to the LCCO subroutine is made to place the megawatt lamp and two status contact outputs for the megawatt loop in the proper state.

Impulse Pressure Feedback Logic

To place the impulse pressure loop in service bumplessly, it is necessary to maintain the governor valves constant while inserting the impulse pressure proportional-plus-reset controller in the control system computations. This means that the integrator in the controller must be instantly positioned at the proper value. Depending on whether the megawatt feedback loop is in service at this time, one of the following two sets of derivations will be appropriate.

GR3 is a ranging constant which converts the megawatt reference value (REF2) to an impulse pressure set point (PISP) while IPI is the impulse pressure flip-flop. The analog input (PI) is the actual impulse pressure at the instant of placing the loop in service, RESPI is the impulse pressure integrator, and VSP is the governor valve set point. When the loop is put in service, both the integrator values (RESMW and RESPI) must be instantly recomputed to hold the governor valve set point (VSP) constant. Thus to remain bumpless, the following expression must hold.

$$VSP_{IN}=VSP_{OUT}$$

The value of VSP before the switch is retained in computer memory, whereas after the loop is in service, the value of VSP will be given by the integrator (RESPI). Therefore this integrator output must be instantly set to the value of VSP.

$$RESPI=VSP_{OUT} \quad (22)$$

The additional requirement is that the impulse pressure set point (PISP) be identical to the existing impulse pressure analog input at the instant of switching so that the integrator sees a zero error. This is satisfied as follows.

$$PISP_{IN}=PI \quad (23)$$

The computed value for PISP now may be written to determine what changes must be made to the megawatt integrator.

$$PISP=GR3*REF2_{IN} \quad (24)$$

The value of REF2 in turn may be determined in terms of REF1, which does not change when the impulse pressure is switched in since REF1 is upstream of the megawatt loop.

$$REF2_{IN}=Y*REF1 \quad (25)$$

Substituting Equations (23) and (24) into (25), and remembering that the megawatt correction factor (Y) and the megawatt integrator output (RESMW) are equal, the new value which must be given to RESMW may be solved for as follows:

$$RESMW = Y = \frac{PI}{GR3 * REF1} \quad (26)$$

The steps in the computation to place impulse pressure feedback into service when the megawatt loop is already in service may be summarized: compute the new value of the impulse integrator from Equation (22), set the last value of the impulse integrator input (RESPIX) to zero, compute the new value of the megawatt integrator from Equation (26), and place the loop in service.

To remove the impulse pressure feedback from service bumplessly, a similar set of computations must be followed. The necessary and sufficient condition is to hold the value of VSP constant as follows:

$$VSP_{OUT}=VSP_{IN} \quad (27)$$

The value of VSP before the switch will be retained in computer memory, whereas the value of VSP after the switch can be determined when the loop is out.

$$VSP_{OUT}=PISP \quad (28)$$

The set point (PISP) can in turn be computed as follows:

$$PISP=GR3*REF2 \quad (29)$$

Finally, REF2 may be determined from REF1 which does not change since it is upstream of the megawatt integrator.

$$REF2=Y*REF1 \quad (30)$$

Substituting Equations (27), (28) and (29) into (30), and remembering that the megawatt correction factor (Y) and the megawatt integrator (RESMW) are equal, the new value which must be given to RESMW may be solved for as follows:

$$RESMW = Y = \frac{VSP_{OUT}}{GR3 * REF1} \quad (31)$$

The steps in the computation to remove the impulse pressure feedback from service when the megawatt loop is in service are to compute the new value of the megawatt integrator from Equation (31) and then place the loop out of service.

The above set of computations hold for switching the impulse pressure loop while the megawatt loop is in service. The situation is significantly different when the megawatt loop is out of service, since then the reference must be reset to maintain a bumpless transfer. To put the impulse pressure loop in service bumplessly, it is necessary, as always, to keep the governor valve set point constant.

$$VSP_{IN}=VSP_{OUT}$$

Again, the value of VSP before the switch will be in computer memory. The remaining equations describing the system after the switch may be derived with results as follows:

$$RESPI=VSP_{OUT} \quad (32)$$

$$PISP=PI$$

$$PISP=GR3*REF2$$

$$REF2=REF1$$

$$REF1=REFDMD+X$$

Solving this set of equations for the new value of REFDMD yields the required condition.

$$REFDMD = \frac{PI}{GR3} - X \quad (33)$$

Thus, to summarize, when placing impulse pressure feedback in service with the megawatt loop out of service, it is necessary to set the impulse integrator (RESPI) to the value given in Equation (32), reset the last input to this integrator (RESPIX) to zero, compute the new reference REFDMD from Equation (33), and place the loop in service.

The last case to cover is that of removing the impulse pressure loop when megawatt feedback is out of service. Once more the governor valves must remain constant to assure bumpless transfer, as indicated below.

$$VSP_{OUT}=VSP_{IN}$$

As always, the value of VSP prior to the switch will be in computer memory. The set of equations describing the computations may be written as follows:

$$VSP_{OUT}=PISP$$

$$PISP=GR3*REF2$$

$$REF2=REF1$$

$$REF1=REFDMD+X$$

Solving this set of equations for the new value of REFDMD yields the required condition.

$$REFDMD = \frac{VSP_{IN}}{GR3} - X \quad (34)$$

Thus, REFDMD is computed according to Equation (34), the impulse pressure loop is removed, and the transfer proceeds bumplessly.

The impulse pressure pushbutton, represented by IPIPB and updated by the PANEL program, sets the impulse pressure flip-flop (IPI), while a number of conditions may reset the flip-flop as follows: the main breaker (BR) open; a valve position limiting condition as indicated by VPLIM; an analog input failure (AI-FAILPI) for the impulse pressure feedback signal as set by the ANALOG SCAN task; the analog-to-digital converter out of service (VIDAROS); or a contact input (SIO) to set impulse pressure out of service when in the automatic dispatch system (ADS) mode. After evaluation of the impulse pressure flip-flop (IPI), decisions are made to determine if the loop has just been put into service or just taken out of service assuming that the main breaker (BR) is closed. If the loop has just come in, as indicated by "the leading edge of the IPI pulse," then the bumpless transfer computations discussed and derived above are evaluated. If the loop has just come out, as indicated by "the trailing edge of the IPI pulse," then again appropriate bumpless transfer conditions are evaluated as discussed above. An additional decision is made on MWI as to whether or not the megawatt feedback loop is in service. As derived above, the form of the bumpless transfer computations depends on the state of the megawatt loop. After all expressions are evaluated, calls are made to the LCCO subroutine to place the impulse pressure lamp and two status contact outputs in the proper state.

Speed Feedback Logic

The speed feedback loop is critically important when the turbine is on automatic speed control, and is of somewhat less importance on load control. Without speed feedback on automatic speed control, the DEH system must reject to manual operation, while on automatic load control the DEH system merely removes the speed feedback loop from service. The operator may place the speed loop back in service after it has been rejected by pressing the speed loop pushbutton, providing the speed inputs have in the meantime been corrected and are again valid.

Once the speed feedback loop is in service, the operator cannot take it out of service, since standard turbine control practice requires speed in service at all times if the input signals are valid. Thus when the loop is in service, pressing the pushbutton is ignored. The only mechanism for taking the loop out of service is by automatic action of the DEH system programs when a speed transducer failure occurs. The speed feedback logic program responds to those conditions which will activate or deactivate the speed loop, whether the conditions be an operator pushbutton request or automatic rejection by the transducer failure.

Automatic Synchronizer Logic

The auto sync flip-flop (AS) may be set by the auto sync pushbutton (ASPB) or by the automatic turbine startup program request (ATSASPB), provided in both cases that the unit is on automatic control (OA), the breaker (BR) is open, the turbine is on governor control (GC), and the automatic synchronizer equipment permissive contact input (ASPERM) is set. Otherwise the AS flip-flop will be reset. Decisions are then made to determine if the AS flip-flop has just come on. If AS just came on, the temporary variable (T3) is set to indicate a remote control transfer for later logic programs. Then a call is made to the LCCO subroutine to set the auto sync lamp to the correct state; arguments in the call consist of the current state of AS, the last state (ASX), the auto sync pushbutton state (ASPB) which must be aligned with the AS flip-flop, and a pointer (N9) to a table of contact output words and bits which define connections to the auto sync lamp.

Decisions must be made in the auto sync logic program, when the AS mode has been selected, to detect whether the automatic synchronizing equipment is sending raise or lower pulses to the DEH system. Thus, if the leading edge of the ASUP contact input pulse has just come on, then the logical variable ASINC is set so that the CONTROL task may increment the turbine reference by one rpm. Similarly, if the leading edge of the ASDOWN contact input pulse has just come on, then the logical variable (ASDEC) is set so that the CONTROL task may decrement the turbine reference by one rpm. Finally, last values (ASUPX and ASDOWNX) are updated to the current states (ASUP and ASDOWN) in preparation for future bids of the LOGIC task.

Automatic Dispatch Logic

The automatic dispatch flip-flop (ADS) may be set by the automatic dispatch button (ADSPB), which is updated by the PANEL program, providing the unit is on automatic control (OA), the breaker (BR) is closed, and the automatic dispatch permissive contact input (ADSPERM) is set. Otherwise the ADS flip-flop will be reset. Decisions then are made to determine if the ADS flip-flop has just come on. If ADS just came on, the temporary variable (T3) is set to indicate a remote control transfer for later logic programs. Then a call is made to the LCCO subroutine to set the ADS lamp to the correct state; arguments in the call consist of the current state of ADS, the last state (ADSX), the automatic dispatch button (ADSPB) which must be aligned with the ADS flip-flop, and a pointer (N10) to a table of contact output words and bits which define connection to the ADS lamp.

Additional decisions must be made in the ADS logic program, when the ADS mode has been selected, to detect whether the ADS equipment is sending raise or lower pulses to the DEH system. Thus if the leading edge of the ADSUP contact input pulse has just come on, then a flip-flop (CADSUP) is set to start a counter which is handled by the AUX SYNC program. As long as CADSUP is set the AUX SYNC will count in 1/10 sec increments, thus determining the length of time the raise pulse is on. When the trailing edge of the ADSUP contact input pulse is detected, this means the raise contact has been released; this then resets the CADSUP flip-flop and the AUX SYNC program will stop counting. Finally, a logical state (ADSINC) is set so that the CONTROL task may raise the turbine reference by an amount proportional to the CADSUP counter. Identical checks and logical decisions are made with respect to the ADS lower contact input (ADSDOWN), after which last values of both ADSUPX and ADSDOWNX are updated with the current state of ADSUP and ADSDOWN in preparation for future bids of the LOGIC task.

Automatic Turbine Startup Logic

Figure 21:
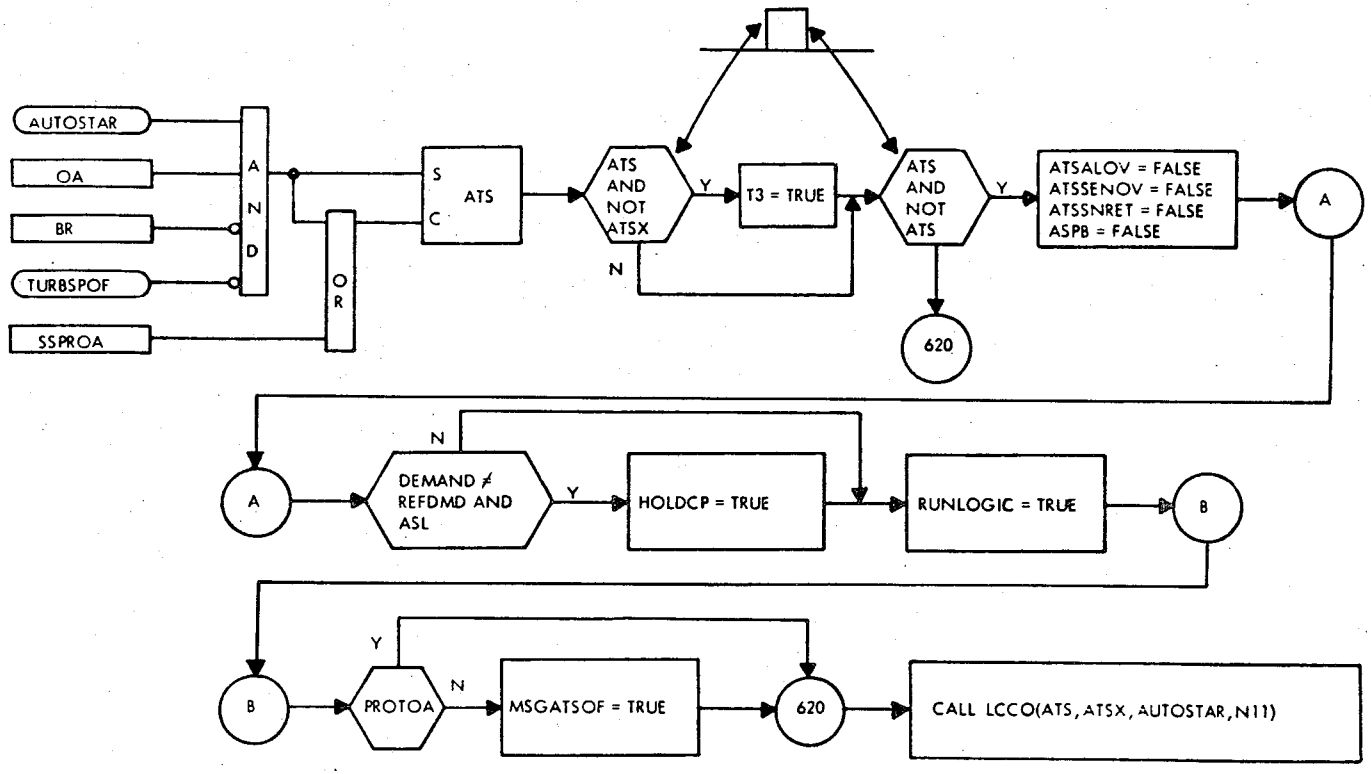
FIG. 21 is a flow chart of an automatic turbine startup program which is operable in accordance with the principles of the invention.

As shown in FIG. 21, the automatic startup flip-flop (ATS) may be set by the pushbutton (AUTOSTAR), which is updated by the PANEL task, provided the turbine is on automatic control (OA), the main breaker (BR) is not closed, and the turbine supervision off pushbutton (TURBSPOF) has not been pushed. Otherwise the ATS flip-flop will be reset by the lack of any of these conditions or by the automatic startup program itself through the variable SSPROA if the program detects improper conditions for startup.

Decisions are then made to determine if the ATS flip-flop has just come on. If so, a temporary logical variable (T3) is set to indicate a remote control transfer for later logic programs. A decision is also made to determine if the ATS flip-flop has just gone off. If this is the case, then a group of logical variables used in the ATS program must be reset. In addition, certain DEH system conditions must be aligned properly; these include the auto sync pushbutton (ASPB), which may have been set by the ATS program, and the reference/demand windows on the DEH Operator's Panel, which may have been left in an unequal state by the startup program. These conditions are cleared by setting RUNLOGIC to request another bid of the LOGIC task. Finally a call is made to the LCCO subroutine to set the ATS lamp to the proper state. Arguments in the call are the current state of ATS, the last state (ATSX), the auto state pushbutton (AUTOSTAR) which must be aligned with ATS, and a pointer (N11) to a table of contact output words and bits which define the hardware connections to the ATS lamp.

Remote Transfer Logic

To transfer from operator automatic to a remote mode, the operator simply presses the appropriate pushbutton on the Operator's Panel. Then, assuming all permissive conditions as described elsewhere in this writeup are satisfied, the new mode will be selected with a bumpless transfer in which the turbine valves remain at the existing position. In addition, a lamp behind the pushbutton selected will be turned on and the lamp for the previous mode will be turned off. Conversely, in order to return from any remote mode to operator automatic, the operator simply presses the OPER AUTO pushbutton. The remote transfer logic program detects operating mode changes and updates the panel lamps according.

As shown in FIG. 22, the temporary logical variable (T3), which has been updated in earlier portions of the logic programs, is checked to determine if any remote state has been selected. If so, the operator demand (ODMD) is set equal to the current reference (REFDMD), and logical flags are set to run the LOGIC task again to set the appropriate conditions in the DEH system. Then the status of the operator automatic lamp (OALITE) is determined since a remote control mode selection must result in turning off this lamp. Finally, a call to the LCCO subroutine is made to place this lamp in the proper state.

PANEL TASK

FIG. 24 shows a block diagram of the major functions performed by the PANEL task. These include executing each of the button group functions discussed above, as well as additional decisions, checks, and bookkeeping necessary to properly perform the action requested by the operator.

Control System Switching

There are six buttons on the Operator's Panel which may switch control states of the DEH system. A brief description of each follows:

1. TRANSFER TV/GV—This button initiates a transfer from throttle valve to governor valve control during wide-range speed operation. The push-button has a split lens. When control is on the throttle valves, the upper half of the lens is backlighted. When the button is pressed, to transfer control, the entire lens is backlighted. At the completion of the transfer, only the bottom half of the lens remains on. Once the DEH system is on governor control, it stays in this mode until the turbine is tripped and relatched. At this time, it is again in throttle valve control.
2. IMPULSE PRESSURE FEEDBACK IN/OUT—This is a push-push button with split lens. It places the impulse pressure feedback loop in or out of service, with appropriate backlighting of the button lens.
3. MEGAWATT FEEDBACK IN/OUT—This is a push-push button with split lens. It places the megawatt feedback loop in or out of service, with appropriate backlighting of the button lens.
4. SPEED FEEDBACK IN/OUT—This split lens button places the speed feedback loop in service in the DEH system. Normally the speed loop is always in service; however, when the DEH CONTROL task detects a speed channel failure condition in which all speed input signals are unreliable, the speed feedback loop is disabled and the speed channel monitor lamps turned on. When the speed inputs become reliable, the monitor lamps are turned off, thus indicating to the operator that he may place the speed feedback loop back in service. As long as the speed signals are reliable, the operator cannot take the speed loop out of service.
5. THROTTLE PRESSURE CONTROL IN/OUT—This is a push-push button with split lens which places the throttle pressure controller in or out of service, with appropriate backlighting of the lens.
6. CONTROLLER RESET—The button restores the DEH system to an active operating state after the computer has been stopped due to a power failure or hardware/software maintenance.

The logical variable TRPB is set when the TRANSFER TV/GB button is pressed. The impulse pressure, megawatt, and throttle pressure logical states (IPIPB, MWIPB and TRCB respectively) are set to the logical inverse of their previous state when the corresponding buttons are pressed. This is the mechanism which provides the push-push nature of these buttons. The logical variable SPIPB is set when the speed feedback button is pressed. Finally, each of these buttons initiate a bid for the LOGIC task by setting the RUNLOGIC variable prior to exit from the PANEL task.

The CONTROLLER RESET button is handled somewhat differently. The state CRESETPB is set by the STOP/INITIALIZE task, which does cleanup and initialization after a computer stop condition. Then CRESETPB is checked; if it is not set, the computer has been running, and thus the button pressed is ignored. If CRESETPB is set, this means the computer had been stopped; CRESETPB is reset and the lamp behind the button is turned off. In addition, the PANEL task effectively presses the speed feedback button by setting the logical state SPIPB. This is done so that the DEH system restarts after a power failure or other computer stop condition with the speed feedback loop in service. The LOGIC task is requested to run by setting the RUNLOGIC state. The REFERENCE display button is also effectively pressed so that the display windows always start out in the same mode after a stop condition on the computer.

Display/Change DEH System Parameters

Since the reference and demand control the turbine valves directly, it is essential that the operator have a unique handle on these quantities so that he may start or stop reference changes quickly and easily. This is accomplished by use of the GO and HOLD buttons in conjunction with the reference button. The GO and HOLD buttons control two reference states in the DEH system, which indicate whether the reference and demand are equal or unequal. When these quantities are equal, both the GO and HOLD backlights are off. When these quantities are unequal, either the GO or the HOLD lamp is on. If the GO light is turned on, the reference is changing to meet the demand value at the selected rate. Should the operator wish to stop the reference adjustment process, he simply presses the HOLD button. The HOLD button then backlights and holds the reference at its current value. When the operator wishes to start the reference moving again, he must press the GO button, which then backlights and enables the reference to adjust to the proper value.

The sequence of steps for displaying or changing the reference follows:

1. The operator presses the reference button. The DEH programs display the current value of reference in the left windows and the current value of demand in the right windows.
2. If the operator wishes to change the demand, he types the new value on the keyboard. This is displayed in the DEMAND windows, but is not yet entered into the DEH programs.
3. If the operator is satisfied with the new value, he presses the ENTER button. This places the new demand value in the DEH programs and turns the HOLD lamp, assuming that the new demand satisfies certain limit checks to be described shortly. If these conditions are not met, the INVALID RE- QUEST lamp is flashed, the new value is ignored, and the original value is returned to the DEMAND windows.

4. If the operator is not satisfied with the new value (set in Step 3), he simply presses the CANCEL button. The DEH programs then ignore this value and return the original value to the DEMAND windows.
5. If a new demand is finally entered and the HOLD lamp comes on, the operator may start the reference adjusting to this new demand by pressing the GO button. The HOLD lamp is turned off, the GO lamp is turned on, and the reference begins to move at the selected rate toward the demand.
6. At any time, the operator may inhibit the reference adjustment by pressing the HOLD button. He may then restart the reference adjustment by pressing the GO button.
7. When the reference finally equals the demand both the GO and HOLD lamps will be turned off.

Operating Mode Selection

There are five buttons which may be used to select the turbine operating mode. When any of these are pressed, they initiate major operating changes in the DEH Control System, assuming the proper conditions exist for the mode selected. A brief description of these buttons follows:

1. OPERATOR AUTOMATIC (OPER AUTO)—This button places the turbine in automatic control with the operator providing all demand, rate, and set point information from the keyboard. If the turbine had been previously in manual control, the OPER AUTO lamp must be flashing to indicate that the DEH system is ready to accept automatic control; otherwise pressing the OPER AUTO button is ignored. If the turbine had been in one of the remote control modes listed below, then pressing the OPER AUTO button rejects the remote and returns automatic control to the operator.
2. AUXILIARY SYNCHRONIZER (AUTO SYNC)—This button allows automatic synchronizing equipment to synchronize the turbine generator with the power system by indexing the speed demand and reference with raise/lower pulses, in the form of contact inputs.
3. AUTOMATIC DISPATCHING SYSTEM (ADS)—This button allows automatic dispatching equipment to operate the turbine generator by setting the load demand and reference. A number of dispatching options are available, including raise/lower pulses, raise/lower pulse-width modulation, and analog input values to set the reference.
4. AUTOMATIC TURBINE STARTUP (TURBINE AUTO START)—This button allows a special computer program to automatically start up and accelerate the turbine during wide-range speed control. The program may reside in the DEH computer or it may exist in another computer in the plant or at a remote location.
5. COMPUTER DATA LINK (COMP DATA LINK)—This optional button allows another computer, either in the plant or at a remote location, to provide all demand, rate, and set point information to the DEH system.

The OPER AUTO button resets the remote mode button states (ASPB, ADSPB and AUTOSTAR) for Automatic Synchronizer, the Automatic Dispatch System, and the AUTOMATIC TURBINE STARTUP program, respectively. Since the operator automatic state (OA) is merely the logical inverse of the turbine manual state (TM), the PANEL task cannot actually set OA, but can only request the LOGIC task to run, by setting the RUNLOGIC variable. The LOGIC program then determines whether or not operator automatic is accepted by the manual backup system.

The remote buttons set their corresponding pushbutton states after which RUNLOGIC is set. As in the case of operator automatic, the LOGIC task then determines if the requested mode will be accepted.

The data link button is handled somewhat differently; this is a push-push button whose state (DLINK) is given the logical inverse of its previous value at statement 14. The new state is then interrogated in order to determine whether to turn the button backlight on or off, after which the program exits.

Valve Status/Testing/Limiting

Nine buttons on the Operator's Panel are used for displaying valve status, testing the throttle and governor valves, and displaying or changing the valve position limit. Some of these buttons are used in more than one of these areas. A brief description of the three buttons associated with display of valve status follows:

1. VALVE STATUS—This button initiates a display of the status (position) of the turbine throttle and governor valves.
2. TV—This button provides the mechanism for the throttle valve status (position) to be displayed.
3. GV—This button provides the mechanism for the governor valve status (position) to be displayed.

A brief description of the four buttons associated with valve testing follows:

1. VALVE TEST—This button initiates a sequence of steps which results in throttle/governor valve testing.
2. TV—This button indicates that the turbine throttle valves are to be tested.
3. CLOSE—This button provides the mechanism for gradually closing the governor valve associated with the throttle valve to be tested.
4. OPEN—This button provides the mechanism for gradually opening the governor valve associated with the throttle valve which has just been tested.

Automatic Turbine Startup

Five buttons are associated with the automatic turbine startup feature of the DEH system. A brief description of these buttons follows:

1. AUTOMATIC TURBINE STARTUP (TURBINE AUTO START)—This button allows a special computer program to automatically start up and accelerate the turbine during wide-range speed control.
2. TURBINE SUPERVISION OFF—This is a push-push button which controls the printout of messages from the turbine supervisory programs. Normally, the messages are always printed; the operator may suppress printing by pressing this button, which then backlights. Should the messages be desired later, then the button may be pressed again; the lamp is turned off and the supervisory messages are printed on the typewriter.
3. OVERRIDE ALARM—This button overrides certain alarm stops which the AUTOMATIC TURBINE STARTUP program may detect. When this happens, the program waits for operator action before proceeding with the acceleration. If the operator decides to continue the startup, he presses the OVERRIDE ALARM button.

4. OVERRIDE SENSOR HOLD—This button overrides certain analog input sensor stops, which the AUTOMATIC TURBINE STARTUP program may detect. When this happens, the program waits for operator action before proceeding with the acceleration. If the operator decides to continue the startup, he presses this button.
5. RETURN SENSOR TO SCAN—This button returns certain analog inputs to scan after their sensor has been repaired. Should a sensor fall, the AUTOMATIC TURBINE STARTUP removes the corresponding input from scan; when the sensor is detected valid again, this button is backlighted to notify the operator. He then presses the button to return the input to its normal scan.

Manual Buttons

Six buttons on the Operator's Panel are associated with manual operation of the turbine. Even though the DEH PANEL program does not interface directly with these buttons, a brief description of their function is given for completeness. In general, these buttons allow the operator to control the position of the turbine throttle and governor valves directly from the panel.

1. TURBINE MANUAL—This button places the turbine under manual control of the operator, with the transition from automatic being achieved essentially bumplessly.
2. TV LOWER—This button lowers, or decreases, the throttle valves at a fixed rate as long as the button is held down.
3. TV RAISE—This button raises, or increases, the throttle valves at a fixed rate as long as the button is held down.
4. GV LOWER—This button lowers, or decreases, the governor valves at a fixed rate as long as the button is held down.
5. GV RAISE—This button raises, or increases, the governor valves at a fixed rate as long as the button is held down.
6. FAST ACTION—This button opens or closes the throttle and governor valves, at a fast rate, in manual control. The FAST ACTION button must be held down at the same time as any of the TV or GV RAISE/LOWER buttons described above to achieve the fast action effect.

CONTROL TASK

Select Operating Mode Function

The SELECT OPERATING MODE program must distinguish between speed and load control by examining the state of the main generator circuit breaker. For wide-range speed control, the program flow chart is shown in FIG. 28A. The automatic synchronizer state (AS) is first interrogated; if it is the operating mode, the auto sync increase and decrease states (ASINC and ASDEC) are examined. These states are flip-flops which are controlled by the LOGIC task when the auto sync raise or lower contact inputs are set. The program carefully checks to see if both the increase and decrease states are set; if so, no action is taken. Otherwise a temporary location (TEMP) is set to +1 rpm or −1 rpm for each pass through the program during which the appropriate contact input is set. The turbine speed reference and demand are then incremented properly, the ASINC and ASDEC states are reset for the next time, and the program passes to the next stage of the CONTROL task.

If the automatic synchronizer is not the operating mode, then the Automatic Turbine Startup (ATS) state is interrogated at statement 4000 (FIG. 28A). If it is the operating mode, as determined by the LOGIC task, the turbine speed demand and rate are selected from this program via computer locations TASDMD and TASRATE. The rate is then checked against an absolute high limit (OARATMAX), which is a keyboard entered constant usually set at 800 rpm after which the program passes on to the next stage of the CONTROL task.

If the AUTOMATIC TURBINE STARTUP program is not the operating mode, the Operator Automatic (OA) state, and the Maintenance Test (OPRT) state are interrogated at statement 6000 (FIG. 28A). If either of these states are set, the turbine speed demand and rate are selected from the keyboard and the program proceeds to the next stage of the CONTROL task. Note that on Operator Automatic the keyboard values control the turbine, while in Maintenance Test the keyboard values simulate a turbine.

In neither Operator Automatic nor Maintenance Test is the operating mode, then the turbine is in Manual control and the SELECT OPERATING MODE program goes into the manual tracking mode at statement 7000. If the contact input (THI) is set, this means the throttle valves are wide open and the turbine is in speed governor control. Then the error between manual and computer governor valve outputs (IGVMAN and IGVAO) is multiplied by a gain factor (GR10) and saved in a temporary location. If the contact input (THI) is not set, then the turbine is in speed throttle control and the error between manual and computer throttle valve outputs (ITVMAN and ITVAO) is multiplied by a gain factor (GR5) and saved in a temporary location.

In either case, assuming the speed loop (SPI) is in service, the valve output error is checked against a speed tracking deadband (DBTRKS, which is a keyboard entered constant usually set at 1 percent) and the reference is checked against actual speed (WS) through a reference tracking deadband (DBTRKREF, which is also a keyboard entered constant usually set at 50 rpm). If both conditions are met, the READY state is set to indicate the DEH system is ready to assume automatic control. The READY state is detected by the FLASH task, which then flashes the OPER AUTO light to let the operator known that he may transfer to automatic control.

Finally, the gained valve position error in the temporary location (TEMP) is used to increment the reference (REFDMD), which is then checked against an absolute high speed limit (HLS). This is a keyboard entered constant which is normally set at 4200 rpm. The program then transfers to statement 15500 for some final bookkeeping checks.

When the SELECT OPERATING MODE program determines that the main generator circuit breaker is closed, thus indicating the turbine is on load control, transfer is made to statement 10000 which is shown in FIG. 28B. The Throttle Pressure Control (TPC) state is interrogated; if it is in service, then the actual throttle pressure (PO) is compared against a set point (POSP), which is a keyboard entered constant usually set at about 1600 psia. If the throttle pressure (PO) is above the set point (POSP), no further action is taken. But if PO is below POSP, then the governor valve position (GVSP) as called for by the computer is checked against a minimum governor valve set point (GVSPMIN). This is a keyboard entered constant usually set at about 25 percent. If GVSP is less than GVSPMIN, no further action is taken, but if GVSP is greater than GVSPMIN, then the throttle pressure limiting state (TPLIM) is set and the reference load rate is set to runback the reference at the rate TPCRATE, which is a keyboard entered constant usually set at 200 percent per minute. The program then transfers to statement 11500 for further bookkeeping computation.

If no throttle pressure contingency exists, the RUNBACK contact input (RB) is interrogated; if it is set, the load reference is runback at the rate (RBRATE, which is a keyboard entered constant set at about 100 percent per minute. Then at statement 11500 some bookkeeping details are taken care of. Thus if the Automatic Dispatch System (ADS) state has been in control when either a throttle pressure limit or runback condition occurred, this mode is rejected by resetting the automatic dispatch system pushbutton state (ADSPB) and setting the RUNLOGIC flag. Within 1/10 sec the AUX SYNC task bids the LOGIC task, which then realigns all states to the correct position. A second bookkeeping check is made at statement 11700 where the HOLD state is checked. If HOLD is reset, then it is set so that the operator has an indication of why the reference has been runback.

If no runback contingency exists, then the Automatic Dispatch System (ADS) state is interrogated at statement 1200. If it is the operating mode, the ADS increase and decrease states (ADSINC and ADSDEC) are examined. These are flip-flops which are controlled by the LOGIC task when the ADS increase and decrease contact inputs are set. The program carefully checks to see if both the increase and decrease contacts are set; if so no action is taken. Otherwise a temporary location (TEMP) is set to the ADS raise or lower pulse count (IADSUP or IADSDOWN). The AUX SYNC task keeps track of these pulse counts according to the conditions set up by the LOGIC task. However, a maximum ADS pulse-width is imposed on both the raise and lower pulses in the SELECT OPERATING MODE program by comparing their counts (IADSUP and IADSDOWN) with a limit (ADSMAXT), which is a keyboard entered constant usually set to 10 counts of 1/10 sec each (thus yielding a maximum pulse-width of 1 sec). After the pulse-width limiting action, at statement 12400 the turbine load reference and demand are incremented by an amount proportional to the pulse-width; the proportionality factor (ADSTRATE) is a keyboard entered constant usually set somewhere between 1 and 10 MW per sec of pulse-width. Finally, at statement 12600, various ADS counters and states are reset prior to moving on to the next stage of the CONTROL task.

If the ADS state is not set, then the select operating mode program checks the Operator Automatic (OA) state and the Maintenance Test (OPRT) state at statement 14000. If either of these states are set, then the turbine demand and rate are accepted from the keyboard and the program proceeds to the next stage of the CONTROL task. Note that in Operator Automatic the keyboard values control the turbine, while in Maintenance Test the keyboard values simulate a turbine.

If neither Operator Automatic nor Maintenance Test is the operating mode, then the turbine is in Manual control and the SELECT OPERATING MODE program goes into the Manual Load Tracking mode at statement 1500. The error between the manual and computer governor valve outputs (IGVMAN and IGVAO) is stored in a temporary location (TEMP) and compared against a load tracking deadband (DBTRKL), which is a keyboard entered constant usually set at about 1 percent. If the outputs agree within DBTRKL, then the READY state is set to indicate the DEH system is ready to assume automatic control. The READY state is detected by the FLASH task, which then flashes the OPER AUTO light to let the operator know that he may transfer to automatic control.

The valve output error is then gain multiplied by GR9 and added to the current reference (REFDMD), which is high-limit-checked against MWMAX, a keyboard entered constant usually set to about 120 percent of rated megawatts. REFDMD is also low-limit-checked against zero, thus assuring that the tracking scheme will not windup in either direction. Finally, a last check is made to determine if a voltage exists on the test analog output lines; if so, the READY state is reset so that transfer to automatic control is inhibited until this voltage is removed. This may be done by pressing the OPEN valve test pushbutton until the lights behind the OPEN and CLOSE pushbutton go out.

Speed/Load Reference Function

The GO state is checked; if GO is off, the HOLD state is checked. If HOLD is on and the demand and reference value (REFDMD) are equal, then the logical states (GOHOLDOF and RUNLOGIC) are set. This results in the LOGIC task being bid within 1/10 sec by the AUX SYNC task, which recognizes the RUNLOGIC state. The LOGIC task then turns off the HOLD flip-flop and lamp as requested by the GOHOLDOF state.

If the GO state is set back however, then this is the signal to allow the reference to move toward the demand. The magnitude of the difference between the reference and the demand is computed and stored in a temporary location. Then the magnitude of the incremental step size taken each second by the selected rate, as discussed above, is saved in another temporary location. These two temporary quantities are then compared and if the demand/reference difference in TEMP is greater than the incremental step size in TEMP1, this means the reference must continue to move closer to the demand. However, the governor valve position limiting state (VPLIM) is checked; if it is set and the demand is above the reference, then no movement is allowed in the reference. This is because the valve position limit function is operating and refuses to allow any increase in reference because this will attempt to increase the governor valve position beyond the limit.

If there is no valve position limiting action, then the reference is incremented by the incremental rate step size and the program transfers for final exit.

Eventually the reference will approach within the allotted boundary of the demand. Then the reference program immediately sets the reference equal to the demand. Finally, the state of the breaker (BR) is interrogated; if it is set, the program transfers for the Load Control System computations, while transfer is made for the Speed Control System computations if the breaker state (BR) is reset.

Speed Control Function

To provide the simulation and training feature, FIG. 30 shows an additional program path which will internally generate a simulated speed signal (SIMWS) in the Maintenance Test mode of operation. This is accomplished by feeding back the speed controller output (SPDSP) through a first order lag transfer function which approximates the turbine inertia response. This simulated speed then replaced the actual speed in developing a speed error during the Simulation/Training mode of operation.

All speed control system parameters, such as gains, reset times and limits, are keyboard entered constants which are available for tuning or adjustment during the Maintenance Test mode. These changes require transfer of the turbine control to manual operation.

Logical checks are made to determine whether the speed computations should be evaluated. Thus, if the speed inputs failed and are unreliable, then the speed loop (SPI) is taken out of service, and there is no speed information by which to control the turbine. In addition, if the overspeed speed protection circuit in the Analog Backup System is operating, as indicated by the contact input (OPCOP), this closes the governor valve and thus overrides the DEH Speed Control System; consequently in this case, no speed control computations are performed.

Assuming that neither of these situations exist, the speed error is calculated. If the system is in the Stimulation/Training mode, this error is the difference between the reference and simulated speed; the speed error is the difference between the reference and actual speed in all other cases. Following this error computation, a decision is made as to whether the turbine is on governor or throttle control. Appropriate cells are then made to the PRESET subroutine to evaluate the proportional-plus-reset controller action for the throttle or governor valve. This subroutine takes care of evaluating the controller algorithm and the high/low limit checks to eliminate reset windup.

Load Control Function

As in the Speed Control System, all parameters in the Load Control System are keyboard entered constants, which may be tuned or adjusted in the Maintenance Test mode. As always, changes of this type require transfer to manual control for the adjustment, after which the DEH system will track and permit return to automatic control.

To provide the simulation and training feature disclosed previously, FIG. 31 shows additional program paths which internally generate simulated megawatt and impulse pressure signals (SIMMW and SIMPI) in the Maintenance Test mode of operation. These are accomplished by feeding back the load reference (REF2) and the valve set point (VSP) (through software) to first order lag transfer functions which approximate the generator and turbine responses. These simulated signals then replace the actual feedbacks in developing megawatt and impulse pressure errors during the Simulation/Training mode of operation.

A check is first made (FIG. 32) to determine if a change has occurred in the throttle pressure limit state (TPLIM); if so the LOGIC task aligns all status variables accordingly. The LOAD CONTROL program next checks the speed transducer failure state (SPTF). If there is no failure, the speed feedback loop is evaluated with a cell to the SPDLOOP subroutine; if there is a speed transducer failure, the speed feedback loop is bypassed and the speed compensation factor (X) is set to zero. Whichever is the case, the factor (X) is summed with the turbine load reference (REFDMD) to form the speed compensated load reference (REF1). A low-limit-check against zero is performed on REF1 to keep it from going negative, which is possible should a turbine overspeed condition result.

The LOAD CONTROL program then checks the maintenance test contact input (OPRT), which if set means the DEH system is being used as a simulator/-trainer or control system tuning is underway. In either case, simulated megawatt and impulse pressure signals (SIMMW and SIMPI) are generated; if the turbine is not in this mode, then the simulated signals are set equal to the actual signals.

The state of the megawatt feedback loop (MWI) is checked; if the loop is out of service, the speed/-megawatt compensated load reference (REF2) is simply set equal to the speed compensated load reference (REF1). But if the megawatt loop is in service, the megawatt error is computed and ranged to a per unit value by using the ranging gain (GR2), which is normally set at rated turbine generator megawatts. Then the PRESET subroutine is called to evaluate the megawatt proportional-plus-reset controller, including high/low limiting checking. The result of this computation is the megawatt trim factor (Y), which is then applied to the speed compensated load reference (REF1) in a product relationship to form the speed/megawatt corrected load reference (REF2).

The speed/megawatt compensated load reference (REF2) is converted to an impulse pressure set point (PISP) by use of ranging gain (GR3). The state of the impulse pressure feedback loop (IPI) is then interrogated; if it is out of service the governor valve set point (VSP) is simply set equal to the impulse pressure set point (PISP) in psi. But if the pulse pressure loop is in service, then the impulse pressure error is computed and used as the driving signal for the proportional-plus-reset controller, which is evaluated by a call to the PRESET subroutine; this also does the high/low limit checking.

Finally, the governor valve set point (VSP) in psi is converted to a governor valve set point from 0 to 100 percent by use of the ranging gain (GR4), which is normally set at rated impulse pressure. The program then transfers to the final stages of the CONTROL task which actually compute the throttle and governor valve outputs.

Throttle Pressure Control (TPC)

The TPC circuits provide a means (in the Turbine Manual mode) of controlling minimum throttle pressure. If throttle pressure falls below a set point (adjustable on the Test and Calibration Panel from 20 to 100 percent of rated pressure), the governor valves are closed until throttle pressure increases to the set point. The TPC circuits cannot close the governor valves to less than 20 percent open. The TPC circuits can be placed in, or out, of service in two ways, as follows:

1. TPC IN/TPC OUT pushbutton on the Operator B Panel.
2. Digital controller.

A hardware flip-flop and associated contact closure input to the controller ensure that both the analog and digital systems are in the same state. A transducer failure or the generator breaker opening will put the TPC circuits out of service. The TPC circuits cannot be restored to service until the problem is corrected. Also, the TPC circuits cannot be placed in service at any pressure below the TPC set point.

APPENDIX IX

Fortran Programs for the Manual Backup Function, etc. of the DEH and ATS Systems

```
C*****************************************************************************
C
C                    VALVE CONTINGENCY/MANUAL NOT TRACKING PROGRAM
C
C*****************************************************************************
C
46      VSTATCON=.FALSE.
        TVCONT=.FALSE.
        GVCONT=.FALSE.
        MANOTRAK=.FALSE.
        IF(TM) GO TO 50
        DO 48 I=1,2
C
C                    CHECK MANUAL E A L CONTINGENCY
C
        TEMP=ITVAO-ITVSS(I)
        IF(ABS(TEMP) .LT. TVDB) GO TO 47
        VSTATCON=.TRUE.
        TVCONT=.TRUE.
C
C                    CHECK GVEAOP A E CONTINGENCY
C
47      TEMP=IGVAO-IGVSS(I)
```

---

```
        IF(ABS(TEMP) .LT. GVDB) GO TO 48
        VSTATCON=.TRUE.
        GVCONT=.TRUE.
48      CONTINUE
C
C                    CHECK MANUAL TRACKING
C
        TEMP=ITVAO-ITVMAN
        IF(ABS(TEMP) .GE. TVMANDB) GO TO 49
        TEMP=IGVAO-IGVMAN
        IF(ABS(TEMP) .LT. GVMANDB) GO TO 50
49      MANOTRAK=.TRUE.
```

```
0197: C*****************************************************************************
0198: C
0199: C                    VALVE CONTINGENCY/MANUAL NOT TRACKING PROGRAM
0200: C
0201: C*****************************************************************************
0202: C
    0102    EFFD  E8 7 FD          SST  *M1CCO ,B
    0103    0030                   ADL  N1
    0104    0023                   ADL  IPAT
    0105    0011                   ADL  N27
    0106    0004                   ADL  MASK
0203: 46    VSTATCON=.FALSE.
0204:       TVCONT=.FALSE.
0205:       GVCONT=.FALSE.
0206:       MANOTRAK=.FALSE.
```

---

```
0207:       IF(TM) GO TO 50
    0045+B  0200
    0107    2045  28 4 45          LDA  =X'0000' ,B
    0108    1000  10 2 00          LDC  $+X'0000'
    0109    AE05  A8 6 05          STA  VSTATCON,C
    010A    AE06  A8 6 06          STA  TVCONT,C
    010B    AE07  A8 6 07          STA  GVCONT,C
    010C    AE03  A8 6 03          STA  MANOTRAK,C
    010D    10F1  10 2 F1          LDC  $+X'FFF1'
    010E    2813  28 6 13          LDA  TM,C
```

```
    0195    F250  50 2 00          JMP  $+X'0000'
0208:       60 48 I=1,2
0209: C
0392: C                    MANUAL - TRACK LOAD CONTROL
0393: C
    038D    7573  70 5 73          JMP  *)70 ,B
0394: 15000 TEMP=IGVMAN-IGVAO
0395:       TEMP=TEMP/40.96
0396:       READY=.FALSE.
0397:       IF(ABS(TEMP) .LT. DBTRKL) READY=.TRUE.
    038E    1200  10 2 00          LDC  $+X'0000'
    038F    2C14  28 6 14          LDA  IGVMAN,C
    0390    4E15  48 6 15          SUB  IGVAO ,C
    0391    EDEE  E8 5 EE          SST  *C11:,B
    0392    AC30  A8 4 30          STA  TEMP,B
    0393    A42F  A0 4 2F          STE  TEMP,B
    0394    EDED  E8 5 ED          SST  *D11:,B
    0395    0A3B                   ADL  =X'4A3'
    0396    AC30  A8 4 30          STA  TEMP,B
    0397    A42F  A0 4 2F          STE  TEMP,B
    0398    2C45  28 4 45          LDA  =X'0000' ,B
    0399    1200  10 2 00          LDC  $+X'0000'
    039A    AE04  A8 6 04          STA  READY ,C
    039B    EF00  E8 7 00          SST  *ABS ,B
    039C    002F                   ADL  TEMP
    039D    EDEB  E8 5 EB          SST  *S11:,B
    039E    0A3F                   ADL  DBTRKL
    039F    F200  B0 2 00          PJP  $+X'0000'
    03A0    2C48  28 4 48          LDA  =X'FFFF' ,B
    03A1    1208  10 2 08          LDC  $+X'0008'
    03A2    AE04  A8 6 04          STA  READY ,C
0398:       REFDMD=REFDMD+GR9*TEMP
0399:       IF(REFDMD .GE. MWMAX) REFDMD=MWMAX
    03A3    12D4  10 2 D4          LDC  $+X'FFD4'
    03A4    2E63  28 6 63          LDA  GR9 ,C
    03A5    2E62  20 6 62          LDE  GR9 ,C
    03A6    EDEC  E8 5 EC          SST  *M11:,B
    03A7    002F                   ADL  TEMP
    03A8    EDEA  E8 5 EA          SST  *A11:,B
    03A9    007D                   ADL  REFDMD
    03AA    12CA  10 2 CA          LDC  $+X'FFCA'
    03AB    AE19  A8 6 19          STA  REFDMD,C
    03AC    A618  A0 6 18          STE  REFDMD,C
    03AD    EDEB  E8 5 EB          SST  *S11:,B
    03AE    8090                   ADL  MWMAX
    03AF    B200  B8 2 00          NJP  $+X'0000'
    03B0    12C7  10 2 C7          LDC  $+X'FFC7'
    03B1    2E83  28 6 83          LDA  MWMAX ,C
    03B2    2E82  20 6 82          LDE  MWMAX ,C
    03B3    12C1  10 2 C1          LDC  $+X'FFC1'
    03B4    AE19  A8 6 19          STA  REFDMD,C
    03B5    A618  A0 6 18          STE  REFDMD,C
0400: 15500 IF(REFDMD .LT. 0.) REFDMD=0.
    03B6    12BE  10 2 BE   )15500 LDC  $+X'FFBE'
    03B7    2C19  28 6 19          LDA  REFDMD,C
    03B8    2C18  20 6 18          LDE  REFDMD,C
    03B9    B200  B0 2 00          PJP  $+X'0000'
    03BA    2C27  28 4 27          LDA  =X'0000' ,B
    03BB    2426  20 4 26          LDE  =X'0000' ,B
    03BC    12B8  10 2 B8          LDC  $+X'FFB8'
    03BD    AE19  A8 6 19          STA  REFDMD,C
    03BE    A618  A0 6 18          STE  REFDMD,C
0401:       ODMD=REFDMD
0402:       TEMP=ITESTAO
0403:       IF(TEMP .GE. TESTAIMX) READY=.FALSE.
    03BF    12B5  10 2 B5          LDC  $+X'FFB5'
    03C0    2C19  28 6 19          LDA  REFDMD,C
    03C1    2C18  20 6 18          LDE  REFDMD,C
    03C2    AE31  A8 6 01          STA  ODMD,C
    03C3    A630  A0 6 00          STE  ODMD,C
    03C4    1236  10 2 36          LDC  $+X'0036'
    03C5    2E26  28 6 26          LDA  ITESTAO ,C
    03C6    EDEE  E8 5 EE          SST  *C11:,B
    03C7    AC30  A8 4 30          STA  TEMP,B
    03C8    A42F  A0 4 2F          STE  TEMP,B
    03C9    EDEB  E8 5 EB          SST  *S11:,B
    03CA    0A91                   ADL  TESTAIMX
    03CB    B200  B0 2 00          NJP  $+X'0000'
    03CC    2C45  28 4 45          LDA  =X'0000' ,B
```

```
    03CD    122C  10 2 2C          LDC   $+X'002C'
    03CE    AE04  A3 6 04          STA   READY ,C
0404:       GO TO 300
0405: C
0406: C*****************************************************************************

C                    VALVE STATUS DISPLAY
C
800     IF(.NOT. VTESTPB) GO TO 850
        IF(NVTEST .EQ. 0) GO TO 830
        IWINDOW=NVTEST
        I=N5
        GO TO 620
830     J=INDEX2+N4
        GO TO 860
850     J=INDEX2
860     TEMP=ITVGVS3(J)
        TEMP=TEMP/40.96
        IK(N5)=N3
C
C                    LOCATE DECIMAL POINT
C
900     IF(TEMP .GE. 0.) GO TO 910
        TEMP=-TEMP
        IK(N5)=N10
910     IF(TEMP .GE. 9999.) TEMP=9999.
        DO 930 I=N1,N4
        IF(TEMP .LT. XCHK(I)) GO TO 940
930     CONTINUE
940     INDEX3=5-I
        IWINDOW=XCHK(INDEX3+1)*TEMP+.001
950     I=N2
960     N=N4
```

---

```
0192: C
0193: C                    VALVE STATUS DISPLAY
0194: C
    0144    7572  70 5 72          JMP   *)900,B
0195: 800   IF(.NOT. VTESTPB) GO TO 850
```

---

```
    0145    1200  10 2 00   )800   LDC   $+X'0000'
    0146    2E12  28 6 12          LDA   VTESTPB ,C
    0147    5452  50 4 52          EOR   #X'FFFF' ,B
    0148    F200  F0 2 00          ZJP   $+X'0300'
    0149    7575  70 5 75          JMP   *)850,B
0196:       IF(NVTEST .EQ. 0) GO TO 830
    014A    12BD  10 2 BD          LDC   $+X'FFBD'
    014B    2E03  28 6 03          LDA   NVTEST,C
    014C    F201  F0 2 01          ZJP   $+X'0001'
    014D    7200  70 2 00          JMP   $+X'0000'
    014E    7576  70 5 76          JMP   *)830,B
0197:       IWINDOW=NVTEST
0198:       I=N5
0199:       GO TO 620
    014F    12B8  10 2 B8          LDC   $+X'FFB8'
    0150    2E03  28 6 03          LDA   NVTEST,C
    0151    A406  A8 6 06          STA   IWINDOW ,C
    0152    2049  28 4 49          LDA   N5,B
    0153    AC5C  A8 4 5C          STA   I ,B
    0154    7062  70 5 62          JMP   *)620,B
0200: 830   J=INDEX2+N4
0201:       GO TO 860
    0155    12B2  10 2 B2          LDC   $+X'FFB2'
    0156    2E05  28 6 05          LDA   INDEX2,C
    0157    4A0F  40 4 0F          ADD   N4,B
    0158    AC73  A8 4 73          STA   J ,B
    0159    7077  70 5 77          JMP   *)860,B
0202: 850   J=INDEX2
```

```
    015A    12[illegible]  10 2 AD   )850     LDC   $+X'FFAD'
    015B    2[illegible]   28 6 05            LDA   INDEX2,C
    015C    AC73   A8 4 73                    STA   J ,B
0203: 860   TEMP=ITVGVSS(J)
0204:       TEMP=TEMP/40.96
0205:       IW(N3)=N3
0031: C
0032: C                 RESTORE SPEED CHANNEL SYSTEM
0033: C
0034: 35    LDA         =8913
    0000    [illegible]                       DAT   X'0000'
    0001    [illegible]  08 2 FF              LDB   $+X'FFFF'
    0006+B  22D1                )5
    0002    2C[illegible]  28 4 05            LDA   =X'22D1' ,B
0035: 5     IOA         32
    0003    8[illegible]  88 0 20             IOA   X'2020'
0036: C
0037: C                 RESET ALL CCO'S AND A/O'S
0038: C
0039:       DO 20 I=1,32
```

---

```
    0007+B  [illegible]
    0004    2[illegible]  28 4 07             LDA   =X'0001' ,B
    0005    AC[illegible]  A8 4 06            STA   I ,B
0040:       CALL M:CCO(N1,N0,I,MASK)
    0006    EF[illegible]  E8 7 00            SST   *M:CCO ,B
    0007    [illegible]                       ADL   N1
    0008    [illegible]                       ADL   N0
    0009    [illegible]                       ADL   I
    000A    [illegible]                       ADL   MASK
0041: 20    CONTINUE
```

I claim:

1. An automatic digital electrohydraulic control system for a steam turbine having a plurality of throttle and governor valves, said control system comprising means for generating respective signals representative of the actual turbine speed and load, an operator panel having means for generating mode select signals and load and speed demand signals, an electrohydraulic control for positioning the throttle and governor valves in response to valve position signals, means for digitally generating the valve position signals in response to the actual and demand speed and load signals and the mode select signals during the speed and load modes of turbine operation, a manual backup control for generating valve position signals to operate the valves for speed and load control when said digital generating means is nonoperational, said mode select generating means including means for generating an automatic operation signal, means for tracking the valve position outputs from said digital generating means to the valve position signals generated during the manual mode of operation, and means for disabling a signaled transfer to automatic operation if predetermined conditions are sensed which indicate defective tracking operation by said digital means.

2. A control system as set forth in claim 1 wherein means are provided for comparing the manual and digital valve outputs and a transfer to automatic is disabled if the comparison value exceeds a predetermined limit.

3. A control system as set forth in claim 1 wherein said digital generating means includes a speed control to which a speed reference is applied, means are provided for comparing the actual turbine speed with the turbine speed reference and a signaled transfer to automatic is disabled if the comparison value exceeds a predetermined limit.

4. A control system as set forth in claim 2 wherein said digital generating means includes a programmed digital computer, said computer having a speed control to which a speed reference is applied, means for comparing the actual turbine speed with the turbine speed reference, and means for disabling a signaled transfer to automatic if either comparison exceeds a predetermined limit associated with it.

5. An automatic digital electrohydraulic control system for a steam turbine having a plurality of throttle and governor valves, said control system comprising means for generating respective signals representative of the actual turbine speed and load, an operator panel having means for generating mode select signals and load and speed demand signals, an electrohydraulic control for positioning the throttle and governor valves in response to valve position signals, means for digitally generating the valve position signals in response to the actual and demand speed and load signals and the mode select signals during the speed and load modes of turbine operation, a manual backup control for generating valve position signals to operate the valves for speed and load control when said digital generating means is nonoperational, said mode select generating means including means for generating an automatic operation signal, said digital generating means including a speed control and a load control functioning respectively in the speed and load modes of operation, means for generating a logical output indicating breaker closure to provide for transfer from speed control to load control, and means for applying inputs to said load control which cause a match between the load control and speed control outputs at the time of transfer to provide for bumpless operation.

6. A control system as set forth in claim 5 wherein said digital generating means includes a programmed digital computer.

7. An automatic digital electrohydaulic control system for a steam turbine having a plurality of throttle and governor valves, said control system comprising means for generating respective signals representative of the actual turbine speed and load, an operator panel having means for generating mode select signals and load and speed demand signals, an electrohydraulic control for positioning the throttle and governor valves in response to valve position signals, means for digitally generating the valve position signals in response to the actual and demand speed and load signals and the mode select signals during the speed and load modes of turbine operation, a manual backup control for generating valve position signals to operate the valves for speed and load control when said digital generating means is nonoperational, said mode select generating means including means for generating an automatic operation signal, said digital generating means including a mode selector responsive to the mode selection signals, said mode select generating means including means for generating an automatic synchronizer signal, and a synchronizer control responsive to external synchronizer inputs for varying the digital valve position signals during synchronization if the automatic synchronizer mode select signal has been generated and the automatic operation mode select signal has been generated.

8. An automatic digital electrohydraulic control system for a steam turbine having a plurality of throttle and governor valves, said control system comprising means for generating respective signals representative of the actual turbine speed and load, an operator panel having means for generating mode select signals and load and speed demand signals, an electrohydraulic control for positioning the throttle and governor valves in response to valve position signals, means for digitally generating the valve position signals in response to the actual and demand speed and load signals and the mode select signals during the speed and load modes of turbine operation, a manual backup control for generating valve position signals to operate the valves for speed and load control when said digital generating means is nonoperational, said operator panel mode select generating means including means for generating an automatic operation signal, said digital generating means including a mode selector responsive to the mode selection signals, said mode select generating means including means for generating an automatic turbine startup signal, an automatic turbine startup control for generating a speed demand as a function of representations of turbine rotor stress, said speed control operating in response to said startup control if said mode selector indicates the automatic turbine startup mode select signal has been generated, and said speed control operating in response to panel speed demand signals if said mode selector indicates the automatic operation mode select signal has been generated and the automatic startup mode select signal has not been generated.

9. A control system as set forth in claim 8 wherein said mode select generating means including means for generating an automatic synchronizer signal, and a synchronizer control responsive to external synchronizer inputs for varying the digital valve position signals during synchronization if the automatic synchronizer mode select signal has been generated and the automatic operation mode select signal has been generated.

10. A control system as set forth in claim 9 wherein said digital generating means includes a programmed digital computer.

11. An automatic digital electrohydraulic control system for a steam turbine having a plurality of throttle and governor valves, said control system comprising means for generating respective signals representative of the actual turbine speed and load, an operator panel having means for generating mode select signals and load and speed demand signals, an electrohydraulic control for positioning the throttle and governor valves in response to valve position signals, means for digitally generating the valve position signals in response to the actual and demand speed and load signals and the mode select signals during the speed and load modes of turbine operation, a manual backup control for generating valve position signals to operate the valves for speed and load control when said digital generating means is nonoperational, said operator panel mode select generating means including means for generating an automatic operation signal, said digital generating means including a mode selector responsive to the mode selection signals, said digital generating means including speed and load controls for varying the valve position control signals during speed and load control and for generating outputs uncoupled from the valves during a maintenance/test mode of operation, said mode select generating means including means for generating a maintenance/test mode signal, and means for coupling the panel speed and load demand signal to said speed and load controls if said mode selector indicates the maintenance/test mode select signal or automatic operation mode select signal has been generated.

12. A control system as set forth in claim 11 wherein said digital generating means includes a programmed digital computer.

* * * * *